United States Patent [19]

Itoh et al.

[11] Patent Number: 4,888,268

[45] Date of Patent: Dec. 19, 1989

[54] SILVER HALIDE PHOTOGRAPHIC MATERIALS COMPRISING BLOCKED PHOTOGRAPHIC REAGANTS RELEASING PLUG GROUPS

[75] Inventors: Isamu Itoh; Mitsunori Ono; Yoshio Inagaki, all of Minami-ashigara, Japan

[73] Assignee: Fuji Photo Film Co., Ltd., Kanagawa, Japan

[21] Appl. No.: 234,008

[22] Filed: Aug. 16, 1988

Related U.S. Application Data

[63] Continuation of Ser. No. 906,074, Sep. 11, 1986, abandoned.

[30] Foreign Application Priority Data

| | | | |
|---|---|---|---|
| Sep. 11, 1985 | [JP] | Japan | 60-200751 |
| Oct. 4, 1985 | [JP] | Japan | 60-221295 |
| Oct. 4, 1985 | [JP] | Japan | 60-221296 |
| Dec. 18, 1985 | [JP] | Japan | 60-285348 |
| Dec. 20, 1985 | [JP] | Japan | 60-287336 |

[51] Int. Cl.[4] ..... G03C 1/40; G03C 1/48; G03C 5/54

[52] U.S. Cl. ..... 430/218; 430/223; 430/224; 430/443; 430/445; 430/446; 430/561; 430/566; 430/598; 430/955; 430/957; 430/958; 430/960

[58] Field of Search ..... 430/955, 957, 958, 960, 430/566, 598, 561, 443, 445, 446, 218, 223, 224

[56] References Cited

U.S. PATENT DOCUMENTS

| | | | |
|---|---|---|---|
| 4,310,612 | 1/1982 | Mooberry et al. | 430/223 |
| 4,358,525 | 11/1982 | Mooberry et al. | 430/217 |
| 4,500,636 | 2/1985 | Uno et al. | 430/566 |
| 4,554,243 | 11/1985 | Ono et al. | 430/543 |
| 4,618,563 | 10/1986 | Uno et al. | 430/219 |
| 4,629,683 | 12/1986 | Itoh et al. | 430/390 |
| 4,772,537 | 9/1988 | Itoh et al. | 430/219 |

*Primary Examiner*—Paul R. Michl
*Assistant Examiner*—Patrick A. Doody
*Attorney, Agent, or Firm*—Birch, Stewart, Kolasch & Birch

[57] ABSTRACT

A silver halide photographic material, which contains at least one blocked photographic reagent having in the molecule thereof at least one group selected from group and capable of releasing a photographically useful reagent by cleavage of the —N—C—bond by a nucleophilic attack of a nucleophilic reagent on the carbonyl group and a subsequent intramolecular electron transfer reaction or intramolecular nucleophilic reaction and which has at least one photosensitive silver halide emulsion layer, is photographically processed in the presence of an amine. A photographic material which includes, in combination, a photographic reagent precursor capable of releasing a photographically useful reagent timely on photographic processing and a photosensitive silver halide emulsion layer is provided along with a method of processing the photographic material.

22 Claims, No Drawings

SILVER HALIDE PHOTOGRAPHIC MATERIALS COMPRISING BLOCKED PHOTOGRAPHIC REAGANTS RELEASING PLUG GROUPS

This application is a continuation of application Ser. No. 06/906,074 filed on Sept. 11, 1986, now abandoned.

BACKGROUND OF THE INVENTION

1. Field of the Invention

The present invention relates to photographic materials which comprise, in combination, a precursor of a photographic reagent capable of releasing a photographically useful reagent timely on photographic processing and a silver halide emulsion layer, and a method of processing the photographic material.

2. Description of the Prior Art

When photographically useful reagents are added to a photographic material, several advantages are attained due to the mixture of the reagents, which are totally different from the use of photographic reagents contained in a processing solution. For example, (1) it is possible to use photographic reagents which are likely to readily decompose with acids or alkalis or under oxidation or reduction conditions and which cannot withstand a processing bath for a long period of time, (2) the composition of a processing solution is simplified and is easy to prepare, (3) it is possible to permit a necessary photographic reagent to react with good timing at the time of the processing, (4) it is possible to allow a necessary reagent to act on a necessary spot, i.e. a specific type of layer and/or its adjacent layer alone of a multi-layer photographic material, and (5) the amount of a photographic reagent can be varied as a function of development with silver halide. However, if photographic reagents are added to a photographic material in the active form, they react with other ingredients of the photographic material during storage prior to the processing or decompose by the action of heat or oxygen. Thus, they cannot exhibit the performance that will be expected at the time of the processing.

One of processes known in the art to solve the above problem is to block active groups of a photographic reagent into substantially inert groups in the photographic material. In other words, the photographic reagent is added to the photographic material as a precursor of a photographic reagent reacting only at the time of the developing process.

According to the above process, when the useful photographic reagent is, for example, a dye, functional groups which influence on the spectral absorption of the dye are blocked and cause the spectral absorption to be shifted toward a side of a shorter or longer wavelength. Accordingly, if such a dye coexists in a silver halide emulsion layer having a desired light-sensitive spectral range, any lowering of the sensitivity due to filter effects does not occur. When the useful photographic reagent is an antifoggant or a development restrainer, blocking of the active groups permits the desensitizing action due to absorption on the photosensitive silver halide or its formation of a silver salt during storage to be suppressed. At the same time, the fogging is reduced without deteriorating the sensitivity, the fogging by excess development can be suppressed or the development can be stopped at any time required due to the timely release of the photographic reagent during the developing process. When the useful photographic reagent is a developing agent, a developer aid, a development accelerator or a nucleating agent, various adverse photographic effects caused by formation of semiquinone or oxidants by oxidation with air during storage or formation of fogging nuclei during storage caused by injection of electrons into the silver halide can be prevented by blocking of the active or adsorbing groups. As a result, a stable photographic processing is ensured. Similarly, when the photographic reagent is a bleaching promoter or a bleaching and fixing promoter, blocking of the active groups permits the reaction with other ingredients during storage to be suppressed so that a required performance may be obtained at a required time by removing protecting groups at the time of the development.

As explained hereinabove, the precursors of photographic reagents are effective in showing a satisfactory performance of the photographic reagents. On the other hand, however, these precursors must satisfy very severe reciprocal requirements. The precursors must meet such a contradictory requirement that they are stable under conditions of storage and the blocking groups can be removed at a required time so as to rapidly and efficiently release the photographic reagent.

Several blocking techniques for photographic reagents are known in the art. For instance, Japanese Patent Publication No. 44805/72 describes the utilization of blocking groups such as acyl, sulfonyl and the like groups. In Japanese Patent Publication Nos. 39727/79, 9696/80 and 34927/80, blocking groups which can release a photographic reagent according to a so-called Michael reaction are utilized. Japanese Patent Publication No. 39727/79, and Japanese Patent Application (OPI) Nos. 135944/82, 135945/82, and 136640/82 describe the utilization of blocking groups capable of releasing photographic reagents accompanied by the formation of quinone methide or its analogous compounds by the electron transfer in the molecule. In Japanese Patent Application (OPI) No. 53330/80, there is described the utilization of an intramolecular ring closure reaction. Japanese Patent Application (OPI) Nos. 76541/82, 135949/82 and 179842/82 describe the utilization of cleavage of five-membered or six-membered ring compounds.

These known blocking techniques for photographic reagents are disadvantageous in that, when using stable precursors under storing conditions, the speed of releasing a photographic reagent at the time of the processing is so small that the precursors have to be subjected to a high alkali treatment of a pH over 12, and a high temperature or a long thermal developing time is required at a time of a thermal development. Even though a satisfactory releasing speed is satisfied by the use of a processing solution having a pH of 9 to 12 or by ordinary thermal developing processing, precursors gradually decompose under storage conditions and lose their characteristic properties.

When a liquid developer having a high pH over 12 is used, the developer is susceptible to oxidation with air. Thus, the shelf stability of the developer becomes lower and corrosion of a developing bath is accelerated. In addition, because of the high skin irritativeness, it becomes difficult to handle. Furthermore, the photographic sensitivity and the stability of a formed image are difficult to maintain when using a liquid developer of a higher pH.

SUMMARY OF THE INVENTION

It is therefore an object of the present invention to provide a precursor of a photographic reagent which is completely stable under storage conditions of photographic materials and can release the photographic reagent at a desired time during a developing processing.

It is another object of the present invention to provide a precursor of a photographic reagent which is able to release the reagent, as desired, in a processing solution of a relatively low pH of from 9 to 12 or under ordinary thermal developing conditions.

It is a further object of the present invention to provide a silver halide photographic material which comprises precursors of photographic reagents.

It is a still further object of the present invention to provide a process for the photographic treatment of a silver halide photographic material containing such precursors of photographic reagents as described above.

Other objects, features and advantages of the invention will appear more fully from the following description.

DETAILED DESCRIPTION OF THE INVENTION

The above objects of the invention can be achieved by a blocked precursor of a photographic reagent (hereinafter referred to as photographic reagent precursor) which comprises at least one

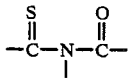

group or

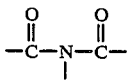

group and which is able to release the photographic useful reagent by cleavage of the

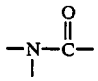

bond by nucleophilic attack of a nucleophilic reagent on the carbonyl group and a subsequently intramolecular electron transfer reaction or intramolecular nucleophilic reaction.

The silver halide photographic material according to the invention comprises a photographic reagent precursor of the type mentioned above and has at least one photosensitive silver halide emulsion layer.

Typical examples of the photographic reagent precursors capable of releasing photographically useful reagents, used in the present invention, include those of the following general formula (I) to (IV)

General formula (I)

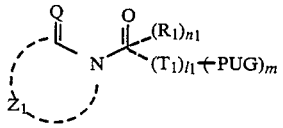

General formula (II)

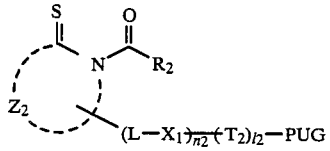

General formula (III)

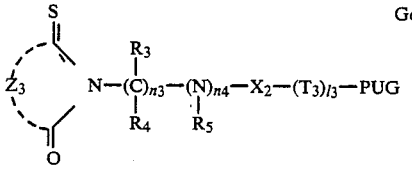

General formula (IV)

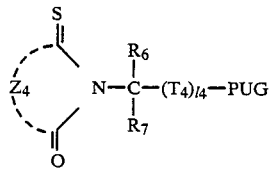

In general formulae (I) to (IV), PUG represents a photograpically useful group; $T_1$, $T_2$, $T_3$ and $T_4$ independently represent a timing group; $R_1$, $R_2$, $R_3$, $R_4$, $R_5$, $R_6$ and $R_7$ independently represent a hydrogen atom or a substituent; $X_1$ and $X_2$ independently represent a electrophilic center; L represents a connecting group; and $Z_1$, $Z_2$, $Z_3$ and $Z_4$ independently represent a non-metallic element group to form five to seven-membered rings and may form a fused ring. In the above formulae, $l_1$, $l_2$, $l_3$ and $l_4$, m, and $n_1$, $n_2$, $n_3$ and $n_4$ are independently 0 or 1, with the provision that in the general formula (I), $m+n_1=1$ and when $m=1$, $l_1$ is 0 or 1 and when $m=0$, $l_1=0$. In the general formula (III), $n_3+n_4$ is an integer of from 1 to 3.

In general formula (I), $Z_1$ preferably represents alkylene, cycloalkylene, alkenylene, arylene, aralkylene, acylalkylene, acylaralkylene, thioalkylene, thioalkenylene, thioarylene, thioaralkylene, oxyalkylene, oxyalkenylene, oxyarylene, oxyaralkylene, aminoalkylene, aminoalkenylene, aminoarylene, aminoaralkylene, heterocycles or the like. The five- to seven-membered rings represented by $Z_1$ have preferably a hetero atom and may form a fused ring. In the general formula (I), when $m=0$, the heterocyclic ring formed by $Z_1$ serves as the photographically useful group. In the case of $m=1$, the heterocyclic ring formed by $Z_1$ may also be a photographically useful group.

Examples of the preferable hetero atoms in $Z_1$ include a sulfur atom, an oxygen atom or a substituted imino group (e.g., methylamino, n-butylamino-n-hexadecylamino, 2-methoxyethylamino, acetylamino, benzoyl amino, PUG—$(T_1)n_1$—CON=). Of these, sulfur and oxygen atoms are preferable, of which a sulfur atom is most preferable.

Specific preferable examples of the five to seven-membered rings represented by $Z_1$ include thiosuccinic acid imide, thiomaleimide, imidazoline-2-thio-5-one, imidazolidine-2-thio-4-one, oxazolidine-2-thio-4-one, thiazoline-2-thio-4-one, thiophthalimide, piperidine-6-thio-2-one, dihydrooxazine-2-thio-4-one, tetrahydrooxazine-2-thio-4-one, dihydrothiazine-2-thio-4-one, tetrahydrothiazine-2-thio-4-one, tetrahydropyrimidine-2-thio-4-one, hexahydropyrimidine-2-thio-4-one, dihydroazepine-7-thio-2-one, tetrahydroazepine-7-thio-2-one, hexahydroazepine-7-thio-2-one and the like. These rings may further have a substituent. Preferable examples of the substituent include a halogen atom (e.g., a fluorine atom, a chlorine atom, a bromine atom), an alkyl group (e.g., a methyl group, a butyl group, a hexadecyl group), an aryl group (e.g., a phenyl group, a naphthyl group, a 4-t-octylphenyl group, a 4-hexadecyloxyphenyl group), an alkenyl group (e.g., an isopropylidene group, a benzilidene group), an alkoxy group (e.g., an ethoxy group, a butoxy group, a decyloxy group), an aryloxy group (e.g., a phenoxy group, a 4-dodecyloxycarbonylphenoxy group), an alkylthio group (e.g., an ethylthio group, an octylthio group, a dodecylthio group), an amino group (e.g., a dimethylamino group, an N-methyl-N-octylamino group, an anilino group, a morpholino group), an acyl group (e.g., an acetyl group, an octanoyl group, a palmitoyl group, a benzoyl group), a carbamoyl group (e.g., a methycarbamoyl group, a butylcarbamoyl group, a dodecylcarbamoyl group, a 4-hexadecyloxyphenylcarbamoyl group), a carbonamide group (e.g., a butyramide group, an octanamide group, a benzamide group), a ureido group (e.g., an ethylureido group, a decylureido group, a tetradecylureido grop, a phenylureido group), a sulfamoyl group (e.g., a methyloctylsulfamoyl group, a dioctylsulfamoyl group, a methylhexadecylsulfamoyl group, a phenylsulfamoyl group), a sulfonamido group (e.g., an octylsulfonamido group, a hexadecylsulfonamido group, a 4-t-octylphenylsulfonamido group), a sulfonyl group (e.g., an ethylsulfonyl group, a hexylsulfonyl group, a 4-decaneamidophenylsulfonyl group), a carboxyl group, a sulfo group, an oxycarbonyl group (e.g., an octyloxycarbonyl group, a tetradecyloxycarbonyl group, a phenyloxycarbonyl group), a carbonyloxy group (e.g., an acetyloxy group, a palmitoyloxy group a benzoyloxy group), a cyano group, a nitro group, a 2-pyridyl group, and a 1-benzotriazole group.

In general formula (I), Q preferably represents a sulfur atom.

The photographically useful groups represented by PUG in general formula (I) may be those of usual photographic reagents bonded through a hetero atom. Examples of the reagents include antifoggants or development restrainers such as mercaptotetrazoles, mercaptotriazoles, mercaptopyrimidines, mercaptobenzimidazoles, mercaptothiadiazoles, benzotriazoles, imidazoles and the like; developing agents such as p-phenylenediamines, hydroquinones, p-aminophenols and the like; auxiliary developing agent such as pyrazolidones; nucleating agents such as hydrazines, hydrazides and the like; solvents for silver halide such as sodium thiosulfate; bleach promoters such as aminoalkylthiols; or azo dyes and azomethine dyes. Photographic reagents which have the redox function capable of releasing the above-indicated photographic reagents as a function of development may also be used, including, for example, colorants for color diffusion transfer sensitive materials or DIR-hydroquinones.

The term timing group, $T_1$, of general formula (I) is known per se and means a group having a timing function that a time to a state capable of utilizing the group represented by PUG is properly delayed. More particularly, $T_1$ has the function of permitting a given time to pass after the bond has been cleft to form the $(T_1)l_1$-PUG residue but before the bonding between PUG and $(T_1)l_1$ is cleft. Accordingly, when $(T_1)l_1$-PUG is diffusible, it will be possible to design a photographic material in which PUG is formed and works at a portion distant from a position where a precursor is incorporated.

Particularly preferable timing groups employed in the photographic reagent precursor are represented by the following formulae wherein symbol * expresses the position at which the residue except PUG and the timing group is bonded, and symbol ** expresses the position at which PUG is bonded. The timing group may be the combination of the following two or more formulae:

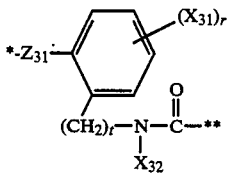

(T-1)

wherein $Z_{31}$ represents

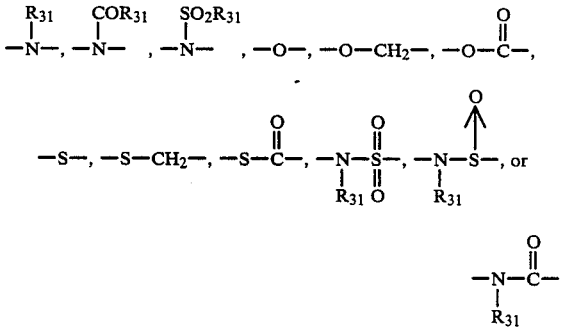

wherein $R_{31}$ is a hydrogen atom, an aliphatic, alicyclic, or aromatic hydrocarbon group, or a heterocyclic group; $X_{31}$ represents an aliphatic, alicyclic or aromatic hydrocarbon group or a heterocyclic group,

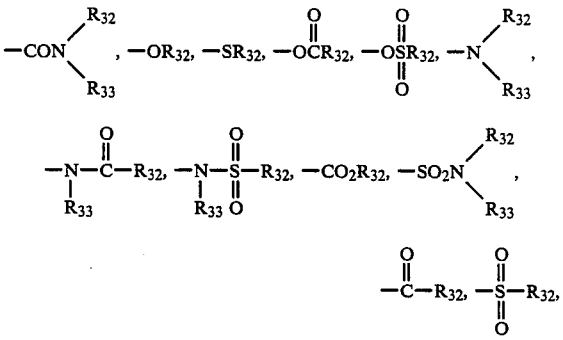

a cyano group, halogen atoms (e.g., fluorine, chlorine, bromine, and iodine) or a nitro group wherein $R_{32}$ and $R_{33}$ may be or may not be identical and express the same groups as described for $R_{31}$; $X_{32}$ represents the same groups as described for $R_{31}$; r represents an integer of from 0 to the total number of hydrogen atoms in the ring which are able to be substituted (in formula (T-1) r represents an integer of from 0 to 4), and when r is 2 or more, the substituent represented by $X_{31}$ may be or may not be identical, and when r is 2 or more, $X_{31}$ may link to each other to form a ring; and t represents 0, 1 or 2.

The groups represented by formula (T-1) are, for example, described in U.S. Pat. No. 4,248,962:

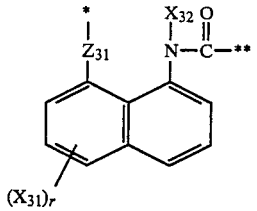

(T-2)

wherein $Z_{31}$, $X_{31}$, $X_{32}$ and r denote the same meanings as those defined in the formula (T-1):

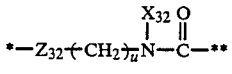

(T-3)

wherein $Z_{32}$ represents

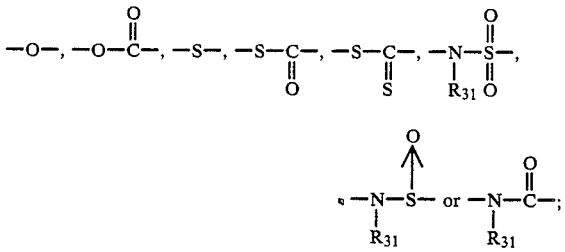

u is an integer of from 1 to 4, preferably being 1, 2 or 3; and $R_{31}$ and $X_{32}$ denote the same meanings as those defined for formula (T-1):

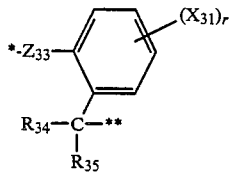

(T-4)

wherein $Z_{33}$ represents —S— or

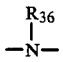

wherein $R_{36}$ expresses an aliphatic, alicyclic or aromatic hydrocarbon group, acyl, sulfonyl or heterocyclic group; $R_{34}$ and $R_{35}$ denote the same meanings as $R_{31}$ defined for formula (T-1); and $X_{31}$ and r denote the same meanings as those defined for formula (T-1).

An example of the group represented by formula (T-4) is the timing group described in U.S. Pat. No. 4,409,323:

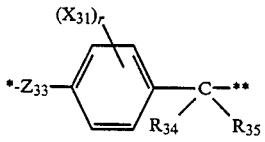

(T-5)

wherein $Z_{31}$, $X_{31}$, $R_{34}$, $R_{35}$, and r denote the same meanings as those defined for formula (T-4):

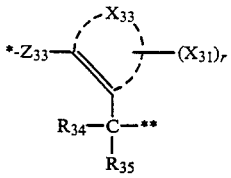

(T-6)

wherein $X_{33}$ is an atomic group which comprises at least one atom selected from the class consisting of carbon, nitrogen, oxygen and sulfur and which is necessary to form a 5- to 7-membered heterocyclic group, which may be further condensed with a benzene ring or a 5- or 7-membered heterocyclic group, exemplarily preferable heterocyclic groups being pyrrole, pyrazole, imidazole, triazole, furan, oxazole, thiophene, thiazole, pyridine, pyridazine, pyrimidine, pyrazine, azepin, oxepin, indole, benzofuran, and quinoline; and $R_{34}$, $R_{35}$, $Z_{33}$, $X_{31}$ and r denote the same meanings as those defined for formula (T-4).

An example of the group represented by formula (T-6) is the timing group described in British Patent No. 2,096,783:

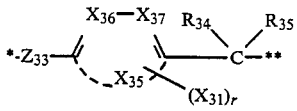

(T-7)

wherein $X_{35}$ is an atomic group which comprises at least one atom selected from the class consisting of carbon, nitrogen, oxygen, and sulfur and which is necessary to form a 5- or 7-membered heterocyclic group, which may be condensed further with a benzene ring or a 5- or 7-membered heterocyclic group, exemplarily preferable heterocyclic groups including pyrrole, imidazole, triazole, furan, oxazole, oxadiazole, thiophene, thiazole, thiadiazole, pyridine, pyridazine, pyrimidine, pyrazine, azepin, oxepin, and isoquinoline; $X_{36}$ and $X_{37}$ is

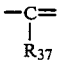

or —N= wherein $R_{37}$ expresses a hydrogen atom, an alipatic-, alicyclic- or aromatic-hydrocarbon group; and $R_{34}$, $R_{35}$, $Z_{33}$, $X_{31}$ and r denote the same meanings as those defined for formula (T-4):

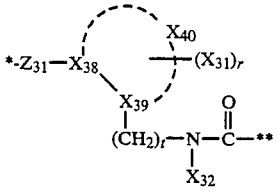

(T-8)

wherein $X_{40}$ is an atomic group which comprises at least one atom selected from the class consisting of carbon, nitrogen, oxygen, and sulfur and which is necessary to form a 5- to 7-membered heterocyclic group, which may be further condensed with a benzene ring or 9 5- to 7-membered heterocyclic group, exemplarily preferable heterocyclic groups being pyrrolidine, piperidine, and benzotriazole besides those given for formula (T-6); $X_{38}$ and $X_{39}$ are $$-\overset{|}{C}= \quad \text{or} \quad -\overset{|}{N}-;$$

and $Z_{31}$, $X_{31}$, $X_{32}$, t and r denoe the same meanings as those defined for formula (T-1):

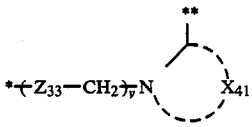

(T-9)

wherein $X_{41}$ denotes the same meaning as $X_{40}$ defined for formula (T-8); $Z_{33}$ denotes the same meaning as that defined for formula (T-4) and v expresses 0 or 1. Exemplarily preferable heterocyclic groups including $X_{41}$ are as follows:

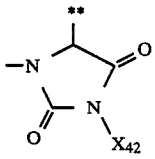

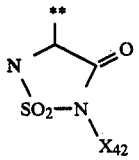

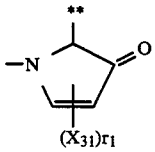

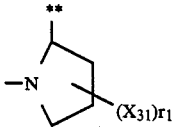

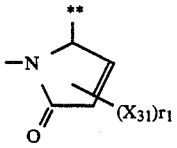

-continued

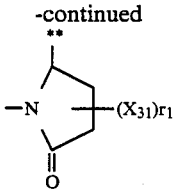

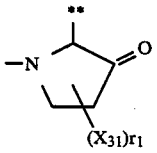

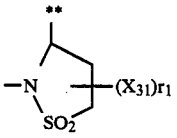

wherein $r_1$ represents an integer of 1 and 2, $X_{31}$ denotes the same meaning as those defined for formula (T-1); and $X_{42}$ represents a hydrogen atom, an aliphatic-, alicyclic-, or aromatic-hydrocarbon group, an acyl, sulfonyl, alkoxycarbonyl, sulfamoyl, heterocyclic, or carbamoyl group.

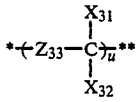

(T-10)

wherein $X_{31}$ and $X_{32}$ denote the same meanings as those defined for formula (T-1), $Z_{33}$ denotes the same meaning as that for formula (T-4) and u denotes the same meaning as that for formula (T-3) and is preferably 1 or 2.

In the above formulae (T-1) to (T-10), $X_{31}$, $X_{32}$, $R_{31}$ to $R_{37}$ have preferably from 1 to 20 carbon atoms, and may be saturated or unsaturated, substituted or unsubstituted, straight or branched chain when they contain an aliphatic hydrocarbon moiety, and have preferably 5 to 20 carbon atoms and may be saturated or unsaturated, substituted or unsubstituted when they have an alicyclic hydrocarbon moiety. The above $X_{31}$, $X_{32}$, $R_{31}$ to $R_{37}$ have from 6 to 20 carbon atoms, preferably from 6 to 10 carbon atoms, and are preferably a substituted or unsubstituted phenyl group when they contain an aromatic hydrocarbon moiety. The above $X_{31}$, $X_{32}$, $R_{31}$ to $R_{37}$ are 5- or 6-membered heterocyclic groups having as hetero atoms at least one member of the group consisting of nitrogen, oxygen and sulfur atoms when they contain a heterocyclic moiety. Examples of the preferable heterocyclic groups are a pyridyl, furyl, thienyl, triazolyl, imidazolyl, pyrazolyl, thiadiazolyl, oxadiazolyl or pyrrolidinyl group.

Examples of the preferred timing groups are as follows:

(1)

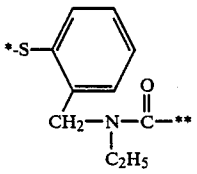

-continued
(2)
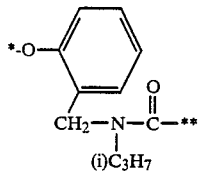
(3)
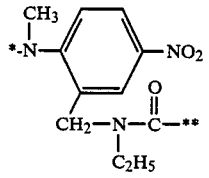
(4)
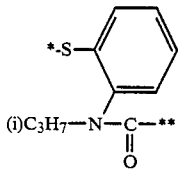
(5)
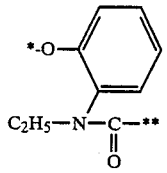
(6)
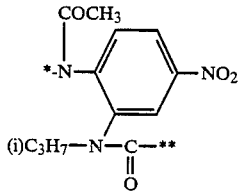
(7)
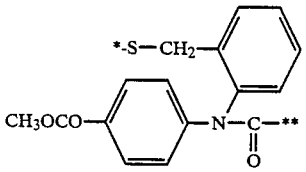
(8)
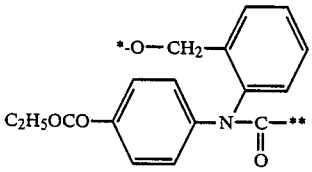
(9)
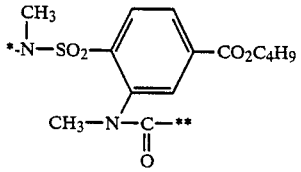

-continued
(10)
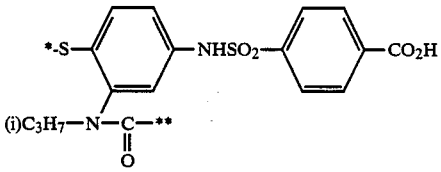
(11)
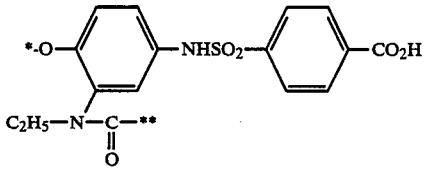
(12)
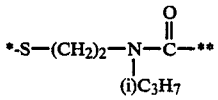
(13)
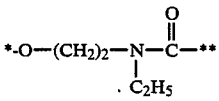
(14)
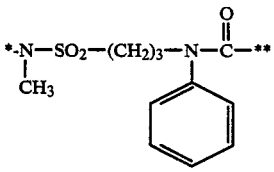
(15)
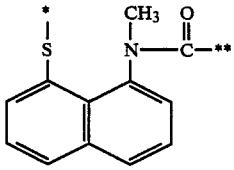
(16)
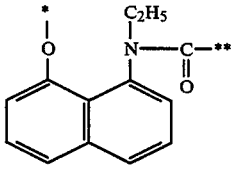
(17)
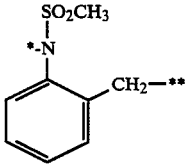
(18)
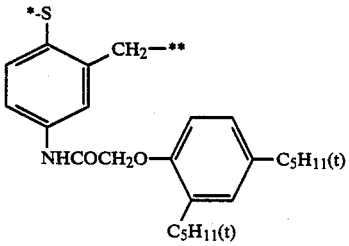

-continued
(19)
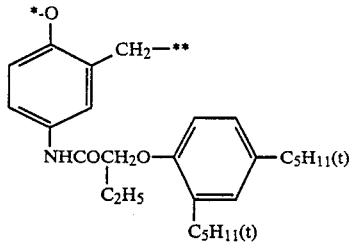
(20)
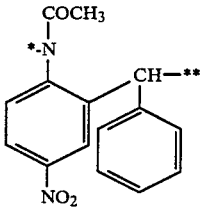
(21)
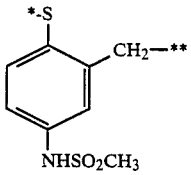
(22)
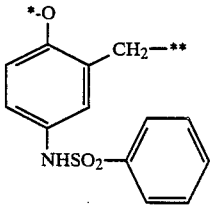
(23)
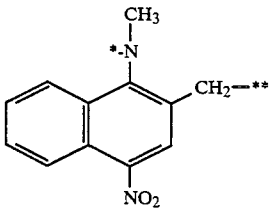
(24)
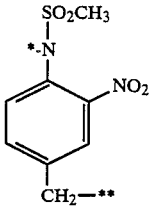
(25)
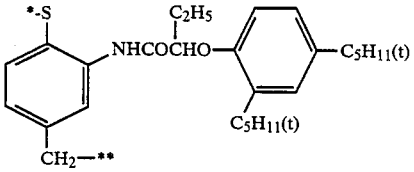

-continued
(26)
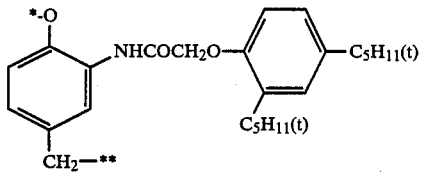
(27)
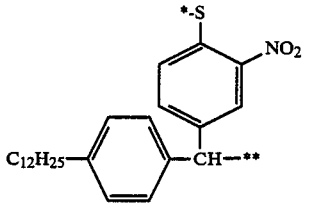
(28)
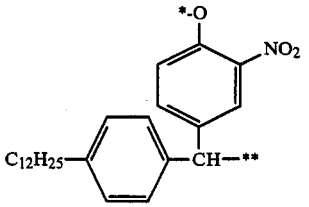
(29)
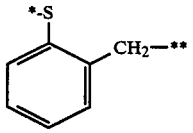
(30)
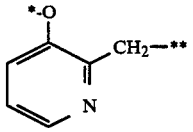
(31)
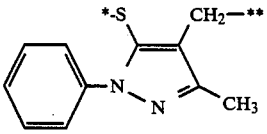
(32)
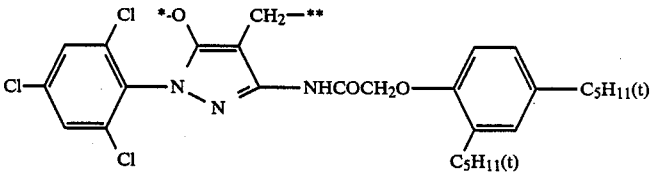
(33)
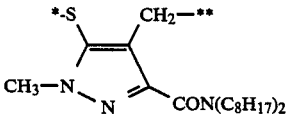
(34)
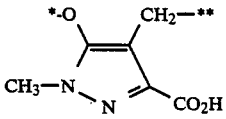
(35)
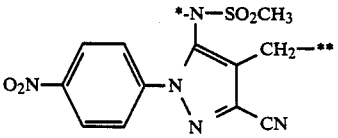

-continued
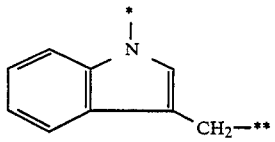
(36)
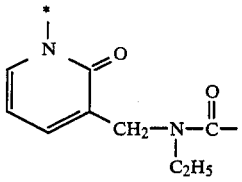
(37)
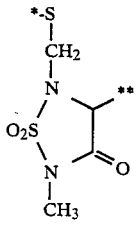
(38)
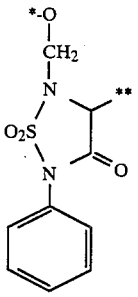
(39)
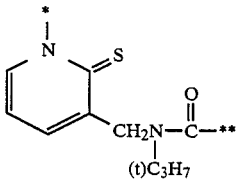
(40)
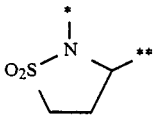
(41)
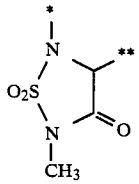
(42)
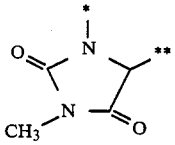
(43)
*-S—$CH_2$—** (44)
*-O—$CH_2$—** (45)

-continued

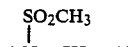

(46)

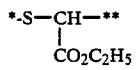

(47)

$R_1$ in general formula (I) is preferably a substituted or unsubstituted alkyl group (e.g., an ethyl grup, a cyclohexyl group, a decyl group, an α-di-tert-amylphenoxypropyl group or the like), a substituted or unsubstituted aryl group (e.g., a 4-chlorophenyl group, a 4-tetradecyloxyphenyl group, a 3-pentadecylphenoxymethyl group or the like), a substituted or unsubstituted aralkyl group (e.g., a benzyl group, a 4-octanamidobenzyl group, a 4-dodecyloxyphenylethyl group or the like), a substituted or unsubstituted alkoxy group (e.g., a methoxy group, a decyloxy group, a 2-(2,4-di-tert-amylphenoxy)ethoxy group or the like, and a substituted or unsubstituted aryloxy group (e.g, a 2,4-di-tert-octylphenoxy group, a 3-dodecylsulfonamidophenoxy group, a 4-hexadecylphenoxy group or the like).

In the compounds of general formula (II), $Z_2$, PUG, $T_2$ and $R_2$ have, respectively, the same meanings as $Z_1$, PUG, $T_1$ and $R_1$ in general formula (I).

When $Z_2$ is substituted further, preferable substituents of $Z_2$ may be those mentioned as substituents of $Z_1$ in general formula (I).

In general formula (II), the bonding position of —(L—$X_1$)$n_2$—($T_2$)$l_2$—PUG is a position where this group is eliminable by electron transfer of an anion formed on the nitrogen atom. Preferably, the position is on an atom adjacent to the nitrogen atom or the allyl position or the benzyl position.

The group of —(L—$X_1$)$n_2$—($T_2$)$l_2$—PUG may be substituted at the fused ring. L represents a connecting group and is preferably alkylene, arylene, aralkylene, oxyalkylene, oxyalkyleneamino, carboxyalkylene, carbonamidoalkylene, carbonamido, aminoalkylene, aminoalkyleneamino or the like.

In general formula (II), the nucleophilic bond represented by $X_1$ is intended to mean a bond having electrophilic reactivity with a reaction site of a higher electron density because the bonding center is deficient of electrons. Preferably, a carbonyl group, a thiocarbonyl group, a sulfonyl group, a sulfinyl group or the like is enumerated, of which a carbonyl group is more preferable.

In the compound of general formula (II), $R_2$ is more preferably an alkyl group having from 1 to 17 carbon atoms or an aryl group having from 6 to 21 carbon atoms.

$Z_2$ is more preferably an alkylene group having from 2 to 18 carbon atoms or an arylene group having from 6 to 21 carbon atoms.

L is more preferably an oxyalkylene group having from 1 to 18 carbon atoms, a carboxyalkylene group having from 2 to 19 carbon atoms or an oxyalkyleneamino group having from 2 to 19 carbon atoms.

$T_2$ more preferably represents an electron transfer-type timing group.

PUG is more preferably a development restrainer, a developing accelerator, a nucleating agent, or a dye or colorant.

In general formula (III), $Z_3$, PUG, $T_3$, $R_3$ to $R_5$ have, respectively, the same meanings as $Z_1$, PUG, $T_1$ and $R_1$. When $Z_3$ is substituted further preferable substituents of $Z_3$ may be the same as those of $Z_1$ in general formula (I). $X_2$ has the same meaning as $X_1$ in general formula (II).

In general formula (IV), $Z_4$, PUG, $T_4$, $R_6$ or $R_6$ have, respectively, the same meanings as $Z_1$, PUG, $T_1$ and $R_1$. Preferable substituents of $Z_3$ may be the same as those of $Z_1$ in general formula (I).

When $R_1$ to $R_7$ and $Z_1$ to $Z_4$ are independently a carbon-containing group, the number of carbon atoms preferably ranges from 1 to 18. These groups should preferably be formed so as to impart immobility or semiimmobility to the entire molecule. Most preferably, these groups serve to impart a diffusion resistance property to the entire molecule. If the groups represented by $R_1$ to $R_7$ and $Z_1$ to $Z_4$ can be substituted further, substituted atoms such as carbon, nitrogen or oxygen in the groups may have a substituent or substituents, which may further have at least one substituent. Typical examples of the substituents include a halogen atom, a cyano group, a nitro group, a hydroxyl group, a carboxyl group, a sulfo group, G—, GO—, GS—, GCO—, GCOO—, —$CONH_2$—, —$OCONH_2$, —$SO_2NH_2$, —$NHCONH_2$—, —$NHSO_2NH_2$, —$SO_2G$, —SOG, —COOG, —$NHSO_2G$ and the like (G represents an aliphatic hydrocarbon group, an aryl group or a heterocyclic ring).

Of the compounds of general formula (III) of present, preferable compounds are represented by the following general formulae (IIIa) and (IIIb)

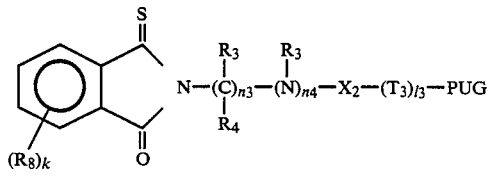

(IIIa)

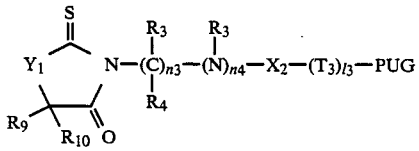

(IIIb)

In the above general formula (IIIa), PUG, $T_3$, $R_3$, $R_4$, $R_5$, $n_3$, $n_4$ and $l_3$ have the same meanings as defined in general formula (III), each $R_8$ represents a substituent which can be substituted to benzene, and k is an integer of from 0 to 4. When k is in the range of from 2 to 4, $R_8$s may be different from one another.

In general formula (IIIb), PUG, $T_3$, $R_3$, $R_4$, $R_5$, $n_3$, $n_4$ and $l_3$ have the same meanings as defined in general formula (III), $R_9$ and $R_{10}$ independently represent a hydrogen atom or a substituent but may join to give $R_9$, forming a double bond with the ring carbon. $Y_1$ represents an oxygen atom, a sulfur atom,

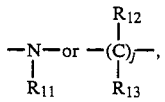

$R_{11}$, $R_{12}$ and $R_{13}$ independently represent a hydrogen atom or a substituent and j is 1 or 2. If j is 2, $R_{12}$ and $R_{13}$ on the two carbon atoms may be the same or different from each other, or may form a ring or double bond between the two carbon atoms. When $l_3$ is 1, $R_{12}$ and $R_{13}$ may likewise form a double bond between the two carbon atoms. In addition, $R_9$, $R_{10}$, $R_{12}$ and $R_{13}$ may form, taken together, a cyclic ring or a heterocyclic ring.

$R_8$ in general formula (IIIa) preferably includes a halogen atom, an alkyl group, an alkenyl group, an aralkyl group, an aryl group, an alkoxy group, an amino group, a hydroxy group, a carboxyl group, an alkyloxycarbonyl group, an aryloxycarbonyl group, a carbonamido group, a sulfonamido group, a ureido group, a sulfamido group, an oxycarbonamido group, a carbamoyl group, a sulfamoyl group, a sulfonyl group, a cyano group, a sulfo group, a nitro group or the like.

In formula (IIIb), $R_9$ and $R_{10}$ may be the same or different from each other and, include preferably a hydrogen atom, a halogen atom, an alkyl group, an aryl group or an exo double bond. Preferably, $R_{11}$ includes a hydrogen atom, an alkyl group, an alkenyl group, a cycloalkyl group, a heterocyclic residue, an aryl group or an aralkyl group.

Preferably, $R_{12}$ and $R_{13}$ independently represent a hydrogen atom, a halogen atom, an alkyl group, an alkoxy group or an aryl group.

Most preferably in general formulae (IIIa) and (IIIb), $R_3$ and $R_4$ independently represent a hydrogen atom, and $n_3$ is 1 or 2 provided that when $n_3$ is 1, $n_4$ is 1 and when $n_3$ is 2, $n_4$ is 0.

Most preferably in general formula (IIIb), $Y_1$ is a sulfur atom or

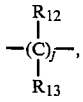

and j is 1. $R_9$ and $R_{10}$ are, most preferably, a hydrogen atom, an alkyl group or an exo double bond formed by combination of $R_9$ and $R_{10}$ when $Y_1$ is a sulfur atom. In the case where $Y_1$ is

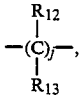

$R_9$ and $R_{10}$ independently represent a hydrogen atom, a halogen atom, an alkyl group or a group to form an unsaturated ring with the carbon atom of

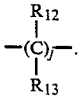

The precursor of the present invention represented by general formula (IV) is preferably defined by the following general formulae (IVa) and (IVb).

General formula (IVa):

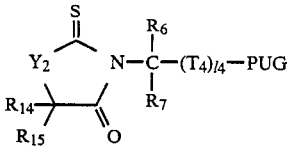

in which PUG, $T_4$, $l_4$, $R_6$ and $R_7$ have, respectively, the same meanings as defined in formula (IV). $R_{14}$ and $R_{15}$ independently represent a hydrogen atom or a substituent, and $Y_2$ represents an oxygen atom, a sulfur atom, $CR_{16}R_{17}$ or $NR_{18}$, in which $R_{16}$, $R_{17}$ and $R_{18}$ independently represent a hydrogen atom or a substituent.

General formula (IVb):

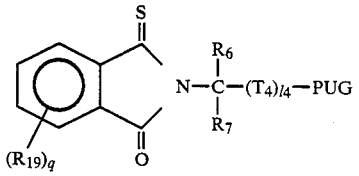

in which PUG, $T_4$, $l_4$, $R_6$ and $R_7$ have, respectively, the same meanings as defined in formula (IV). Each $R_{19}$ represents a substituent and q is an integer of 0 to 4. When q is in the range of 2 to 4, $R_{19}$s may be the same or different from one another.

$R_{14}$, $R_{15}$, $R_{16}$, $R_{17}$ and $R_{18}$ in general formula (IVa) preferably represent a hydrogen atom or those mentioned as the substituents of $Z_1$ in general formula (I).

Most preferably, $R_6$ and $R_7$ in general formula (IVa) independently represent a hydrogen atom, an alkyl group, an aryl group, or a carbonyl or imino group formed together with $R_6$ and $R_7$.

Most preferably, $R_{14}$, $R_{15}$, $R_{16}$ and $R_{17}$ independently represent a hydrogen atom, a halogen atom, an alkyl group, an aryl group, an alkoxy group, an aryloxy group, a carbonamido group, a sulfonamido group, a ureido group, an acyl, a carbamoyl group, a sulfamoyl group or the like. $R_{14}$, $R_{15}$, $R_{16}$ and $R_{17}$ may preferably join together to form a cycloalkyl group or a carbon-carbon double bond. $R_{18}$ is preferably a hydrogen atom, an alkyl group or an aryl group.

$Y_2$ is preferably an oxygen atom, a sulfur atom or $CR_{16}R_{17}$, of which a sulfur atom is more preferable.

More preferably, R6 and $R_7$ independently represent a hydrogen atom and $R_{14}$ and $R_{15}$ independently represent a hydrogen atom, an alkyl group, an acyl group, a carbonamido group, a sulfonamido group, a carbamoyl group, a sulfamoyl group, a carboxy group, a sulfo group or an alkylidene group formed by $R_{14}$ and $R_{15}$.

In general formula (IVb), preferable examples of $R_6$ and $R_7$ are, respectively, those as defined with respect to $R_6$ and $R_7$ of general formula (IVa). A most preferable group on the benzene ring represented by $R_{19}$ includes a halogen atom, an alkoxy group, a carbonamido group, a sulfonamido group, an acyl group, an oxycarbonyl group, a carbamoyl group, a sulfamoyl group, a nitro group or the like. q is preferably an integer of 0 to 2. $R_6$ and $R_7$ are most preferably a hydrogen atom and $R_{19}$ is most preferably a halogen atom, an alkyl group, an alkoxy group, a carbonamido group, a sulfonamido group or the like.

In general formulae (IVa) and (Vb), examples of the timing group represented by $T_4$ are most preferably

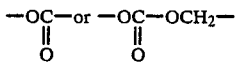

and PUG may include all photographically useful groups. Most preferably, examples of PUG include antifoggant development accelerators, nucleating agents, hydroquinone derivatives and dyes.

In the preferred practice of the present invention, the photographic material which comprises at least one compound of general formulae (I) to (IV) and has at least one photosensitive silver halide emulsion layer is processed in the presence of amines.

Typical examples of the amines include those of the following general formula (V)

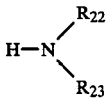

In general formula (V), $R_{22}$ and $R_{23}$ independently represent a hydrogen atom or a substituent.

In the above general formula (V), $R_{22}$ and $R_{23}$ which may be the same or different preferably represent a hydrogen atom, an alkyl group, an aryl group, an alkenyl group, an aralkyl group, an amino group, an imino group, a hydroxyl group, an alkoxy group or an aryloxy group. The groups other than the hydrogen atom and the hydroxy group may be substituted further. Alternatively, $R_{22}$ and $R_{23}$ may join to form a ring.

More preferably, at least one of $R_{22}$ and $R_{23}$ is a hydrogen atom and the other is a substituted or unsubstituted alkyl or aryl group. Alternatively, both may be independently a substituted or unsubstituted alkyl or aryl group.

Most preferably, $R_{22}$ and $R_{22}$ are independently a substituted or unsubstituted alkyl group, or $R_{22}$ represents a hydrogen atom and $R_{23}$ represents a substituted or unsubstituted alkyl group.

The amines represented by general formula (V) may be contained in a processing solution or may be added to a photographic material, in which case it may be contained as an amine precursor typical of which are salts with acids.

The amines are added to a development solution or a photographic material. In the latter case, the amines are preferably added to a layer different from a layer to which photographic reagent precursors of general formulae (I) to (IV) are added, thereby permitting them to react with each other at the time of the processing. The amines are, most preferably, added after formation of ammonium salts with strong acids.

The amines may be used alone or in combination.

When the photographic processing is conducted in the presence of the amine, among the photographic reagent precursors of general formula (I) or (II), a precursor of general formula (I) in which m is 1 and $n_1$ is 0 is preferably used and a precursor of the general formula (II) in which $n_2$ is 0 is preferably used.

The amines of general formual (V) can be prepared according to a known process of preparing amines as described, for example, in R. B. Wagner, H. D. Zook, Synthetic Organic Chemistry, p. 653, John Wiley and Sons Inc., 1953., and may be readily commercially available from reagent manufacturers in Japan and abroad. For instance, these amines are indicated in catalogues of manufacturers such as Tokyo Chem. Ind. Co., Ltd., Wako Pure Chem. Ind., Ltd., Kantoh Chem. Ind. Co., Ltd., Koei Chem. Ind. Co., Ltd., Aldrich Co., Ltd., Merck Co., Ltd., and the like.

The reason why the precursor compounds of the present invention have good shelf stability and can release photographically useful reagents rapidly at the time of development treatment (e.g., a conventional white-and-black or color photographic processing, a diffusion transfer white-and-black or color photographic processing, a thermal developing color photographic processing) has not been clear yet but is presumably considered as follows with reference to the literature of Eiichi Maeda et al concerning thiazolidinethione derivatives.

Maeda et al have reported in detail the reactivity of N-acyl products (VI) of thiazolidone-2-thione in Summaries of the Lectures of the 22nd Forums on Natural Organic Compounds, p. 554 (1979) and Tetrahedron Letters, Vol. 21, p. 841 (1980). According to Maeda et al, the compounds of formula (VI):

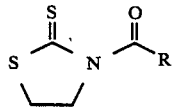

(in which R represents an alkyl group) are very stable in water and does not undergo any hydrolysis. It is also stated that the compounds are low in reactivity with alcohols or hydroxyl ions but react quickly with amines. Similar reactions are considered to take place in the precursor compounds (I) to (IV) according to the present invention. More particularly, the compounds of the present invention are considered to be stable without suffering any influence of water which is present during storage and to undergo a reaction with various types of amines contained in a developing solution, so that the bond is readily cleft, thereby releasing a photographically useful group. Thus, the high stability during storage and the high reactivity at the time of development are considered to be reconciled. This phenomenon is not clear but may be illustrated as follows referring to a compound of general formula (IV).

When the compound of general formula (IV) is in a film during storage, the carbonyl group specifically reacts with water to form a stable adduct (VII). The adduct (VII) does not undergo any ring cleavage and exists in equilibrium with the compound (IV). At the time of processing, the carbon atom of the carbonyl group undergoes a selective and nucleophilic attack with a nucleophilic reagent (Nu) released from an ingredient in a processing solution or a heated precursor, thereby forming a compound (VIII). Subsequently, ring cleavage takes place immediately to eliminate compound (X). Aside from the above idea, the phenomenon may be considered to result according to a so-called HSAB rule of active atom species of the carbon atom of thiocarbonyl or carbonyl and water or a nucleophilic reagent species [(Hard and Soft, Acids and bases Principle in Organic Chemistry, by Tse-Lok Ho (1977), Academic Press Pub.]

Scheme:

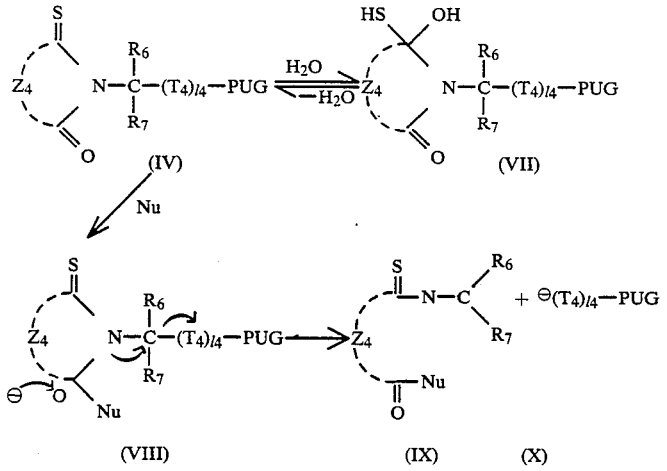

In the above Scheme, PUG, $T_4$, $l_4$, $R_6$, $R_7$ and $Z_4$ have, respectively, the same meanings as defined in the general formula (IV) and Nu represents a nucleophilic agent.

The amounts of precursor compounds of general formula (I) to (IV) may vary depending on the type of released photographic reagent. The antifoggant and the development restrainer are each added in an amount of from $10^{-8}$ to $10^{-1}$ mole per mole of silver, preferably from $10^{-6}$ to $10^{-1}$ mole for mercapto system antifoggant and from $10^{-5}$ to $10^{-1}$ mole for azole system antifoggant such as benzotriazole. The developing agent is added in amounts of from $10^{-2}$ to 10 moles, preferably from 0.1 to 5 moles, per mole of silver. The pyrazolidone system auxiliary developing agent is used in amounts of from $10^{-4}$ to 10 moles, preferably from $10^{-2}$ to 5 moles, per mole of silver. The development accelerator or nucleating agent is added in amounts of from $10^{-2}$ to $10^{-6}$ mole, preferably from $10^{-3}$ to $10^{-5}$ mole, per mole of silver. The solvent for silver halide such as sodium thiosulfate is added in amounts of from $10^{-3}$ to 10 moles, preferably from $10^{-2}$ to 1 mole, per mole of silver. The dye or colorant for color diffusion an transfer photography is added in amounts of from $10^{-3}$ to 1 mole, preferably from $5\times10^{-3}$ to 0.5 moles per mole of silver.

When the amines of general formula (V) are added to a processing solution, their amounts are from $10^{-3}$ to 1 mole/liter, preferably from $10^{-2}$ to $5\times10^{-1}$ mole/liter. On the other hand, when added to a photographic material, the amine is added in amounts of from $10^{-7}$ to 10 moles, preferably from $10^{-5}$ to 1 mole, per mole of silver. Since amines exhibit reduction power although very weak, fogging is apt to take place over the upper limit of the above stated range.

Specific examples of the precursor compounds (I) through (IV) and the amines (V) used in the present invention are shown but should not be construed as limitations.

Exemplified Compounds:

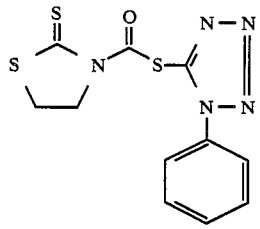

(I)-(1)

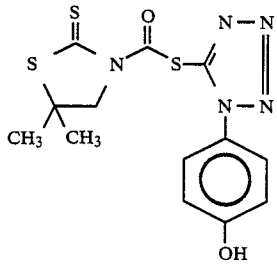

(I)-(2)

-continued
(I)-(3)
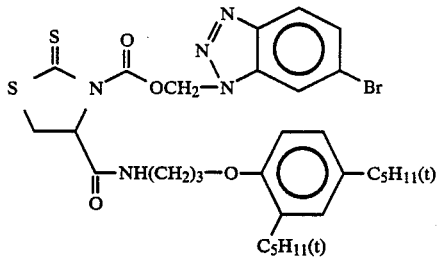
(I)-(4)
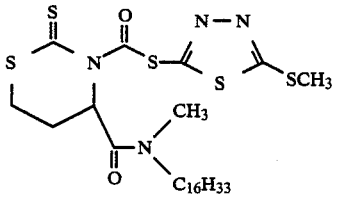
(I)-(5)
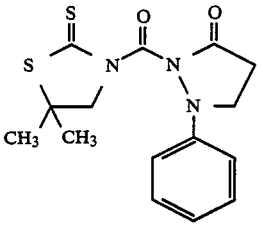
(I)-(6)
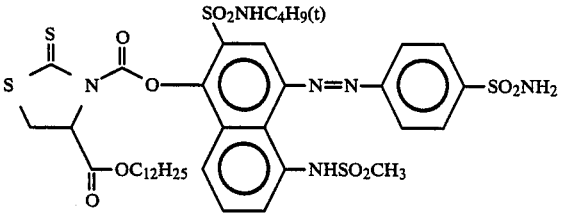
(I)-(7)
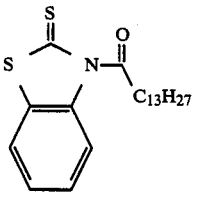
(I)-(8)
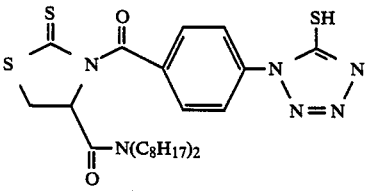
(I)-(9)
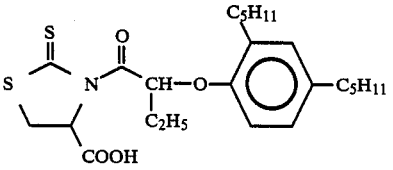

-continued
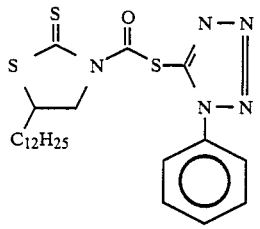
(I)-(10)
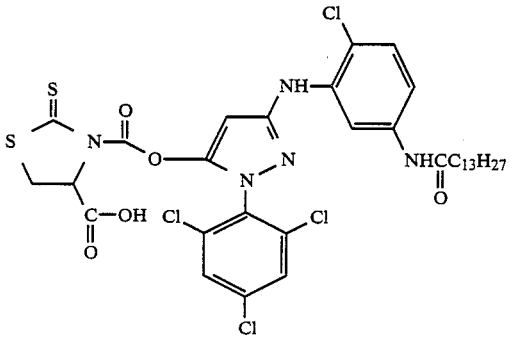
(I)-(11)
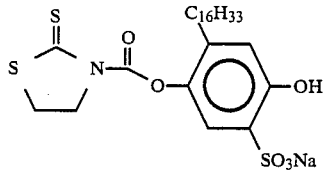
(I)-(12)
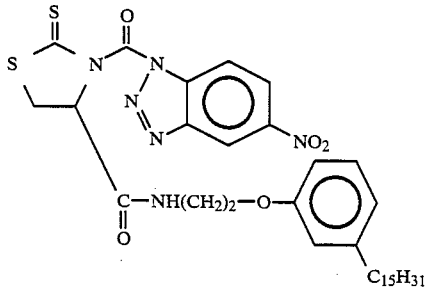
(I)-(13)
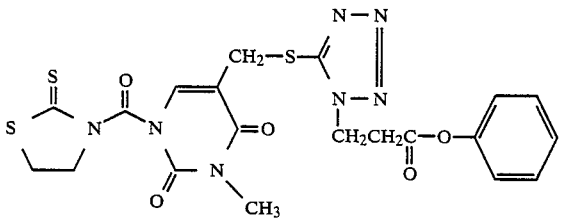
(I)-(14)
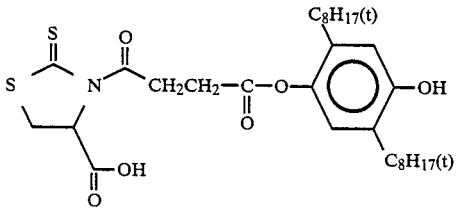
(I)-(15)

-continued
(I)-(16)
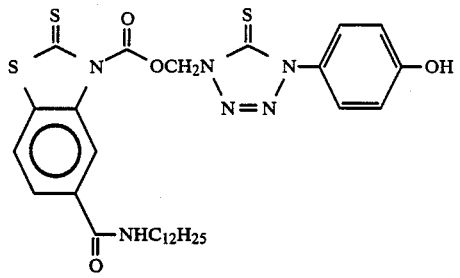
(I)-(17)
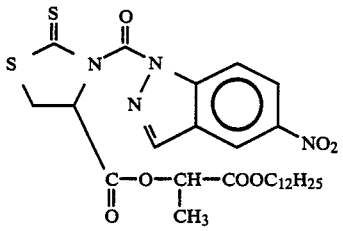
(I)-(18)
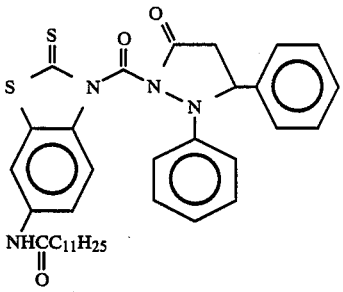
(I)-(19)
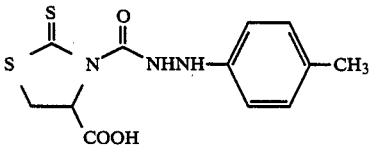
(I)-(20)
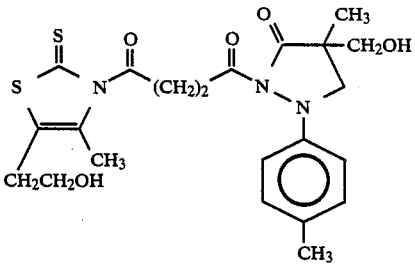
(I)-(21)
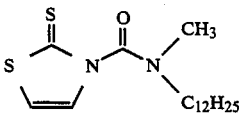
(I)-(22)
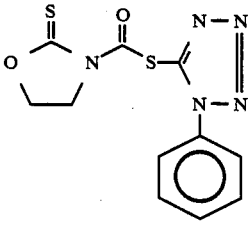

-continued
(I)-(23)
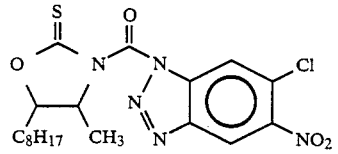
(I)-(24)
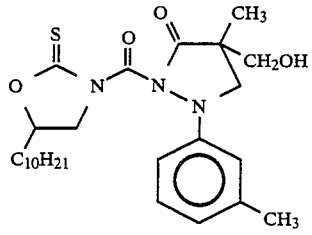
(I)-(25)
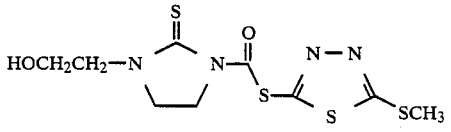
(I)-(26)
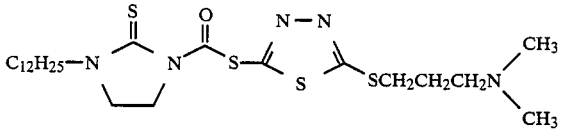
(I)-(27)
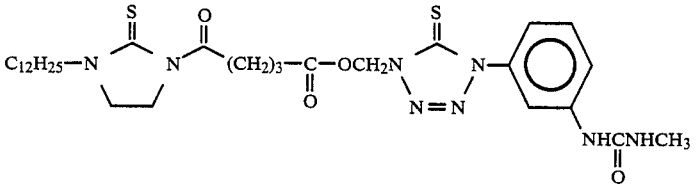
(I)-(28)
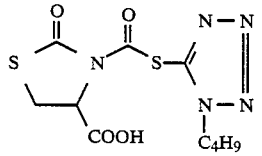
(I)-(29)
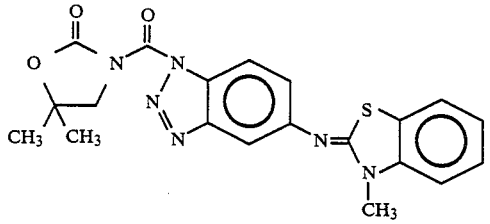
(I)-(30)
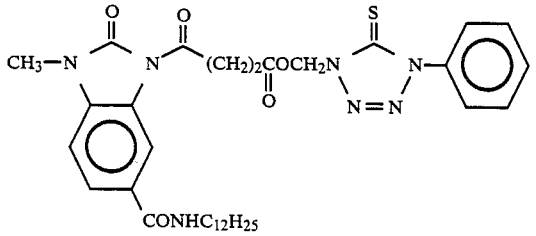

-continued
(I)-(31)
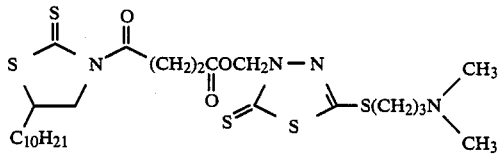
(I)-(32)
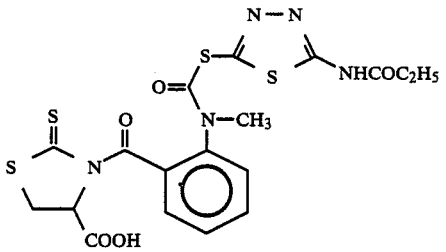
(I)-(33)
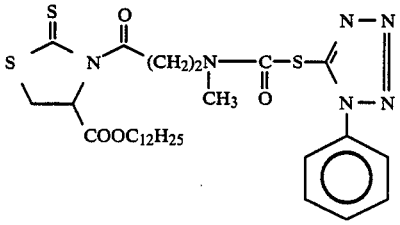
(I)-(34)
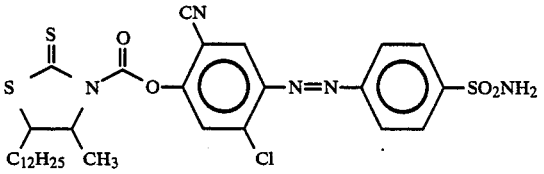
(I)-(35)
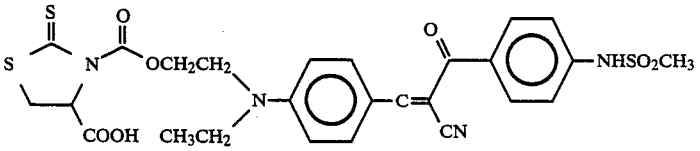
(I)-(36)
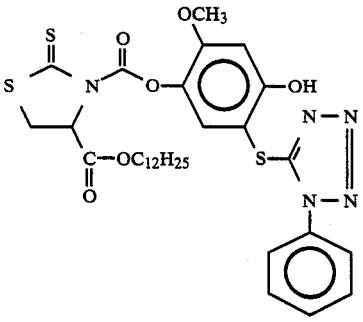
(I)-(37)
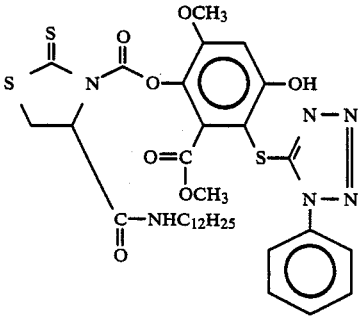

-continued
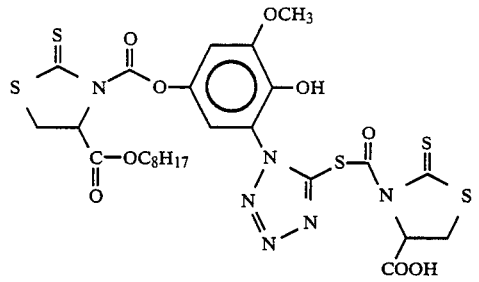
(I)-(38)
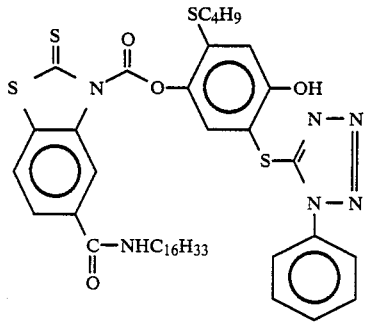
(I)-(40)
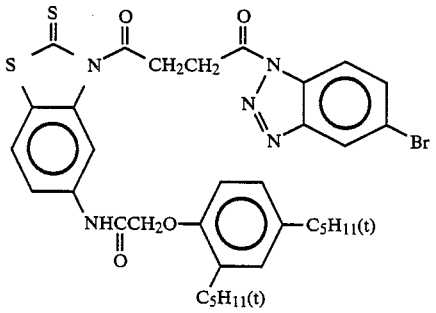
(I)-(41)
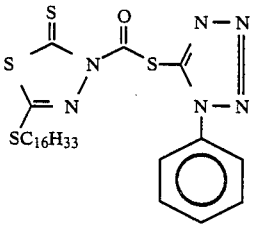
(I)-(42)
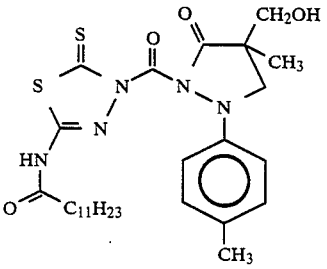

-continued
(I)-(43)
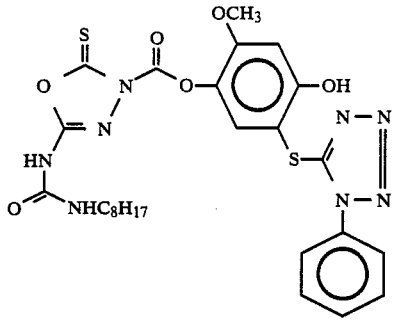
(I)-(44)
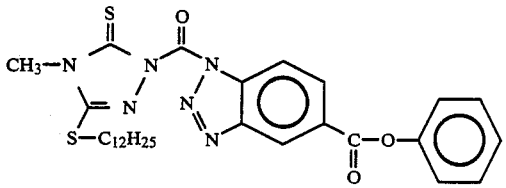
(I)-(45)
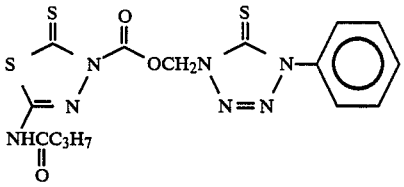
(I)-(46)
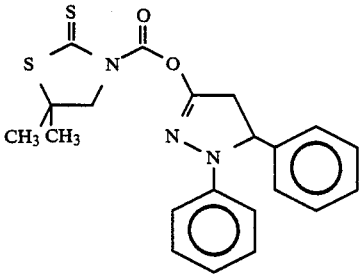
(I)-(47)
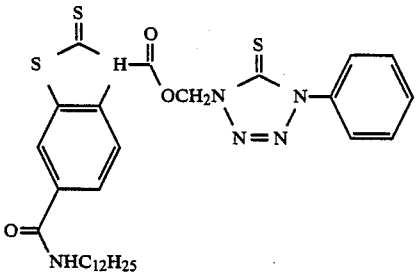
(I)-(48)
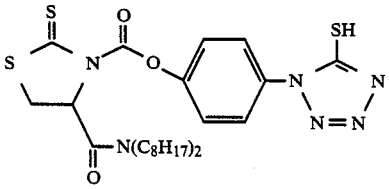

-continued
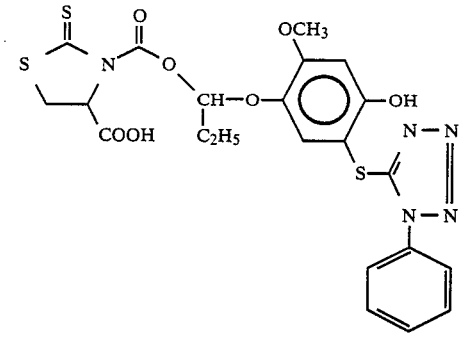
(I)-(49)
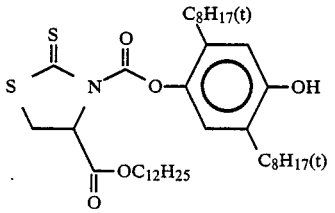
(I)-(51)
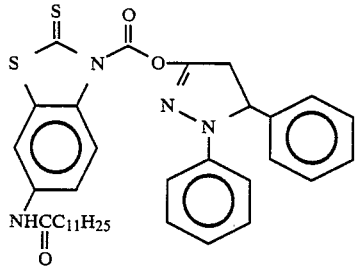
(I)-(52)
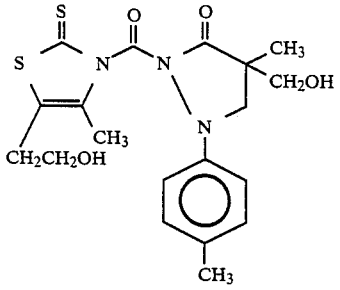
(I)-(53)
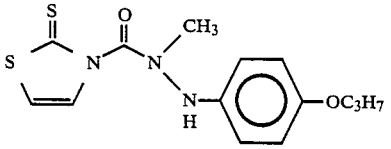
(I)-(54)
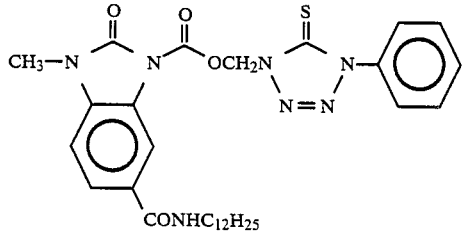

-continued
(I)-(55)
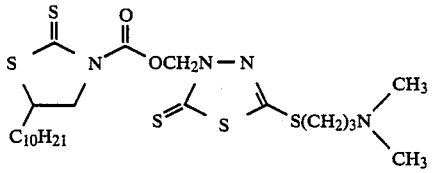
(I)-(56)
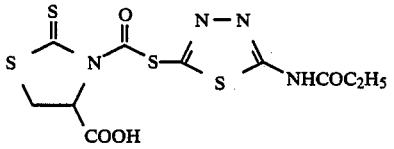
(I)-(57)
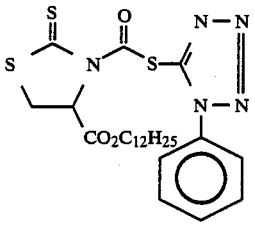
(I)-(58)
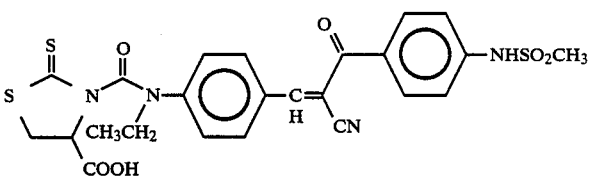
(I)-(59)
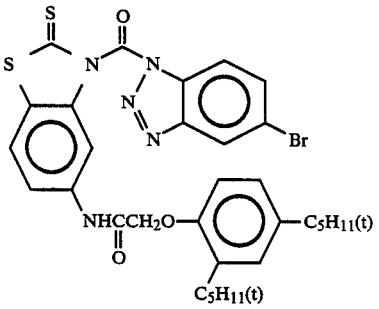
(II)-(1)
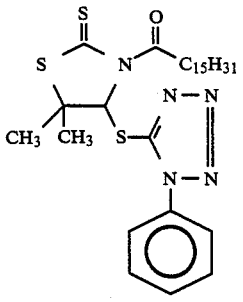

-continued
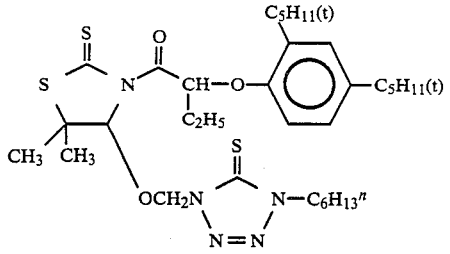
(II)-(2)
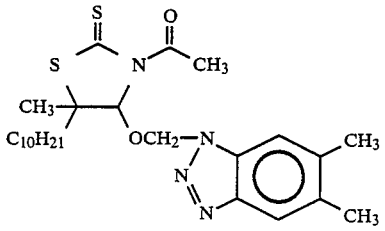
(II)-(3)
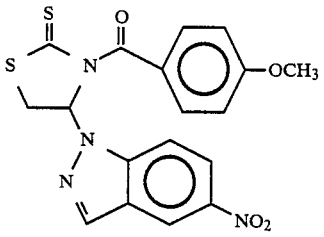
(II)-(4)
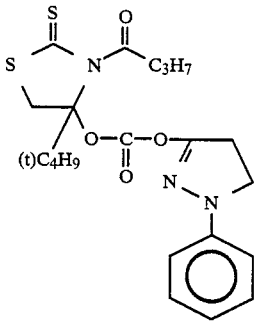
(II)-(5)
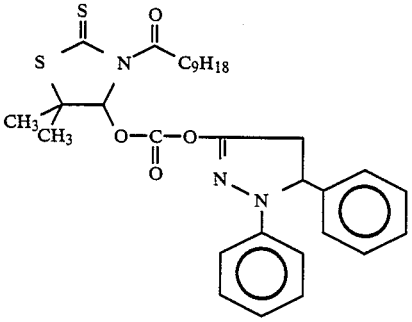
(II)-(6)

-continued
(II)-(7)
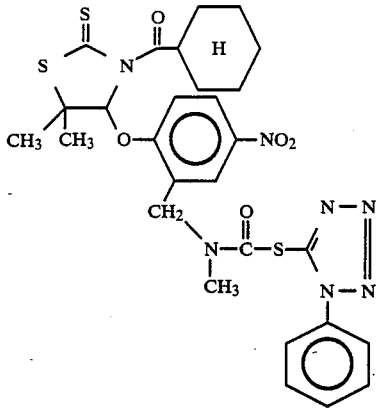
(II)-(8)
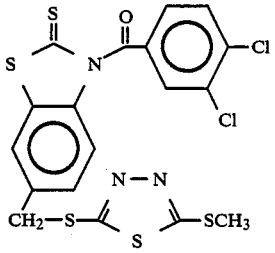
(II)-(9)
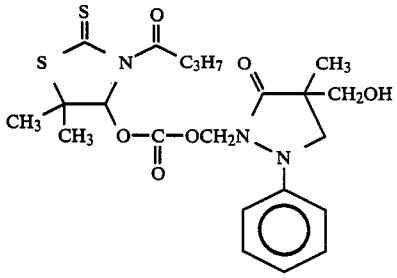
(II)-(10)
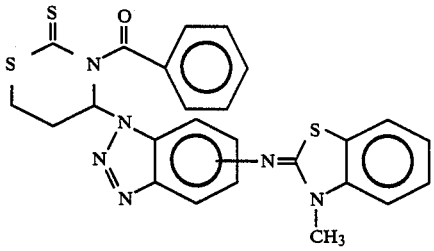
(II)-(11)
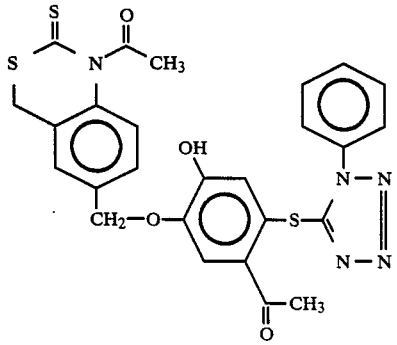

-continued
(II)-(12)
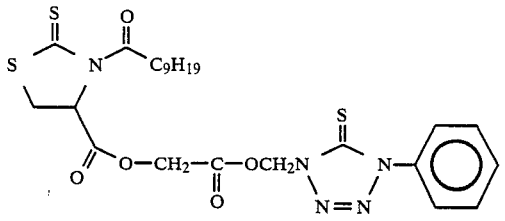
(II)-(13)
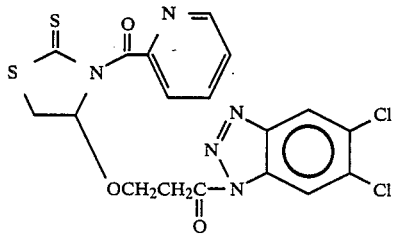
(II)-(14)
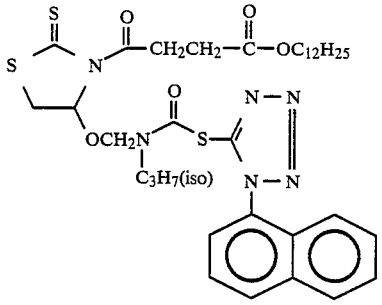
(II)-(15)
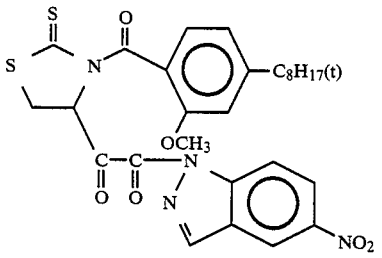
(II)-(16)
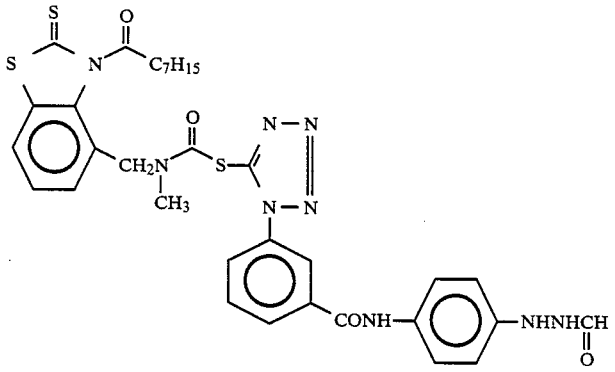

-continued
(II)-(17)
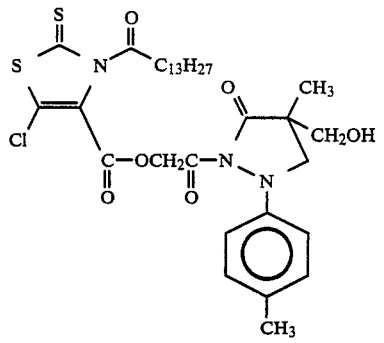
(II)-(18)
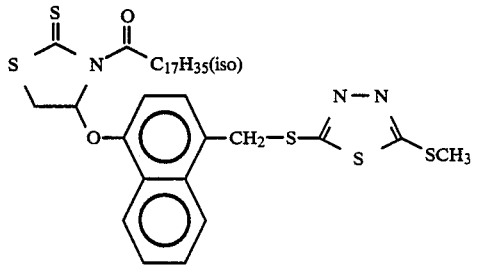
(II)-(19)
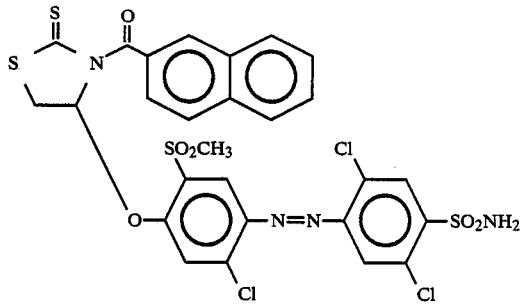
(II)-(20)
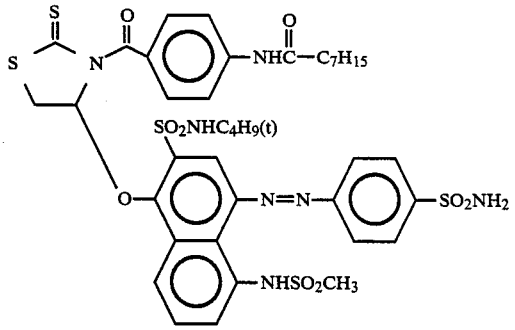
(II)-(21)
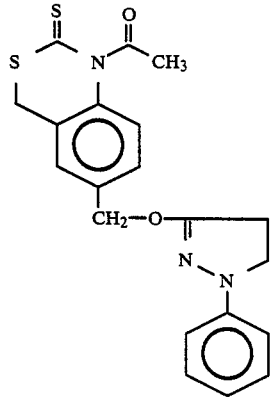

-continued
(II)-(22)
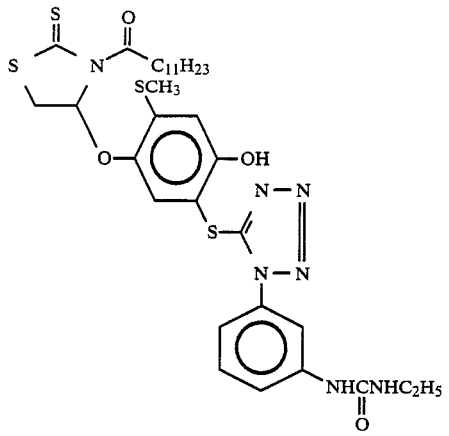
(II)-(23)
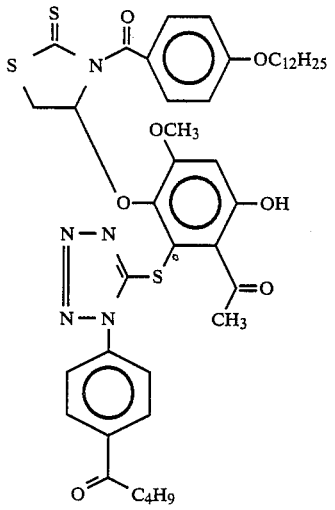
(II)-(24)
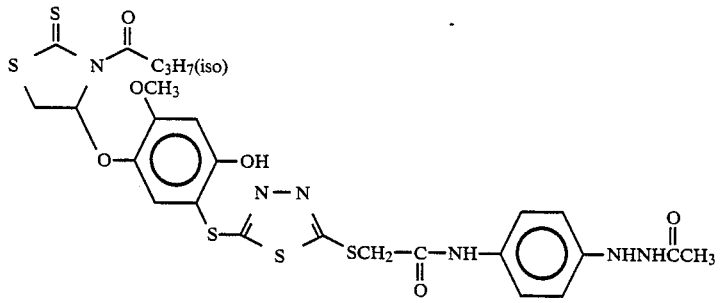
(II)-(25)
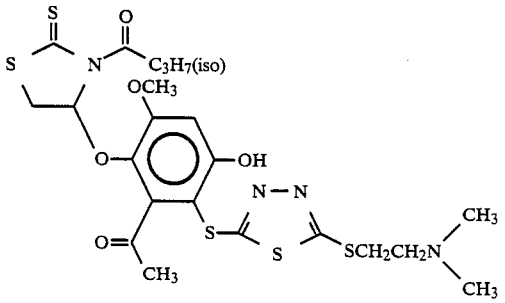

-continued
(II)-(26)
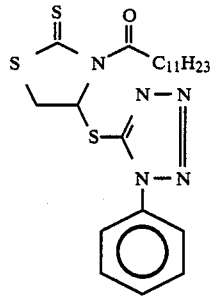
(II)-(27)
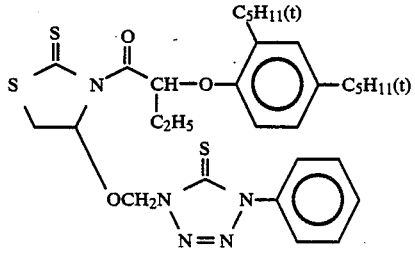
(II)-(28)
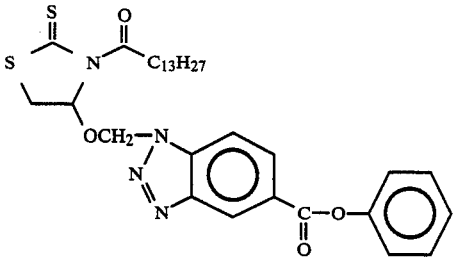
(II)-(29)
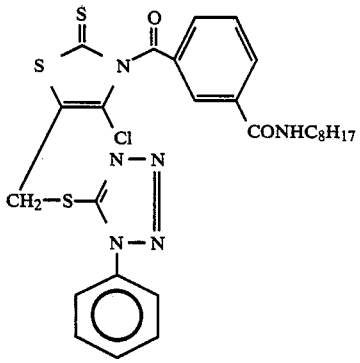
(II)-(30)
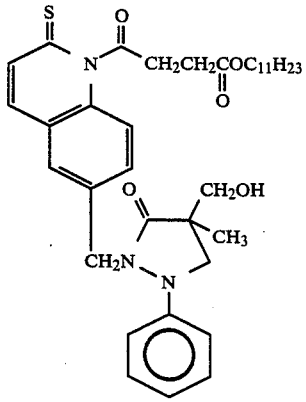

-continued
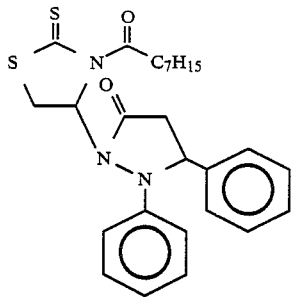
(II)-(31)
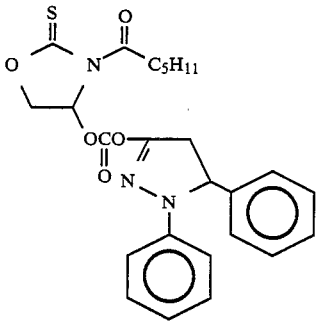
(II)-(32)
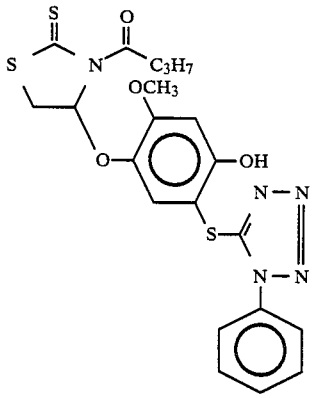
(II)-(33)
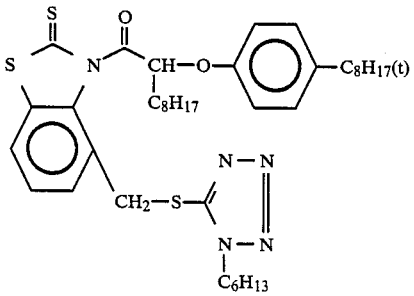
(II)-(34)

-continued
(II)-(35)
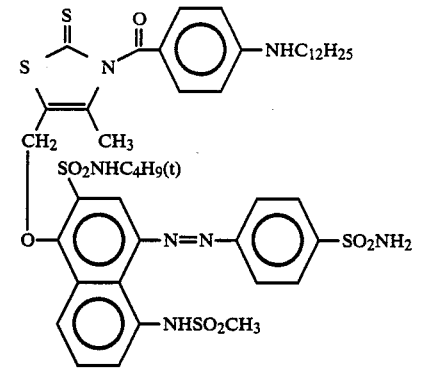
(II)-(36)
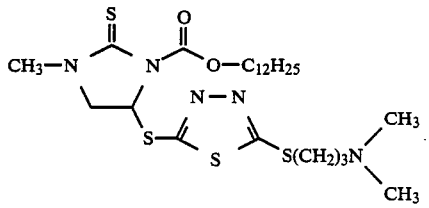
(II)-(37)
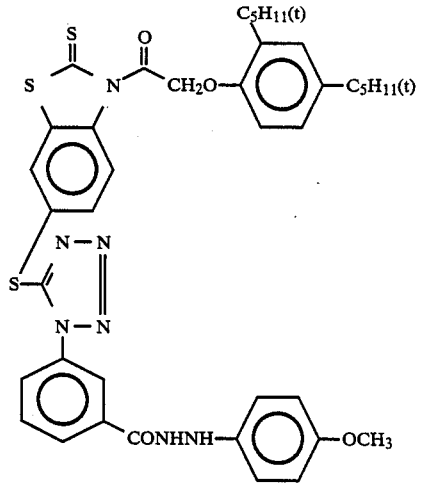
(II)-(38)
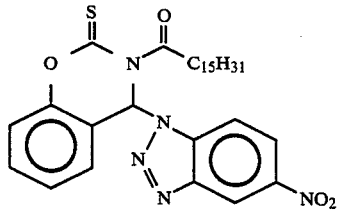
(II)-(39)
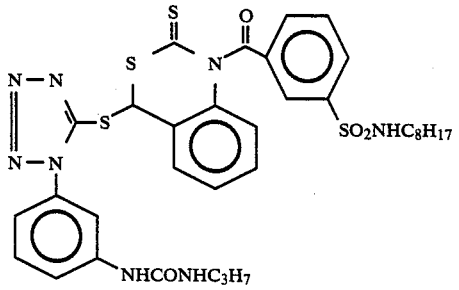

-continued
(II)-(40)
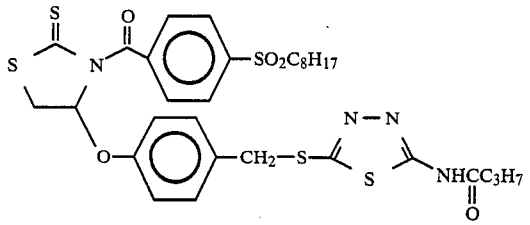
(II)-(41)
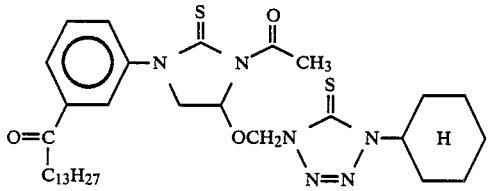
(II)-(42)
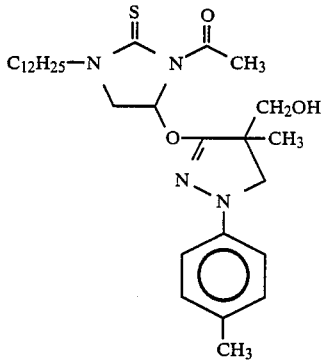
(II)-(43)
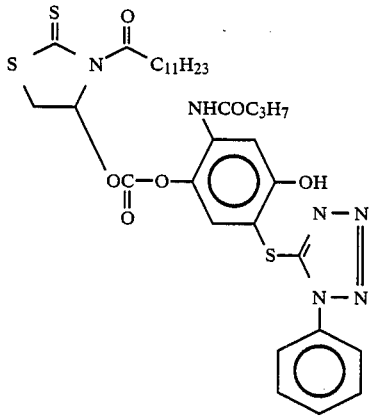
(II)-(44)
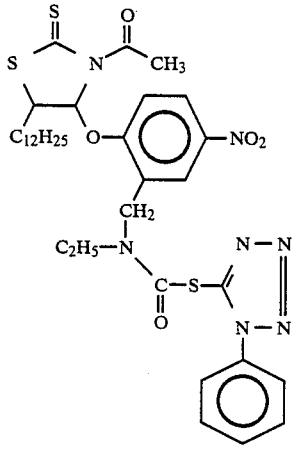

-continued
(II)-(45)
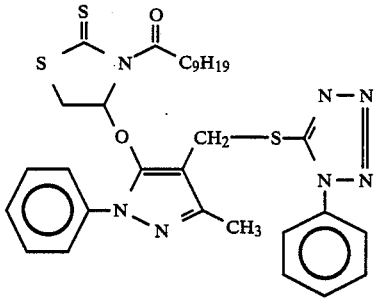
(III)-(1)
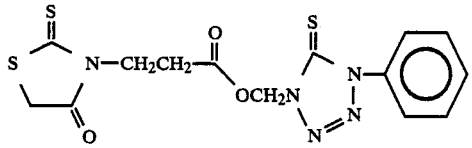
(III)-(2)
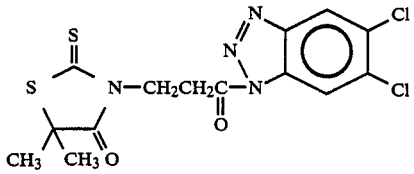
(III)-(3)
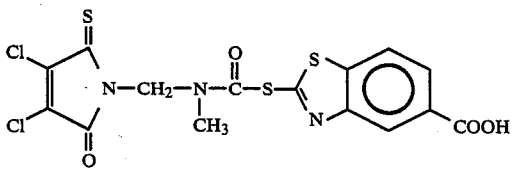
(III)-(4)
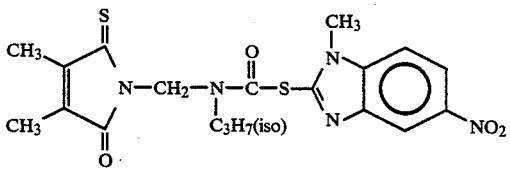
(III)-(5)
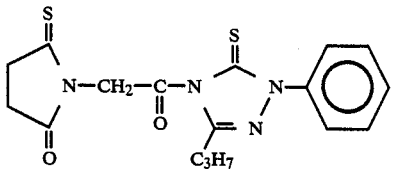
(III)-(6)
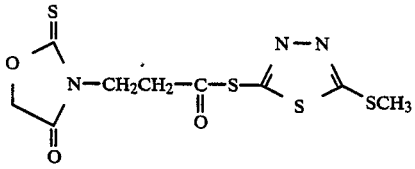
(III)-(7)
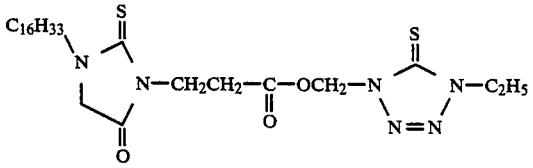

-continued
(III)-(8)
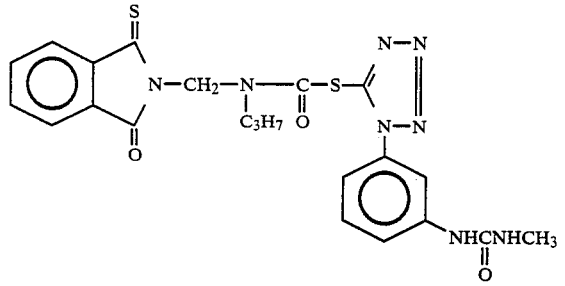
(III)-(9)
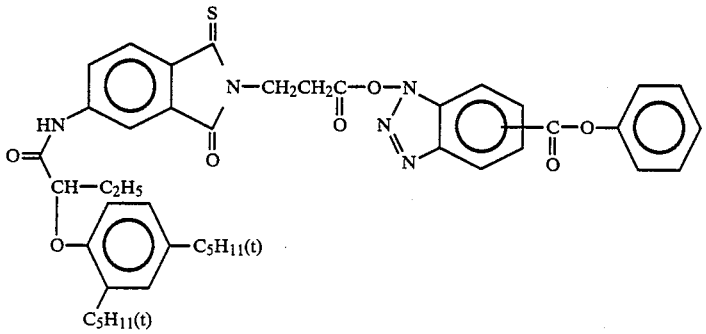
(III)-(10)
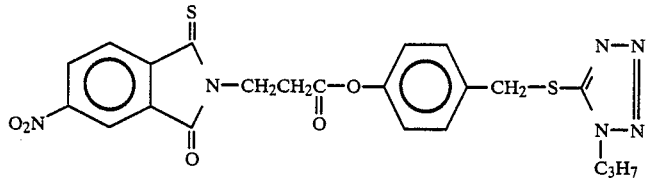
(III)-(11)
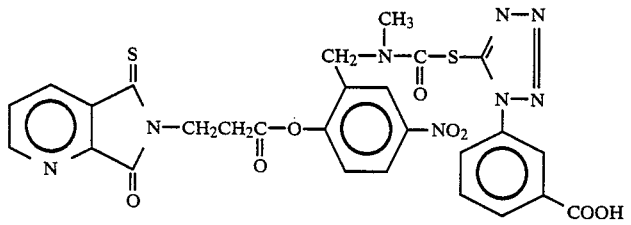
(III)-(12)
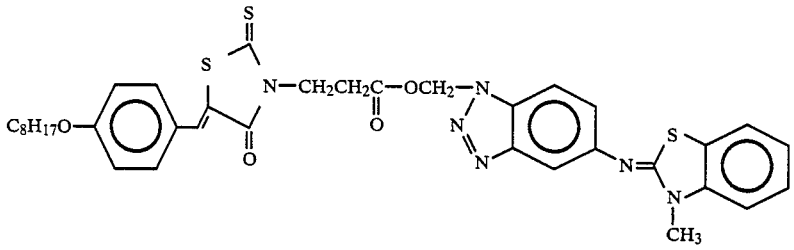
(III)-(13)
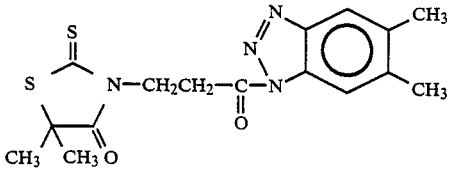
(III)-(14)
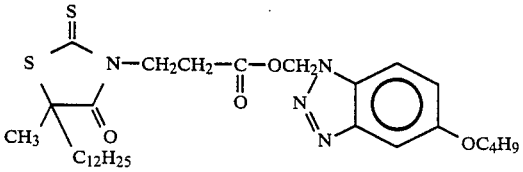

-continued
(III)-(15)
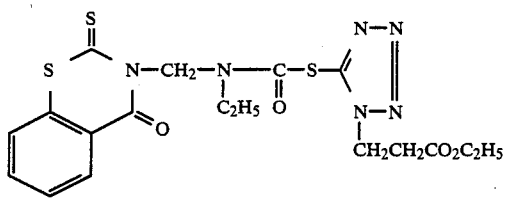
(III)-(16)
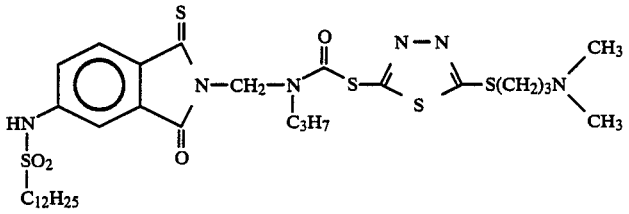
(III)-(17)
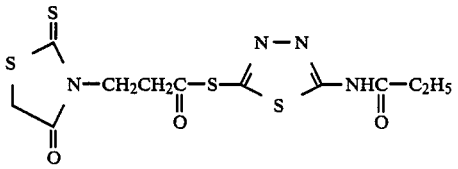
(III)-(18)
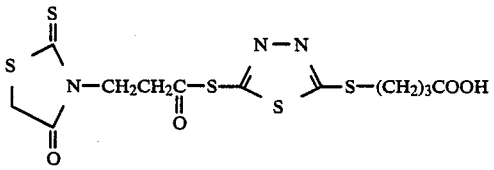
(III)-(19)
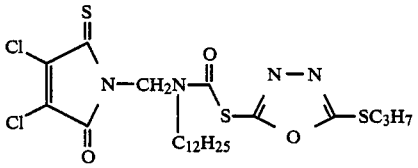
(III)-(20)
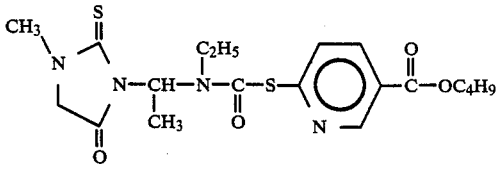
(III)-(21)
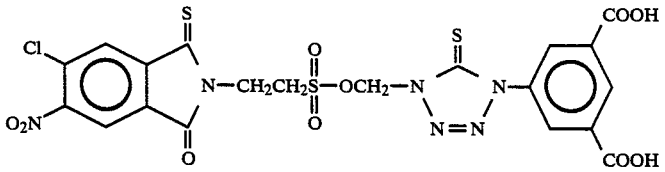
(III)-(22)
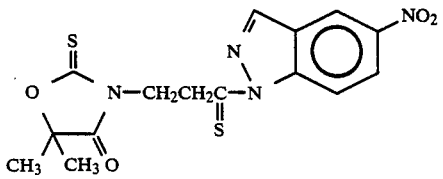

-continued
(III)-(23)
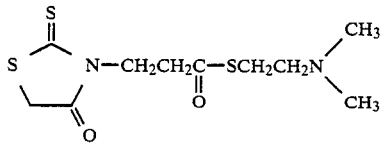
(III)-(24)
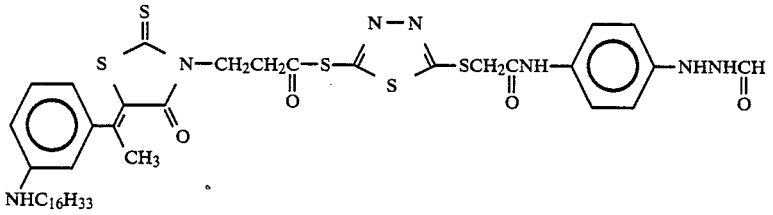
(III)-(25)
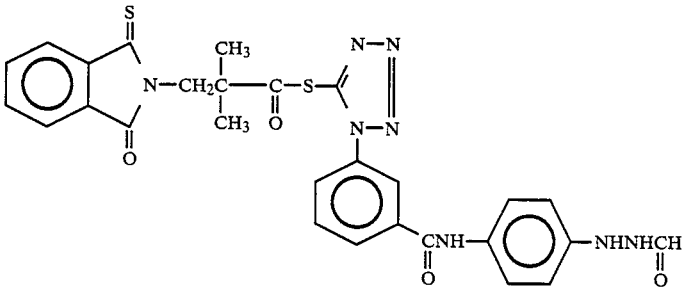
(III)-(26)
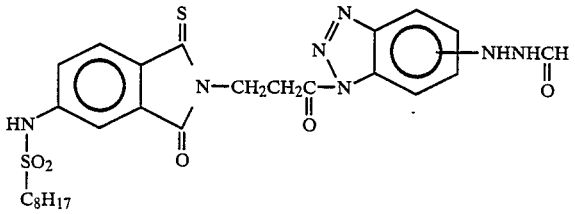
(III)-(27)
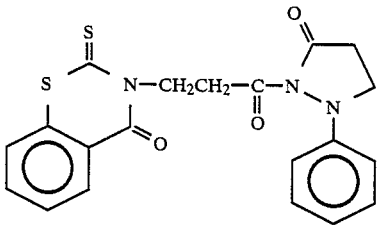
(III)-(28)
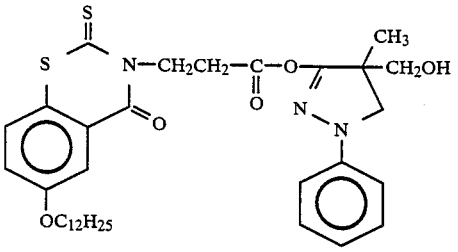
(III)-(29)
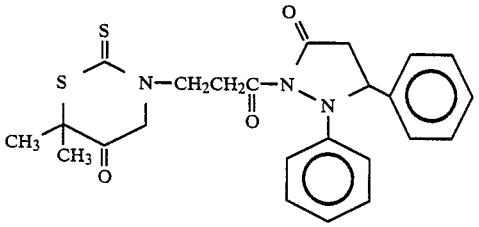

-continued
(III)-(30)
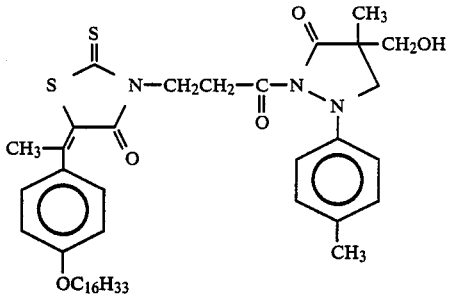
(III)-(31)
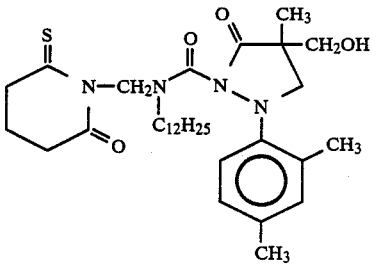
(III)-(32)
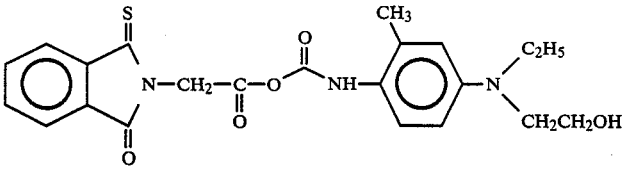
(III)-(33)
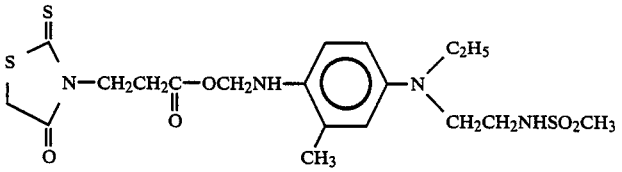
(III)-(34)
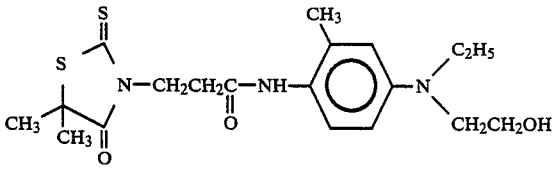
(III)-(35)
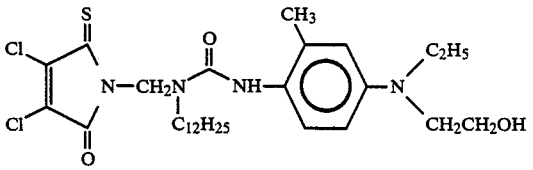
(III)-(36)
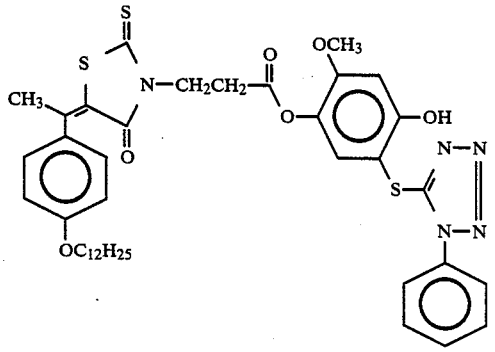

-continued
(III)-(37)
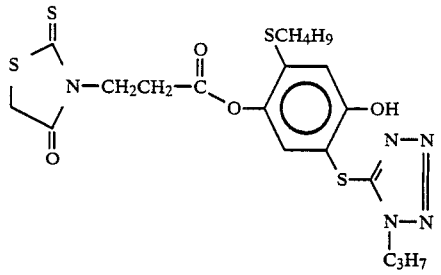
(III)-(38)
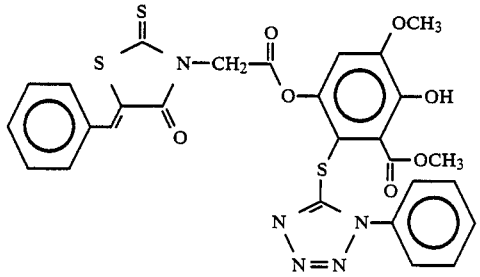
(III)-(39)
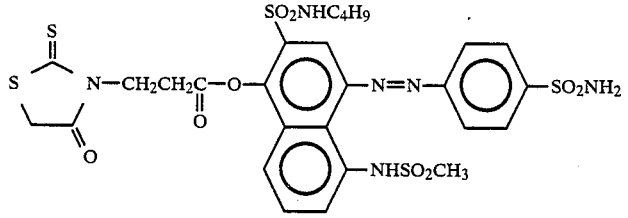
(III)-(40)
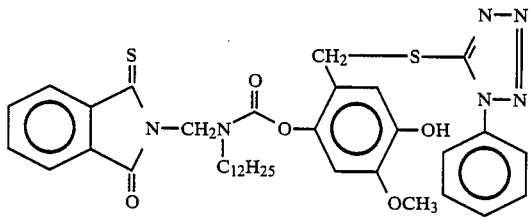
(III)-(41)
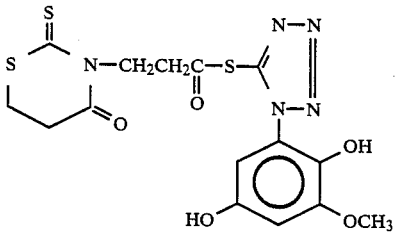
(III)-(42)
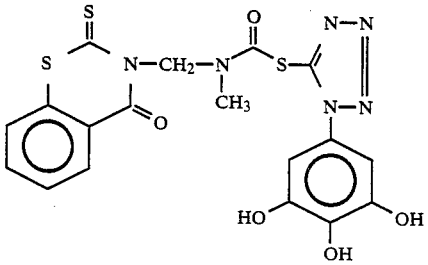

-continued
(III)-(43)
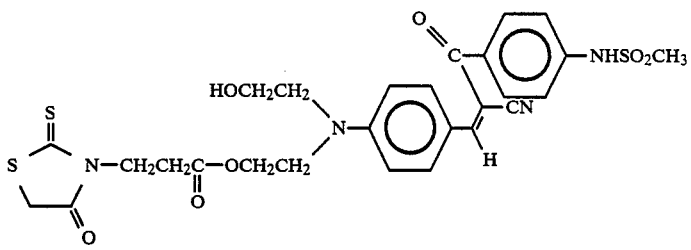
(III)-(44)
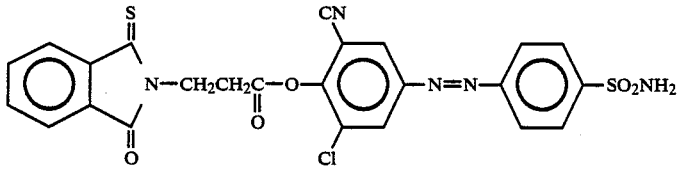
(III)-(45)
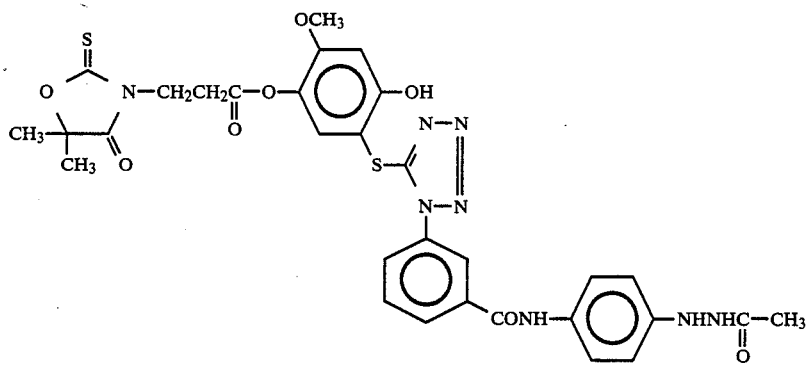
(III)-(46)
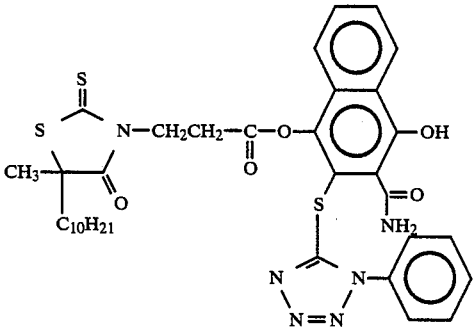
(III)-(47)
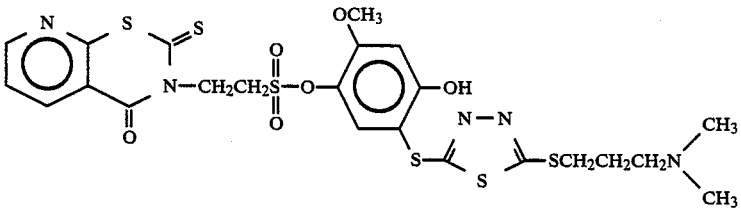
(III)-(48)
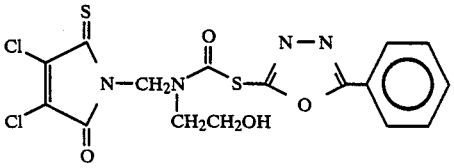

-continued
(III)-(49)
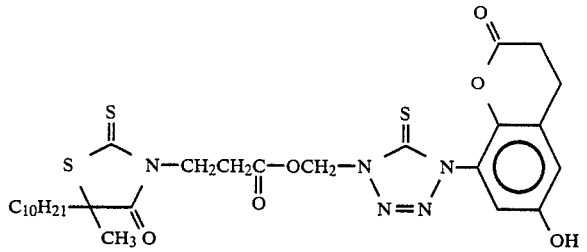
(III)-(50)
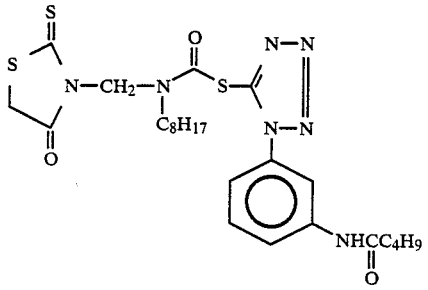
(III)-(51)
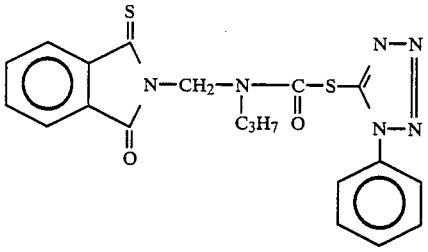
(III)-(52)
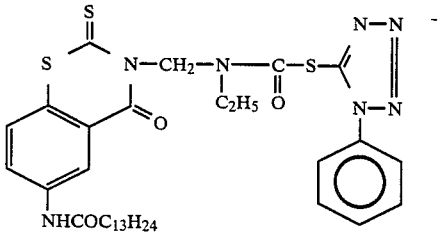
(IV)-(1)
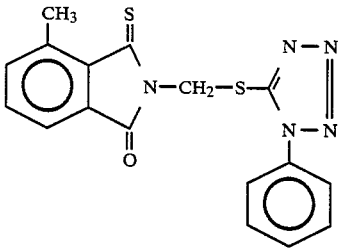
(IV)-(2)
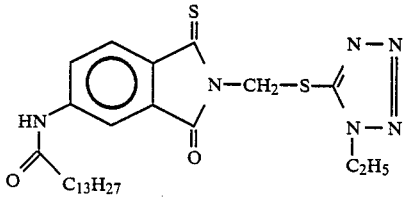

-continued
(IV)-(3)
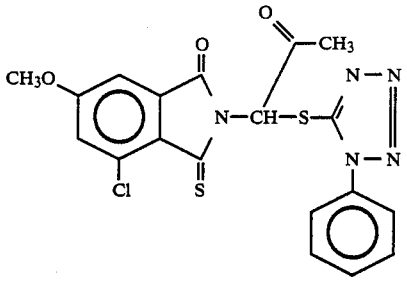
(IV)-(4)
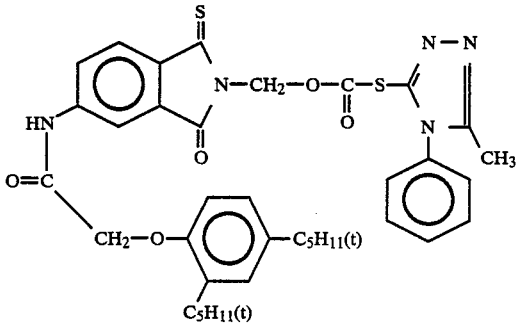
(IV)-(5)
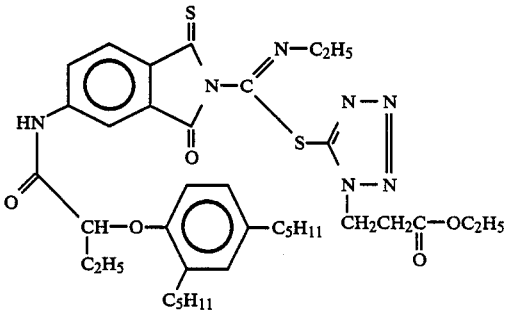
(IV)-(6)
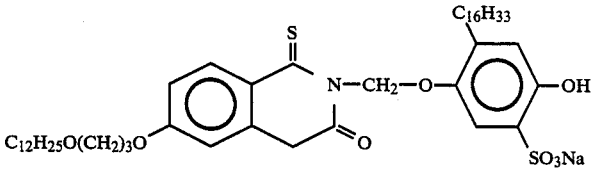
(IV)-(7)
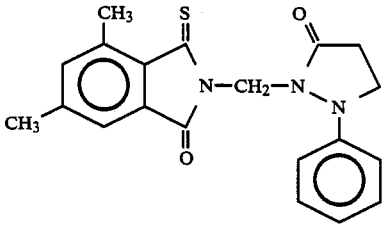
(IV)-(8)
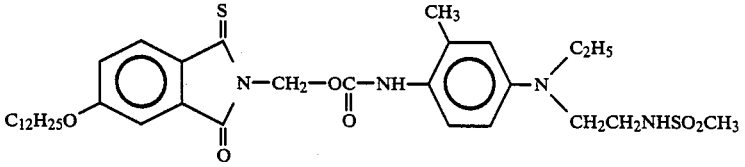

-continued
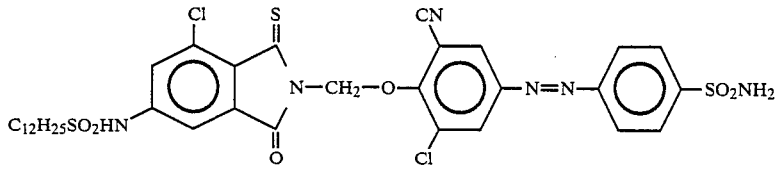
(IV)-(9)
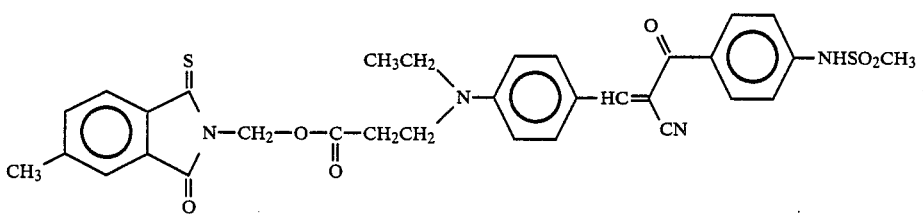
(IV)-(11)
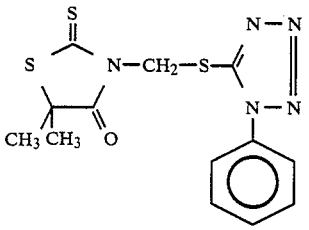
(IV)-(12)
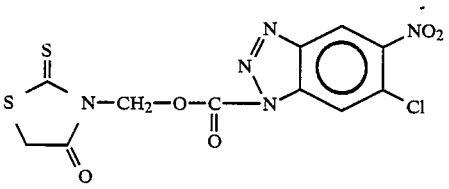
(IV)-(13)
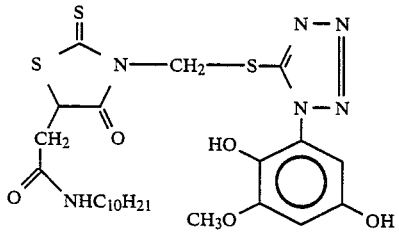
(IV)-(14)
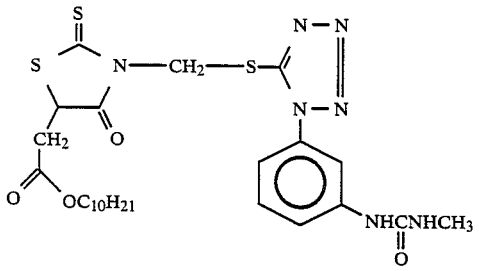
(IV)-(15)
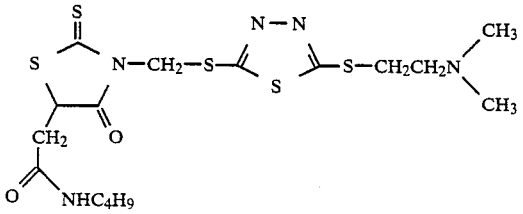

-continued
(IV)-(16)
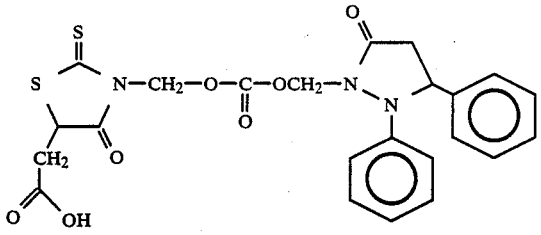
(IV)-(17)
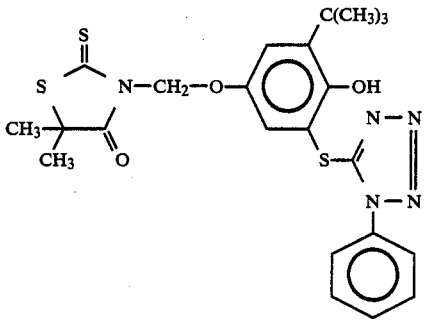
(IV)-(18)
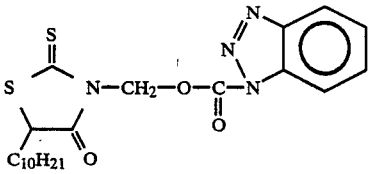
(IV)-(19)
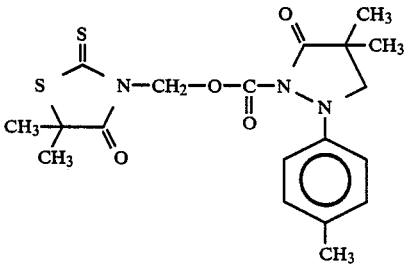
(IV)-(20)
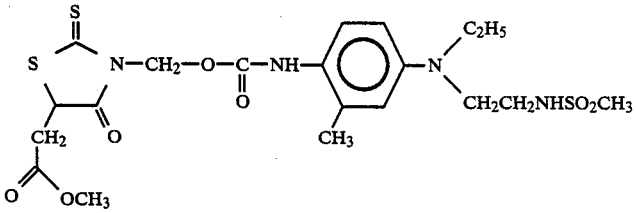
(IV)-(21)
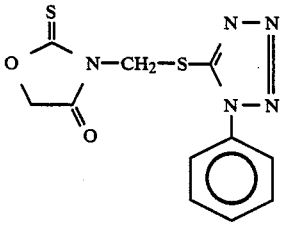

-continued
(IV)-(22)
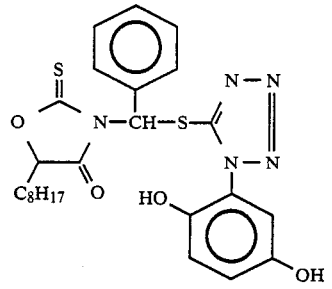
(IV)-(23)
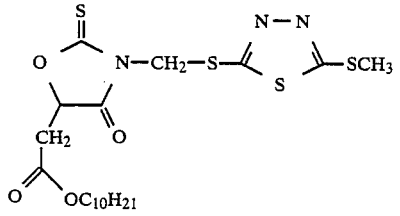
(IV)-(24)
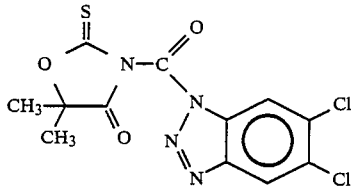
(IV)-(25)
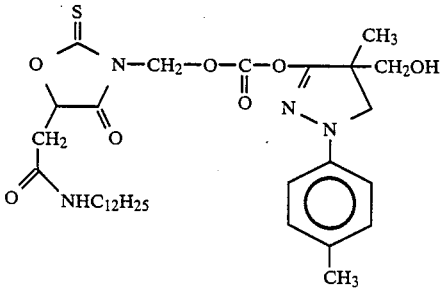
(IV)-(26)
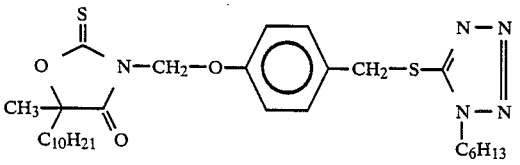
(IV)-(27)
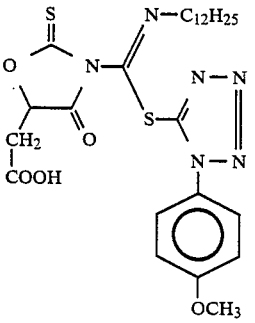
(IV)-(28)
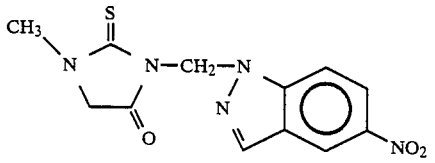

-continued
(IV)-(29)
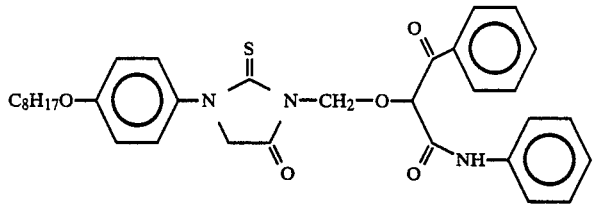
(IV)-(30)
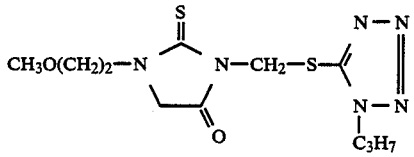
(IV)-(31)
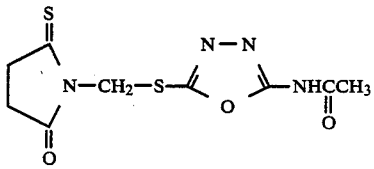
(IV)-(32)
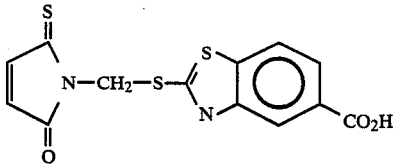
(IV)-(33)
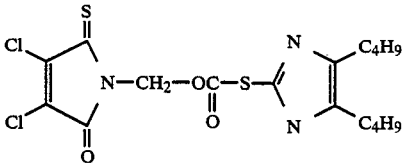
(IV)-(34)
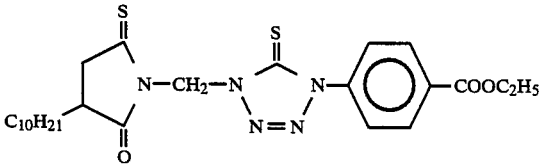
(IV)-(35)
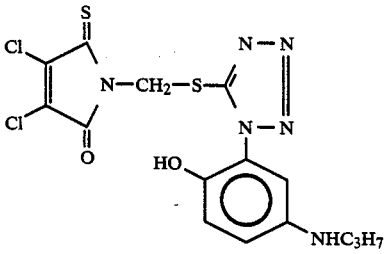
(IV)-(36)
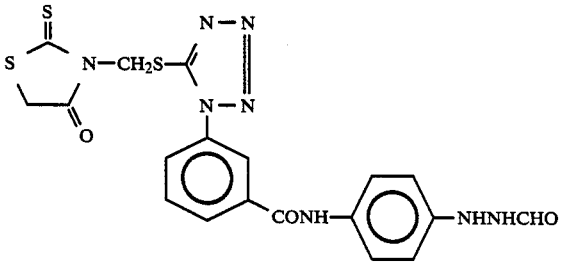

-continued
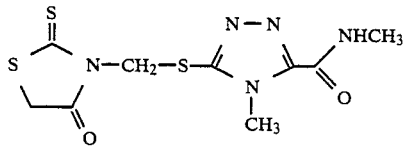
(IV)-(37)
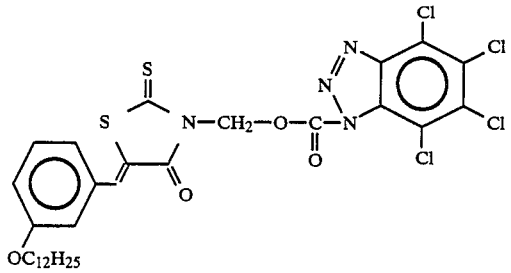
(IV)-(38)
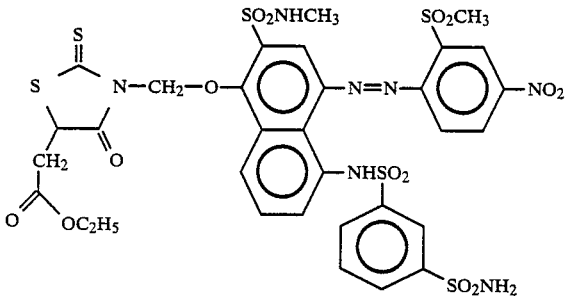
(IV)-(39)
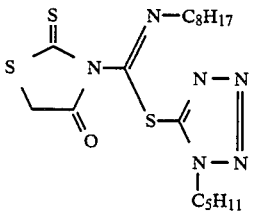
(IV)-(40)
$^{n}C_4H_9NH_2$ (V)-(1)
$HOCH_2CH_2NH_2$ (V)-(2)
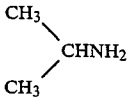
(V)-(3)
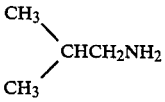
(V)-(4)
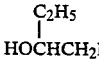
(V)-(5)
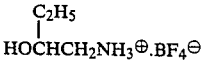
(V)-(6)
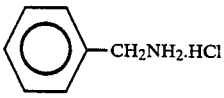
(V)-(7)
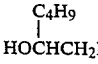
(V)-(8)
-continued
$^{n}C_8H_{17}NH_2$ (V)-(9)
$CH_3OCH_2CH_2NH_2$ (V)-(10)
$(^{n}C_{10}H_{21}NH_2)_2.H_2SO_4$ (V)-(11)
$^{n}C_{16}H_{33}NH_2$ (V)-(12)
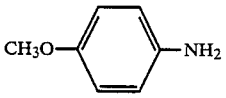
(V)-(13)
$C_3H_7OCH_2CH_2OCH_2CH_2NH_2$ (V)-(14)
$(HOCH_2CH_2)_2NH$ (V)-(15)
$(CH_3OCH_2CH_2)_2NH$ (V)-(16)
$(C_2H_5)_2NH$ (V)-(17)
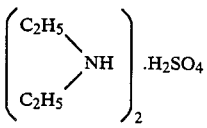
(V)-(18)
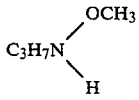
(V)-(19)

-continued
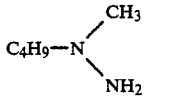
(V)-(20)
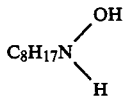
(V)-(21)
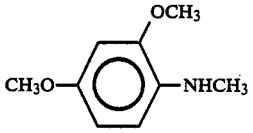
(V)-(22)
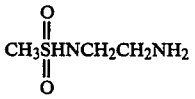
(V)-(23)
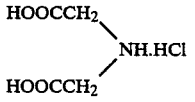
(V)-(24)
(V)-(25)
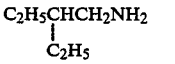
(V)-(26)
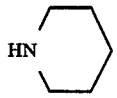
(V)-(27)
-continued
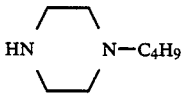
(V)-(28)
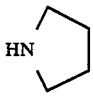
(V)-(29)
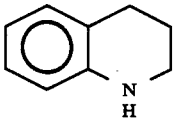
(V)-(30)
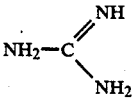
(V)-(31)
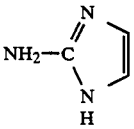
(V)-(32)
[Synthesis of the Compounds Used in the Present Invention]
The compounds of the general formula (I) of the present invention are readily prepared according to the following schemes 1 and 2.
Scheme 1:
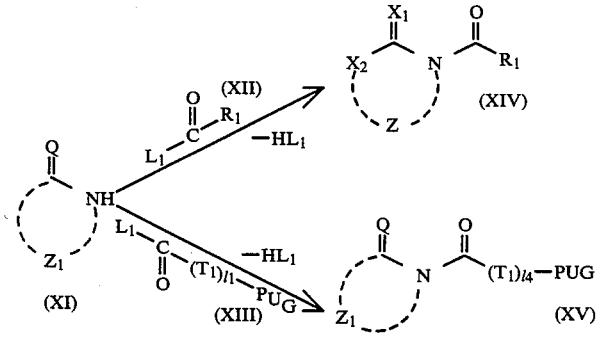
Scheme 2:
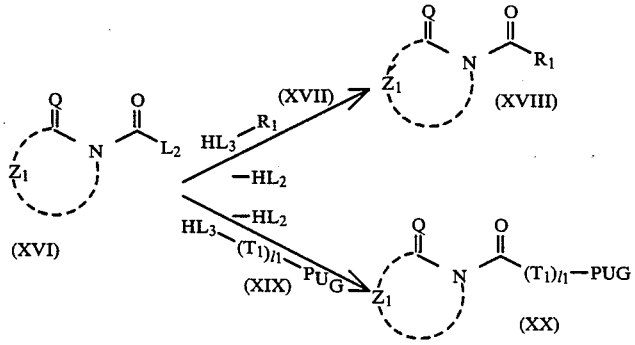

In the schemes 1 and 2, $Z_1$, $R_1$, $T_1$, PUG and $l_1$ have the same meanings as defined in general formula (I), $L_1$ represents a split-off group such as a halogen atom, a hydroxyl group or imidazole group, $L_2$ represents a split-off group such as a halogen atom or an imidazole group, and $L_3$ represents a hetero-atom which can be substituted and is contained in $R_1$, $T_1$ or PUG.

More particularly, compound (XI) is readily prepared according to a method, and its application, as described in Chapters 1, 2, 4, 5, 7 and 8 of Heterocyclic Compounds II, Comprehensive Organic Chemistry 15, compiled by Munio Otake. When $L_1$ is a halogen atom or imidazole, the reaction between compounds (XI) and (XII) or compounds (XI) and (XIII) proceeds in the presence of an organic base such as pyridine or triethylamine to eliminate $HL_1$, thereby forming compound (XIV) or (XV). Further, when $L_1$ is a hydroxyl group and a dehydrating agent such as dicyclohexylcarboimide is used, compound (XIV) or (XV) is readily obtained.

Compound (XVI) indicated in the synthetic scheme 2 is readily prepared according to the reaction between compound (XI) of the scheme 1 and phosgene or triethylamine to remove $HL_2$.

Synthetic examples of precursor compounds according to the present invention are described below.

SYNTHETIC EXAMPLE 1

Synthesis of Exemplified Compound I-(1)

A tetrahydrofuran solution containing 0.05 moles of phosgene was dropped into a tetrahydrofuran (50 ml) solution of thiazoline-2-thione (6g, 0.05 moles) and pyridine (4.4 g, 0.055 moles) at about 5° C., followed by agitation at room temperature for 1 hour. A solution of 1-phenyl-5-mercaptotetrazole (8.9 g, 0.05 moles) and pyridine (4.4 g, 0.055 moles) in tetrahydrofuran (40 ml) was gradually dropped into the reaction solution. After agitation for 1 hour, ice water (100 ml) was added to the reaction solution and the resulting crystals were collected by filtration and dried to give 9.9 g of the exemplified compound I-(1). m.p. 112°-115° C.

SYNTHETIC EXAMPLE 2

Alternative synthesis of exemplified compound I-(1)

A tetrahydrofuran (30 ml) solution of thiazoline-2-thione (6 g, 0.05 moles) was dropped, at about 5° C., into a tetrahydrofuran (40 ml) solution containing 1-phenyl-5-tetrazolinethiocarbonyl chloride (11.8 g, 0.05 moles) prepared according to the process described in Japanese Patent Application (OPI) No. 145135 and pyridine (4.4 g, 0.055 moles), followed by agitation at room temperature for 2 hours. Ice water was added to the reaction solution and the resulting crystals were collected by filtration and dried to give 12.3 g of exemplified compound I-(1). m.p. 112°-114° C.

SYNTHETIC EXAMPLE 3

Synthesis of exemplified compound I-(5)

0.05 moles of phosgene gas was blown, at about 5° C., into a tetrahydrofuran (35 ml) solution of 5,5-dimethylthiazoline-2-thione (7.35 g, 0.05 moles) prepared according to the process described in the afore-indicated Comprehensive Oerganic Chemistry, p. 134 and pyridine (4.4 g, 0.055 moles). After agitation at about 5° C. for 30 minutes, a tetrahydrofuran (40 ml) solution of 1-phenylpyrazoline-3-one (8.1 g, 0.05 moles) was added to the reaction solution, into which triethylamine (5.6 g, 0.055 moles) was dropped. Subsequently, the agitation was continued at room temperature for about 2 hours. Ice water was added to the reaction solution and extracted with ethyl acetate. The extract was dried with anhydrous sodium sulfate, from which the solvent was distilled off to give an oily substance. Isolation by silica gel chromatography resulted in 6.2 g of exemplified compound I-(5) as an oily substance. The structure of exemplified compound I-(5) was identified by spectral data (NMR, IR and mass spectra).

The compounds of the general formula (II) according to the present invention can be readily prepared according to the following scheme 3.

Scheme 3:

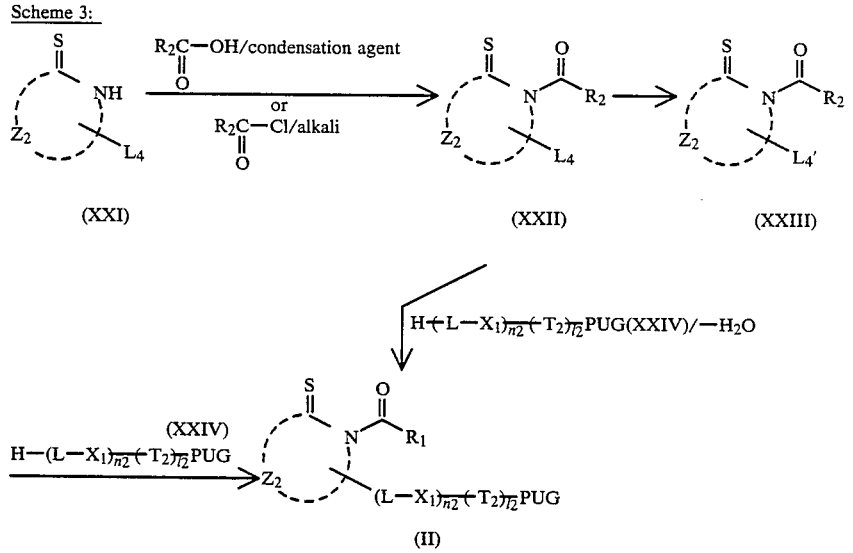

wherein $R_2$, $Z_2$, L, $X_1$, $T_2$, PUG, $n_2$ and $l_2$ have the same meanings as defined in general formula (II), $L_4$ represents a hydroxyl group or a carboxyl group, and $L_4$ represents a halogen atom or a haloformy group. Compound (XXI), which is prepared according to the method or its application described in Comprehensive Organic Chemistry 15, Heterocyclic Compounds II Chapter 4, compiled by Munio Otake or according to the method described by Richard A. Bafford et al, Bulletin de la Société Chemique de France, 971, 1973, is condensed with $R_2COOH$ or subjected to substitution reaction with $R_2COCl$, thereby obtaining compound (XXII). This is stated in the above described report of Eiichi Fujita et al and literature referred to in the report. Subsequently, when $L_4$ of compound (XXII) is a hydroxyl group, the group is converted to a halogen atom by application of thionyl chloride, phosphorus pentachloride, phosphorus tribromide or the like or converted to mesylate or tosylate to give compound (XXIII), followed by a substitution reaction with compound (XXIV) to give compound (II). When $L_4$ of compound (XXII) is a carboxyl group, thionyl chloride is reacted to convert it into an acid chloride (XXIII), followed by a substitution reaction with compound (XXIV) or by dehydrating condensation between compounds (XXII) and (XXIV) to give compound (II).

Synthetic examples for the above compound (II) are described below.

SYNTHETIC EXAMPLE 4

Synthesis of Exemplified Compound II-(1)

Hexadecanoyl chloride (13.7 g, 0.05 moles) was added to an acetonitrile (100 ml) solution of 5-dimethyl-4-hydroxythiazolidine-2-thione (8.1 g, 0.05 moles) prepared according to the method described by Bafford et al and triethylamine (5.1 g, 0.05 moles), followed by heating under reflux for 1 hour. Thereafter, thionyl chloride (12 g, 1.05 moles) was added to the reaction solution, which was subsequently heated under reflux for about 30 minutes. After cooling down to room temperature, water was gradually added to the reaction solution and extracted with ethyl acetate. The extract was washed with water and dried with sodium sulfate. The solvent was distilled off under reduced pressure to give 17.8 g of 4-chloro-5,5-dimethyl-3-hexadecanoylthiazolidine-2-thione as a crude oily substance.

The crude oily substance (8.4 g, 0.02 moles) was added to tetrahydrofuran (50 ml), into which a tetrahydrofuran (30 ml) solution of a sodium salt of 5-mercapto-1-phenyltetrazole (4 g, 0.02 moles) was dropped at room temperature, followed by heating at 50° C. for 1 hour. The solvent was distilled off under reduced pressure, followed by addition of ethyl acetate (100 ml) and washing with water. The ethyl acetate was dried with sodium sulfate and distilled off under reduced pressure to obtain a crude oily substance. This product was isolated and purified by silica gel column chromatography to give 5.1 g of exemplified compound I-(1). The structure of the compound was identified by mass and NMR spectra.

SYNTHETIC EXAMPLE 5

Synthesis of Exemplified Compound II-(12)

Decanoyl chloride (5.2 g, 0.03 moles) was added to an acetonitrile (50 ml) solution of 4-carboxy-thiazolidine-2-thione (4.9 g, 0.03 moles) prepared according to the method described in the above described "Comprehensive Organic Chemistry" and triethylamine (6 g, 0.06 moles), followed by heating under reflux for 1 hour. After cooling, the reaction solution was neutralized with 2NHCl and the resulting crude crystals were filtered out to give an N-decanoyl product. The N-decanoyl product (6 g, 0.02 moles) and potassium carbonate (8.3 g, 0.06 moles) were added to N,N-dimethylacetamide (50 ml), and the resultant solution was then heated to about 80° C., followed by dropping, in about 10 minutes, an N,N-dimethylacetamide (20 ml) solution of 1-(chhloroacetoxymethyl)-4-phenyltetrazoline-5-thione (5.7 g, 0.02 moles) and heating for 4 hours as it is. The reaction solution was poured into ice water, to which 2NHCl was added to render the solution acidic, followed by extraction with ethyl acetate. The extract was dried with sodium sulfate and the solvent was distilled off under reduced pressure to obtain a crude oily substance. The oily product was isolated and purified by silica gel chromatography to obtain 4.2 g of exemplified compound II-(12). The structure was identified by mass and NMR spectra.

The precursor compounds of the general formula (III) according to the present invention can be synthesized according to the following scheme 4.

Scheme 4:

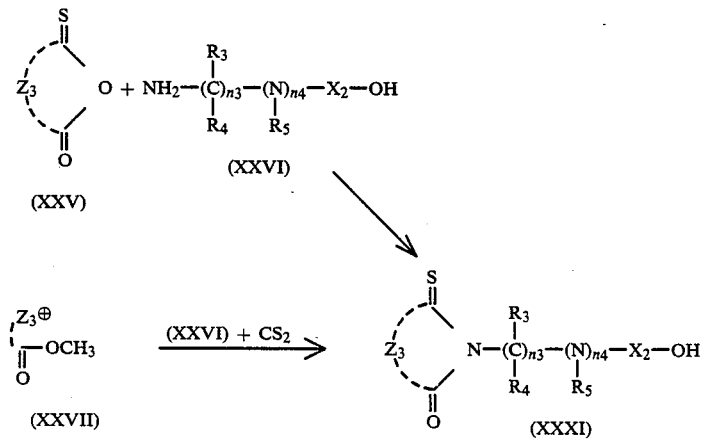

Scheme 4:

-continued

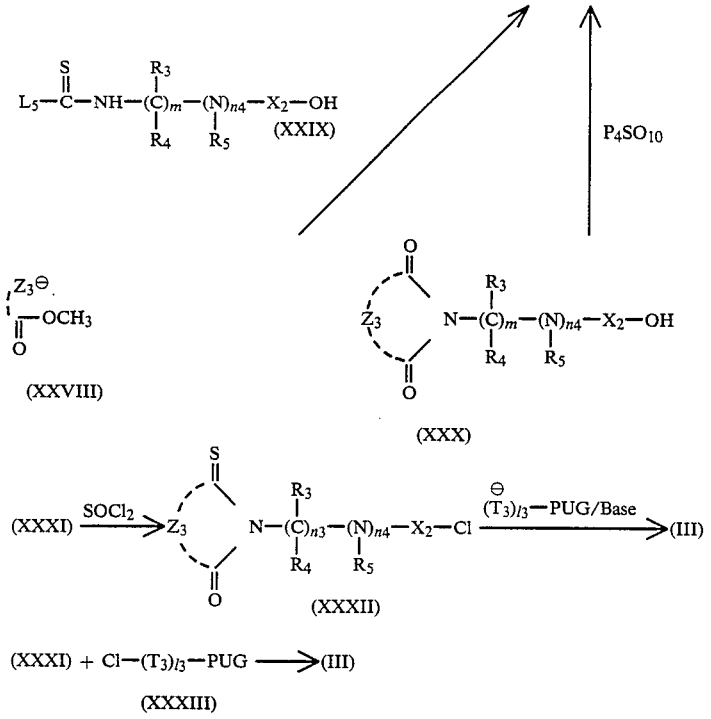

where PUG, $T_3$, $l_3$, $R_3$, $R_4$, $R_5$, $X_2$, $n_3$, $n_4$ and $Z_3$ have, respectively, the same meanings as defined in the general formula (III) and $L_5$ represents a split-off group.

The compound of general formula (III) is obtained by the steps of dehydration condensation between (XXV) and (XXVI); ring closure reaction using an addition reaction product of (XXVI) and carbon disulfide as a nucleophilic agent; or reaction between (XXIX) having a split-off group and nucleophilic agent (XXVIII); or formation of an intermediate (XXXI) by monothiocarbonylation of (XXX) with $P_4SO_{10}$ and reaction with a PUG-($T_3$) $l_3^{\ominus}$ after conversion of (XXXI) into an active halide (XXXII) or reaction of (XXXI) with (XXXIII) having an active halide.

Synthetic examples for compounds (III) are described below.

SYNTHETIC EXAMPLE 6

Synthesis of Exemplified Compound III-(1)

Carbon disulfide (7.2 g,, 0.095 moles) was dropped, at about 5° C., into a tetrahydrofuran (50 ml) solution of β-alanine (8.9 g, 0.1 mole) and triethylamine (10.1 g, 0.1 mole), followed by continuing agitation for about 5 hours as it is, thereby forming triethylamine β-alaninedithiocarbamate. Ethyl α-chloroacetate (12.3 g, 0.1 mole) was dropped into the reaction solution and was agitated at 5° C. for 30 minutes and then at about 50° C. for 3 hours, followed by distilling off the solvent under reduced pressure. The residue was washed with cold water to obtain 16 g of N-(3-carboxyethyl)rhodanine. Potassium tertbutoxide (6.2 g, 0.055 moles) was added, under ice-cooling conditions, to an N,N-dimethylacetamide (40 ml) solution of the thus obtained rhodanine derivative (10.2 g, 0.05 moles) and agitated for 30 minutes, followed by dropping an N,N-dimethylacetamide (50 ml) of 1-phenyl-4-bromomethyl-tetrazoline-5-thione (13.5 g, 0.05 moles). After completion of the dropping, the reaction solution was agitated at room temperature for about 2 hours and poured into ice water. The solution was extracted with ethyl acetate and dried with sodium sulfate, and the solvent was distilled off to obtain a crude oil substance. This product was isolated and purified by silica gel column chromatography to give 7.3 g of exemplified compound III-(1). The structure was identified by mass and NMR spectra.

SYNTHETIC EXAMPLE 7

Synthesis of Exemplified Compound III-(8)

$P_2S_5$ (5 g, 0.023 moles) was added to a benzene (150 ml) solution of phthalimide (14.7 g, 0.1 mole) under ice-cooling conditions, followed by heating under reflux for 1 hour. The benzene phase was washed with water and then with 2NHCl and was distilled off under reduced pressure to obtain a reaction product. To the product were added acetic acid (50 ml) and 30% formalin (20 ml), which was agitated for 5 hours at room temperature. Water was added to the reaction solution and the resulting crystals were filtered out to obtain 11.3 g of N-hydroxymethylmonothiophthalimide. Phosphorus tribromide (13.4 g, 0.05 moles) was added to a benzene (100 ml) solution of the monothiophthalimide product (9.6 g, 0.05 moles) and heated under reflux for 1 hour. The benzene phase was collected, from which the benzene was distilled off under reduced pressure to obtain 11.2 g of crude crystals of a bromomethyl product. The bromomethyl product (7.6 g, 0.03 moles) was gradually added, at about 5° C., to a tetrahydrofuran (50 ml) solution of n-propylamine (4.1 g, 0.07 moles). The reaction solution was agitated at room temperature for 1 hour, into which ice water was poured, followed by extraction with ethyl acetate, drying with sodium sulfate and distilling off the solvent to obtain a crude oily substance. The substance was added, without subjecting it to purification, to a solution of a mixture of N,N-dimethylacetamide (50 ml) and triethylamine (3.3 g, 0.033 moles), into which a tetrahydrofuran (50 ml) solution of bis[1-(3-methylureidophenyl)-5-tetrazolylthio]carbonyl (16 g, 0.03 moles) was dropped. Subsequently, the reaction solution was agitated at room temperature for about 3 hours and poured into ice water. The solution was extracted with ethyl acetate and dried with sodium sulfate, and the solvent was distilled off to obtain a crude oily substance. Isolation and purification by silica gel column chromatography resulted in 7.5 g of exemplified compound III-(8). The structure was identified by mass and NMR spectra.

The compounds of general formula (IV) of the present invention can be synthesized as shown in the following scheme 5 according to the processes described in Japanese Patent Application (OPI) Nos. 135,949/82, 179,842/82 and 198,453/84.

Scheme 5:

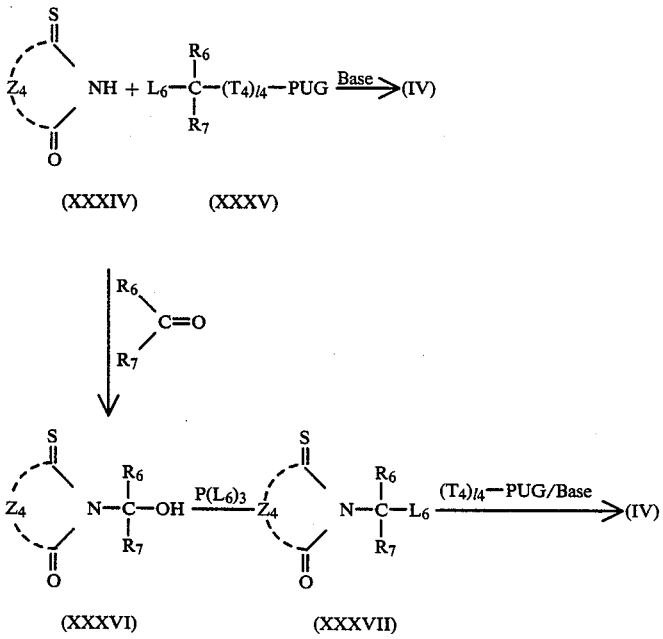

wherein PUG, $T_4$, $l_4$, $R_6$, $R_7$ and $Z_4$ have, respectively, the same meanings as defined in general formula (IV), and $L_6$ represents a chlorine or bromine atom.

Compound (XXXIV) which is a starting material in the scheme 5 can be prepared according to processes described in the following books and literature or similar processes:

Shin Jikken Kagaku Koza Vol. 14, "Syntheses and Reactions of Organic Compounds [IV] 9.1–9.3 and 9.4", compiled by Takemi Takahashi and written by Tadashi Sasaki, 1978, published by Maruzen K. K.

Comprehensive Organic Chemistry Vol. 15 "Heterocyclic Compounds II" Chapters 2, 4 and 5, compiled by Munio Otake and written by Masaki ohta, 1957, published by Asakura Shoten.

Peter A. S. Smith and Rober O. Kan, Journal of Organic Chemistry, 29, 2261 (1964).

Synthetic examples for the above compound (IV) are described.

SYNTHETIC EXAMPLE 8

Exemplified Compound IV-(1)

5-Methyl-3-thiophthalimide (17.7 g, 0.1 mole) (whose synthesis is described in the Peter et al reference above described ) was added to a 30% formalin solution (100 ml) and heated under reflux for 3 hours. The reaction solution was cooled and the resulting crystals were collected by filtration to obtain 10.8 g of a methylol product. The crystals were immediately added to benzene (100 ml), to which phosphorus tribromide (5.0 g) was added further, followed by heating under reflux for about 30 minutes. The benzene phase was separated and the benzene was distilled off under reduced pressure to obtain crude crystals of a bromomethyl product. Without purifying, the crystals were dissolved in tetrahydrofuran (100 ml), into which a tetrahydrofuran (50 ml) solution of 5-mercapto-1-phenyltetrazole (8.9 g, 0.05 moles) and $CH_3ONa$ (3.1 g, 0.055 moles) was gradually dropped at about 5° C. Subsequently, the reaction solution was agitated at room temperature for 1 hour. The solvent was distilled off under reduced pressure and the resulting crude oily substance was subjected to isolation and purification by silica gel chromatography, thereby obtaining 7.2 g of exemplifed compound IV-(1). The structure was identified by the values of an elementary analysis and mass and NMR spectra.

SYNTHETIC EXAMPLE 9

Synthesis of Exemplified Compound IV-(11)

A tetrahydrofuran (50 ml) solution of ammonium carbamate (11.0 g. 0.1 mole) obtained from carbon disulfide and ammonia was dropped into a tetrahydrofuran (120 ml) solution of -bromoisobutyric acid (15.5 g, 0.1 mole) in a stream of nitrogen at about 5° C. After agitation at about 5° C. for 1 hour, the agitation was further continued at room temperature for 1 hour and ice water was added to the reaction solution. The resulting crystals were collected by filtration to obtain 11.6 g of 5,5-dimethylrhodanine.

8.05 g of 5,5-dimethylrhodanine was converted to a methylol product and then to a bromomethyl product in the same manner as in Example 8, followed by reactin with a sodium salt of 5-mercapto-1-phenyltetrazole to give 11.3 g of exemplified compound IV-(11).

The photographic reagent precursors used in the present invention may be used solely or as a combination thereof.

The blocked photographic reagent precursors of the present invention may be added to any layers of a silver halide photographic material including a silver halide emulsion layer, a colorant layer, an undercoat layer, a protective layer, an intermediate layer, a filter layer, an antihalation layer, an image-receiving layer for a black-and-white or color diffusion transfer method, or a cover sheet or other auxiliary layer.

For the addition of these precursors to these layers, precursors may be added directly to a coating paint to form an intended layer or after dissolution in a solvent, which does not effect an adverse influence on the photographic material, e.g. in water or an alcohol. Alternatively, precursors may be dissolved in high boiling and/or low-boiling solvents and added for emulsification and dispersion in an aqueous solution. Still alternatively, precursors may be added after impregnation with polymer latex as described in Japanese Patent Application (OPI) Nos. 39853/76, 59942/76 and 32552/79 and U.S. Pat. No. 4,199,363.

The precursors of the present invention may be added to any stage of a manufacturing process of the photographic material and are added preferably just before their application.

The precursors of the invention may be used, for example, in color photographic materials of the coupler type.

A subtractive color process is an ordinary process for forming a color image from a color photographic material, in which there are used silver halide emulsions which selectively sensitize to blue, green and red lights respectively and color image forming agents of yellow, magenta and cyan which are in complementary relations with the blue, green and red. For the formation of a yellow color image, there is used, for example, an acylacetoanilide or a benzoylmethane system coupler. For the formation of a magenta color image, a pyrozolone, pyrazolobenzimidazole, cyanoacetophenone or indazolone system coupler is mainly used. For the formation of a cyan color image, phenol system couplers such as, for example, phenols and naphthols are used.

In general, color photographic materials may be broadly classified into two types including a coupler-in-developer-type in which couplers are incorporated in a developer and a coupler-in-emulsion type in which couplers are incorporated in the respective photosensitive layer of the photographic material so as to keep the respective performances independently. In the latter case, a coupler for forming a dye image is added to a silver halide emulsion. The coupler added to the emulsion should be resistant to diffusion in an emulsion binder matrix.

In the coupler-in-emulsion type, the processing steps of the color photographic material fundamentally consists of the following three steps:

(1) Color developing step
(2) Bleaching step
(3) Fixing step.

The bleaching and fixing steps may be conducted simultaneously. Namely, it is a bleaching and fixing step, a,so-called blix step, in which desilvering is conducted for the developed silver and non-developed silver halide. The practical development treatment includes, aside from the two fundamental steps of the above color developing and desilvering, an auxiliary step for keeping good photographic and physical qualities of an image or for enabling an image to be well preserved. For instance, there is included a step of using a hard film bath for preventing excess softening of a processed photographic film, a suspension bath by which the developing reaction is effectively stopped, an image-stabilizing bath for stabilizing an image and/or a film-removing bath in which a backing layer is removed from a base.

In order to introduce couplers into the silver halide photographic material of the invention, conventionally known methods may be used including a method of adding couplers to emulsions or dispersing couplers in emulsions, and a method of adding couplers to gelatin/silver halide emulsions or hydrophilic colloids. More particularly, there are known methods in which couplers are mixed with and dispersed in high-boiling organic solvents such as dibutyl phthalate, tricresyl phosphate, wax and higher fatty acids and esters thereof as described, for example, in U.S. Pat. Nos. 2,304,939 and 2,322,027. Other known methods are methods in which couplers are mixed with and dispersed in low-boiling organic solvents or water-soluble organic solvents with or without high-boiling organic solvents as described, for example, in U.S. Pat. Nos. 2,801,170, 2,801,171 and 2,949,360. If couplers are sufficiently low in melting point of, for example, below 75° C., there is used a method of dispersing couplers with or without combination with other types of couplers such as colored couplers or uncolored couplers as described, for example, in German Patent No. 1,143,707.

Examples of auxiliary dispersing agents ordinarily used include anionic surface active agents (e.g., sodium alkylbenzenesulfonates, sodium dioctylsulfosuccinate, sodium dodecylsulfate, sodium alkylnaphtalenesulfonates, Fisher-type couplers), amphoteric surface active agents (e.g., N-tetradecyl-N,N-dipolyethylene-α-betaine), and nonionic surface active agents (e.g., sorbitan monolaurate).

The photographic emulsion layer of the photographic material of the invention may comprise color-forming couplers i.e., compounds capable of color developing by oxidative coupling with aromatic primary amine developing agents (e.g., phenylenediamine derivatives and aminophenol derivatives), in the color development processing. Examples of such magenta couplers include 5-pyrazolone coupler, pyrazolobenzimidiazole coupler, cyanoacetylcumarone coupler, acylacetonitrile couplers and the like. Examples of yellow couplers include acylacetoamide couplers (e.g., benzoylacetoanilides, pivaloylacetoanilides). Examples of cyan couplers include naphthol couplers and phenol couplers. These couplers should preferably be non-diffusible as having a hydrophobic group called a ballast group. Couplers may be either of four equivalents or two equivalents with respect to silver ion. Further, colored couplers having the effect of color correction or couplers capable of releasing a development restrainer as development proceeds (DIR couplers may also be used. Aside from DIR couplers, colorless DIR coupling compounds in which a coupling reaction product is colorless and is capable of releasing a development restrainer may be contained.

When the photographic element of the present invention is applied to a color diffusion transfer photography, the element may be a film unit of a peel-apart type, an integrated type as described in Japanese Patent Publication Nos. 16356/71 and 33697/73, Japanese Patent Application (OPI) No. 13040/75 and British Patent No. 1,330,524, and a peel-apart-free type as described in Japanese Patent Application (OPI) No. 119345/82.

The compounds of the invention may be used in black and white photographic materials. Examples of such materials include X-ray films for medical service, black and white films for ordinary photography, lith films, scanner films and the like.

The silver halide photographic materials of the invention are not critical with respect to the method of preparing silver halide emulsions, halogen compositions, crystal habit, particle size, chemical sensitizers, antifoggants, stabilizers, surface active agents, gelatin hardening agents, hydrophilic colloidal binders, matting agents, dyes, sensitizing dyes, anti-bleaching agents, color-mixing preventing agents, polymer latex, brightening agents, antistatic agents and the like. In this connection, reference should be made to Research Disclosure Vol. 176, pages 22 to 31 (December, 1978).

The manner of exposure and development of the silver halide photographic material of the invention is not critical. For instance, known methods and processing solutions as described in the above-indicated Research Disclosure, on pages 28 to 30 may be employed in the practice of the invention. The photographic processing may be either a photographic processing of forming a silver image (black and white photographic processing) or a processing of forming a dye image (color photographic processing). The processing temperature is generally selected from 18° C. to 50° C. However, temperatures lower than 18° C. or higher than 50° C. may be used.

The developing solution used for black and white photographic processing may contain any known developing agents. Examples of such agents include, dihydroxybenzenes such as hydroquinone, 3-pyrazolidones such as 1-phenyl-3-pyrazolidone, aminophenols such as N-methyl-p-aminophenol and the like. These agents may be used solely or in combination. The developing solution generally comprises other known preservatives, alkalis, pH buffering agents, antifoggants and the like and, if necessary, dissolving aids, toning agents, development promotors, surface active agents, antifoamers, hard water softening agents, hardening agents viscosity-increasing agents and the like.

The photographic emulsion of the invention may be applied with a so-called "lith-type" development processing. In this development processing developing steps are contagiously effected using dihydroxybenzenes as the developing agent under a low concentration of sulfite ions in order to photographically reproduce a line image or a half-tone image.

Moreover, when the process of the invention is applied to methods of obtaining pictures with hard photographic characteristics, in which a latent-image-on-surface type emulsion is developed in the presence of hydrazine compounds, as described in U.S. Pat. Nos. 4,166,742, 4,168,977, 4,221,857, 4,224,401, 4,243,739, 4,272,606 and 4,311,781, half-tone and line images are effectively reproduced. As a result, there is performed good photographic characteristics such as very high sensitivity and high contrast can be obtained with little occurrence of a non-imagewise, fine spot-like blackening phenomenon called black speckles.

The color developing solution generally consists of an aqueous alkaline solution containing a color developing agent. The color developing agent may be known aromatic amines including, for example, phenylenediamines such as 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methansulfoamidoethylaniline, 4-amino-3-methyl-N-ethyl-N-β-methoxyethylaniline and the like.

Further, there may be used those described by L. F. A. Mason, Photographic Processing Chemistry (Focal Press) (1966), pp. 226–229 and also in U.S. Pat. Nos. 2,193,015 and 2,592,364, and Japanese Patent Application (OPI) No. 64933/73.

The photographic emulsion layer after color development is usually bleached. The bleaching treatment may be effected simultaneously with or separately from the fixing treatment. Examples of the bleaching agent include compounds of polyvalent metals such as iron (III), cobalt (IV), chromium (VI), copper (II) and the like, peroxy acids, quinones, nitroso compounds and the like.

The silver halide photographic material of the present invention has the effect that the photographic material can be stably present under preservation conditions and the other effect that the photographic reagent can be timely released rapidly and effectively, when needed at the time of the processing. Particularly with regard to the silver halide photographic material of the present invention, the release of the photographic reagent can timely be achieved, even if the photographic material is processed with the processing solution having a relatively low pH such as 9 to 12. Even when a heat development is carried out, the silver halide photographic material of the present invention can timely release the photographic reagent by performing the usual heat development. Furthermore, the present invention possesses excellent effects such as the prevention of desensitization due to the addition of the photographic reagent precursor and the performance of the function of the released photographic reagent.

The present invention will be described in detail with reference to examples, but the latter do not intend to limit the scope of the present invention.

In the following examples, the above-described exemplified compounds are used as the compounds of the present invention (precursors).

The structures of the antifoggants (development restrainer) and auxiliary developing agents used for comparison and the coupler are as follows:

(1) Antifoggants (development restrainer)

Comparative compound 1-A

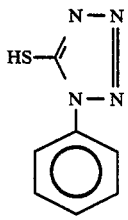

-continued

Comparative compound 1-B

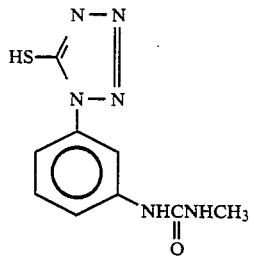

Comparative compound 1-C

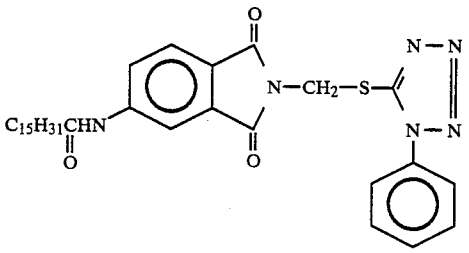

Comparative compound 1-D

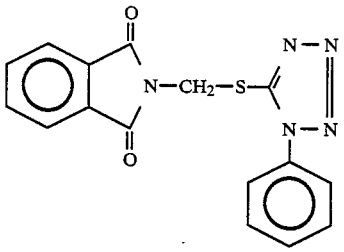

(Disclosed in Japanese Patent Application (OPI) No. 135,949/82)

Comparative compound 1-E

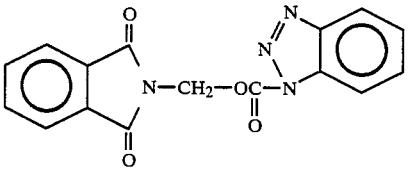

(Disclosed in Japanese Patent Application (OPI) No. 179,842/82)

Comparative compound 1-F

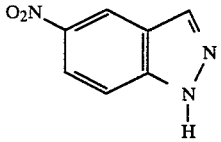

(2) Auxiliary developing agents

Comparative compound 2-A

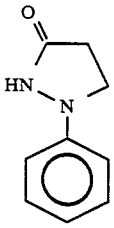

-continued

Comparative compound 2-B

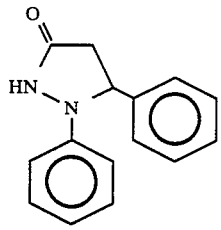

Comparative compound 2-C

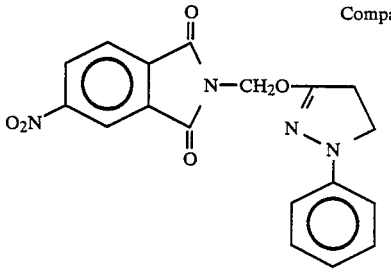

Comparative compound 2-D

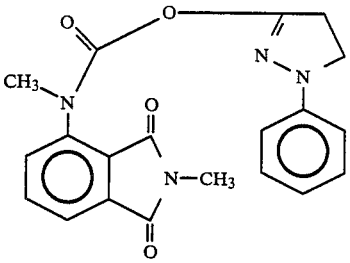

Comparative compound 2-E

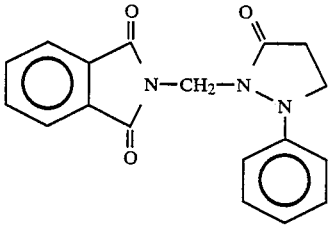

(Disclosed in Japanese Patent Application (OPI) No. 197,037/84)

Comparative compound 2-F

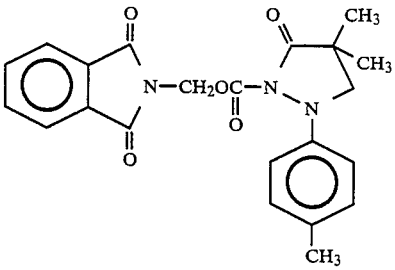

(Disclosed in Japanese Patent Application (OPI) No. 179,842/82)

(3) Coupler

-continued

Cp-1

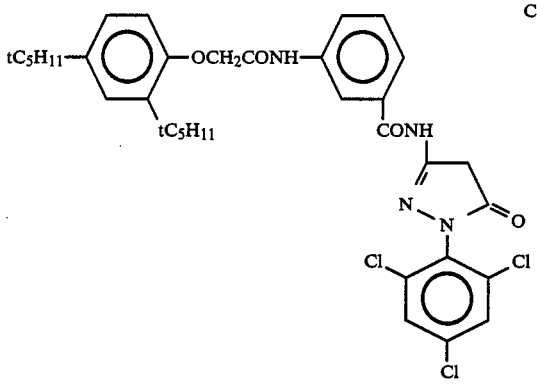

EXAMPLE 1

The effectiveness of an antifoggant precursor of the present invention was evaluated by the use of compounds of the present invention and control (comparative) compounds. In the first place, a photographic element consisting of the undermentioned emulsion layer and protective layer was formed. The preparation of the emulsion layer and the protective layer as well as the coating manner of these layers was as follows: Antifoggants and blocked antifoggants (antifoggant precursors) of the present invention which were set forth in Table 1 were each dissolved and emulsified in an aqueous gelatin solution containing tricresyl phosphate together with a coupler (Cp-1) to prepare an emulsifying dispersion, and the latter was then added to a silver iodobromide emulsion. Cellulose triacetate film bases provided with primer layers were then coated with the thus prepared emulsions. Furthermore, protective layers were coated on the emulsion layers respectively in order to prepare Samples 1 to 6. Amounts of the respective coating materials will be given with a unit of "g/cm$^2$" or "mol/m$^2$" in parentheses.

(1) Emulsion layer:

Negative silver iodobromide emulsion; grain size=1.4 μm (silver content=$1.6\times10^{-2}$ mol/m$^2$).

Magenta coupler Cp-1 ($1.3\times10^{-3}$ mol/m$^2$).

Antifoggants or their precursors (as shown in Table 1).

Gelatin (2.50 g/m$^2$).

(2) Protective layer:

Gelatin (1.30 g/m$^2$).

Sodium salt of 2,4-dichloro-6-hydroxy-s-triazine (0.05 g/m$^2$).

A tungsten light source was used for these photographic elements in order to give thereto a 25 CMS exposure having a color temperature adjusted to 4,800° K. by a filter, and the development processing was then carried out at a temperature of 38° C. in accordance with the following processing steps:

| | |
|---|---|
| Color development | 3 min 15 sec |
| Bleaching | 6 min 30 sec |
| Washing | 2 min 10 sec |
| Fixing | 4 min 20 sec |
| Washing | 3 min 15 sec |
| Stabilization | 1 min 5 sec |

Compositions of the processing solutions used in the respective steps were as follows:

| | |
|---|---|
| Color developing solution: | |
| Diethylenetriaminepentaacetic acid | 1.0 g |
| 1-Hydroxyethylidene-1,1-diphosphonic acid | 2.0 g |
| Sodium sulfite | 4.0 g |
| Potassium carbonate | 30.0 g |
| Potassium bromide | 1.4 g |
| Potassium iodide | 1.3 mg |
| Hydroxylamine sulfate | 2.4 g |
| 4-(N—Ethyl-N—β-hydroxyethylamino)-2-methylaniline sulfate | 4.5 g |
| Water | q.s. to 1.0 liter (pH = 10.0) |
| Bleaching solution | |
| Ferric ammonium ethylenediamine-tetraacetate | 100.0 g |
| Disodium ethylenediamine-tetraacetate | 10.0 g |
| Ammonium bromide | 150.0 g |
| Ammonium nitrate | 10.0 g |
| Water | q.s. to 1.0 liter (pH = 6.0) |
| Fixer: | |
| Disodium ethylenediamine-tetraacetate | 1.0 g |
| Sodium sulfite | 4.0 g |
| Aqueous ammonium thiosulfate solution (70%) | 175.0 ml |
| Sodium bisulfite | 4.6 g |
| Water | q.s. to 1.0 liter (pH = 6.6) |
| Stabilizer: | |
| Formalin (40%) | 2.0 ml |
| Polyoxyethylene-p-monononyl phenyl ether (average polymerization degree = about 10) | 0.3 g |
| Water | q.s. to 1.0 liter |

Photographic properties of the thus processed samples are set forth in Table 1.

TABLE 1

| Sample No. | Antifoggant or its Precursor | Amount mol/m$^2$ | Fog | Gamma | Relative* Sensitivity | Maximum Color Density |
|---|---|---|---|---|---|---|
| 1 | None (Control) | — | 0.14 | 0.78 | 100 | 1.60 |
| 2 | Exemplified Compound (I)-(1) | $2.0\times10^{-6}$ | 0.08 | 0.73 | 93 | 1.45 |
| 3 | Exemplified Compound (I)-(16) | $4.0\times10^{-6}$ | 0.10 | 0.76 | 95 | 1.55 |
| 4 | Exemplified Compound (I)-(40) | $2.0\times10^{-5}$ | 0.11 | 0.77 | 97 | 1.57 |
| 5 | Comparative Compound 1-A | $2.0\times10^{-6}$ | 0.04 | 0.37 | 25 | 0.93 |

TABLE 1-continued

| Sample No. | Antifoggant or its Precursor | Amount mol/m² | Fog | Gamma | Relative* Sensitivity | Maximum Color Density |
|---|---|---|---|---|---|---|
| 6 | Comparative Compound 1-B | $4.0 \times 10^{-6}$ | 0.05 | 0.53 | 37 | 1.12 |

*Relative sensitivity: A reciprocal number of an exposure for providing a color density of fog + 0.2, and its value of each sample was obtained as a value relative to the reciprocal number of the control sample regarded as 100. The same rule applies correspondingly to the Tables below.

It is apparent from the results in Table 1 that with regard to Samples 2 to 4 in which the precursor compounds of the present invention were used, the photographic fog was diminished, the sensitivity being scarcely deteriorated.

As a consequence, the antifoggant precursor of the present invention can be stably present in the photographic element film, and at the time of the processing, the antifoggant can be released to thereby diminish the photographic fog specifically without any desensitization.

EXAMPLE 2

The effectiveness of an auxiliary developing agent precursor of the present invention was evaluated by the use of compounds of the present invention and control (comparative) compounds. In the first place, a photographic element consisting of the undermentioned emulsion layer and protective layer was formed. The preparation of the emulsion layer and the protective layer as well as the coating manner of these layers was as follows: Auxiliary developing agents and their precursors of the present invention which were set forth in Table 2 were each dissolved and emulsified in an aqueous gelatin solution containing tricresyl phosphate together with a coupler (Cp-1) to prepare an emulsifying dispersion, and the latter was then added to a silver iodobromide emulsion. A cellulose triacetate film base provided with a primer layer was then coated with each of the thus prepared emulsions. Furthermore, the protective layers were coated on the emulsion layer respectively in order to prepare Samples 7 to 11. Amounts of the respective coating materials will be given with a unit of "g/cm²" or "mol/m²" in parentheses.

(1) Emulsion layer:

Negative silver iodobromide emulsion; grain size = 1.4 μm (silver content = $1.6 \times 10^{-2}$ mol/m²).

Magenta coupler Cp-1 ($1.33 \times 10^{-3}$ mol/m²).

Auxiliary developing agents or their precursors ($1.33 \times 10^{-3}$ mol/m²).

Gelatin (2.50 g/m²).

(2) Protective layer:

Gelatin (1.30 g/m²).

Sodium salt of 2,4-dichloro-6-hydroxy-s-triazine (0.05 g/m²).

These film samples were allowed to stand under conditions of 40° C. and a relative humidity of 70% for 14 hours, and the same color development as in Example 1 was then carried out after giving imagewise an exposure for sensitometry.

The photographic properties thus obtained are set forth in Table 2.

TABLE 2

| Sample No. | Auxiliary Developing Agent or its Precursor | Fog | Gamma | Relative Sensitivity | Maximum Color Density |
|---|---|---|---|---|---|
| 7 | None (Control) | 0.14 | 0.77 | 100 | 1.62 |
| 8 | Exemplified Compound (I)-(5) | 0.15 | 0.87 | 121 | 1.70 |
| 9 | Exemplified Compound (I)-(18) | 0.14 | 0.82 | 119 | 1.69 |
| 10 | Comparative Compound 2-A | 0.21 | 0.95 | 78 | 1.74 |
| 11 | Comparative Compound 2-B | 0.17 | 0.93 | 92 | 1.75 |

As is apparent from Table 2, with regard to the samples to which the auxiliary developing agents were directly added, the increase in the photographic fog and the occurrence of desensitization were observed, but in Samples 8 and 9 in which the compounds of the present invention were employed, the photographic fog was scarcely increased and sensitization was obtained.

EXAMPLE 3

Samples 12 to 17 were prepared in the same manner as in Example 1 with the exception that the antifoggant precursors were altered, and the same processing as in Example 1 was carried out for a test of photographic properties. The results are set forth in Table 3.

TABLE 3

| Sample No. | Antifoggant or its Precursor | Amount mol/m² | Fog | Gamma | Relative Sensitivity | Maximum Color Density |
|---|---|---|---|---|---|---|
| 12 | None (Control) | — | 0.15 | 0.78 | 100 | 1.61 |
| 13 | Exemplified Compound (II)-(1) | $2.0 \times 10^{-6}$ | 0.08 | 0.73 | 94 | 1.50 |
| 14 | Exemplified Compound (II)-(3) | $2.0 \times 10^{-5}$ | 0.11 | 0.77 | 96 | 1.58 |
| 15 | Exemplified Compound (II)-(12) | $2.0 \times 10^{-6}$ | 0.09 | 0.75 | 95 | 1.50 |
| 16 | Comparative Compound 1-C | $2.0 \times 10^{-6}$ | 0.06 | 0.68 | 88 | 1.38 |
| 17 | Comparative Compound | $4.0 \times 10^{-6}$ | 0.05 | 0.38 | 24 | 0.92 |

TABLE 3-continued

| Sample No. | Antifoggant or its Precursor | Amount mol/m$^2$ | Fog | Gamma | Relative Sensitivity | Maximum Color Density |
|---|---|---|---|---|---|---|
| | 1-A | | | | | |

It is apparent from Table 3 that in Samples 13 to 15 in which the precursor compounds of the present invention were employed, the photographic fog was diminished, the sensitivity being scarcely deteriorated.

Accordingly, the antifoggant precursor of the present invention can be stably present in the photographic element film, and the antifoggant can be released at the time of the processing, whereby the photographic fog can be lowered specifically without any desensitization.

EXAMPLE 4

The procedure of Example 2 was repeated with the exception that the auxiliary developing agents or their precursors shown in Table 4 were employed, in order to prepare Samples 18 to 22. The latter were processed as in Example 2, and the thus processed samples were tested for photographic properties. The results are set forth in Table 4.

TABLE 4

| Sample No. | Auxiliary Developing Agent or its Precursor | Fog | Gamma | Relative Sensitivity | Maximum Color Density |
|---|---|---|---|---|---|
| 18 | None (Control) | 0.15 | 0.77 | 100 | 1.61 |
| 19 | Exemplified Compound (II)-(5) | 0.15 | 0.81 | 119 | 1.68 |
| 20 | Exemplified Compound (II)-(9) | 0.16 | 0.88 | 121 | 1.70 |
| 21 | Comparative Compound 2-C | 0.18 | 0.93 | 92 | 1.74 |
| 22 | Comparative Compound 2-A | 0.21 | 0.94 | 77 | 1.73 |

The results in Table 4 indicate that in the samples to which the auxiliary developing agents were directly added, the photographic fog was noticeably increased and the desensitization was large (Samples 21 and 22). On the contrary, when the precursors were used, the fog and the desensitization were small (Samples 19 and 20). Comparing Sample 21 using the comparative compound with Samples 19 and 20 using the precursors of the present invention, Samples 19 and 20 had the small photographic fog and the noticeably increased relative sensitivity.

Therefore, it is considered that the precursors of the present invention can be stably present in the films and the antifoggants can be released rapidly and timely at the time of the processing.

EXAMPLE 5

The procedure of Example 1 was repeated with the exception that the antifoggants or their precursors shown in Table 5 were employed, in order to prepare Samples 23 to 28. The latter were processed as in Example 1, and the thus processed samples were tested for photographic properties. The results are set forth in Table 5.

TABLE 5

| Sample No. | Antifoggant or its Precursor | Amount mol/m$^2$ | Fog | Gamma | Relative Sensitivity | Maximum Color Density |
|---|---|---|---|---|---|---|
| 23 | None | — | 0.14 | 0.78 | 100 | 1.61 |
| 24 | Exemplified Compound (III)-(1) | $2.0 \times 10^{-6}$ | 0.07 | 0.72 | 93 | 1.48 |
| 25 | Exemplified Compound (III)-(8) | $4.0 \times 10^{-6}$ | 0.10 | 0.77 | 97 | 1.58 |
| 26 | Exemplified Compound (III)-(12) | $2.0 \times 10^{-5}$ | 0.11 | 0.77 | 97 | 1.56 |
| 27 | Comparative Compound 1-D | $2.0 \times 10^{-6}$ | 0.07 | 0.65 | 75 | 1.25 |
| 28 | Comparative Compound 1-A | $2.0 \times 10^{-6}$ | 0.05 | 0.38 | 25 | 0.98 |

The results in Table 5 indicate that in Samples 24 and 25 using the compounds of the present invention, the photographic fog was diminished, the sensitivity being scarcely deteriorated.

On the contrary, when the precursor compounds and the antifoggants described in Japanese Patent Application (OPI) No. 135,949/82 were directly added, the deterioration of the sensitivity was large. Therefore, it is shown that the precursor compounds of the present invention can be stably present in the films and can release the antifoggants timely during the processing, whereby any desensitization cannot occur and the photographic fog can be diminished specifically.

EXAMPLE 6

The procedure of Example 2 was repeated with the exception that the auxiliary developing agents and their precursors shown in Table 6 were used, in order to prepare Samples 29 to 33. The latter were processed as in Example 2, and the thus processed samples were tested for photographic properties. The results are set forth in Table 6.

TABLE 6

| Sample No. | Auxiliary Developing Agent or its Precursor | Fog | Gamma | Relative Sensitivity | Maximum Color Density |
|---|---|---|---|---|---|
| 29 | None | 0.14 | 0.77 | 100 | 1.62 |
| 30 | Exemplified Compound | 0.14 | 0.87 | 121 | 1.73 |

TABLE 6-continued

| Sample No. | Auxiliary Developing Agent or its Precursor | Fog | Gamma | Relative Sensitivity | Maximum Color Density |
|---|---|---|---|---|---|
| | (III)-(27) | | | | |
| 31 | Exemplified Compound (III)-(29) | 0.15 | 0.81 | 117 | 1.70 |
| 32 | Comparative Compound 2-D | 0.14 | 0.78 | 102 | 1.63 |
| 33 | Comparative Compound 2-B | 0.17 | 0.89 | 80 | 1.75 |

The results in Table 6 indicate that in Samples 30 and 31 using the compounds of the present invention, the photographic fog was scarcely increased and the sensitization was obtained. On the contrary, with regard to the Sample 32 using the precursor (2-A) described in Japanese Patent Application (OPI) No. 53,330/80, the increase in the sensitivity was scarcely observed. With regard to Sample 33 in which the auxiliary developing agent (2-B) was added directly, the photographic fog was increased and the desensitization occurred.

EXAMPLE 7

The procedure of Example 1 was repeated with the exception that the antifoggants or their precursors shown in Table 7 were used, in order to prepare Samples 34 to 40. The latter were processed as in Example 1, and the thus processed samples were tested for photographic properties. The results are set forth in Table 7.

TABLE 7

| Sample No. | Antifoggant or its Precursor | Amount mol/m$^2$ | Fog | Gamma | Relative Sensitivity | Maximum Color Density |
|---|---|---|---|---|---|---|
| 34 | None (Control) | — | 0.15 | 0.78 | 100 | 1.61 |
| 35 | Exemplified Compound (IV)-(1) | $2.0 \times 10^{-6}$ | 0.07 | 0.73 | 93 | 1.49 |
| 36 | Exemplified Compound (IV)-(11) | $2.0 \times 10^{-6}$ | 0.11 | 0.76 | 96 | 1.55 |
| 37 | Exemplified Compound (IV)-(18) | $8.0 \times 10^{-6}$ | 0.12 | 0.77 | 97 | 1.56 |
| 38 | Comparative Compound 1-D | $2.0 \times 10^{-6}$ | 0.07 | 0.70 | 88 | 1.41 |
| 39 | Comparative Compound 1-E | $8.0 \times 10^{-6}$ | 0.08 | 0.71 | 89 | 1.43 |
| 40 | Comparative Compound 1-A | $2.0 \times 10^{-5}$ | 0 04 | 0.34 | 24 | 0.98 |

As is apparent from Table 7, in the case of Samples 35 to 37 in which the antifoggant precursors of the present invention were employed, the photographic fog was diminished, and in addition, the deterioration of the sensitivity was small. Samples 38 and 39 in which a phthalimido type precursor and its timing type precursor were employed for comparison had a lower sensitivity, as compared with the case using the precursor of the present invention. In Samples 39 and 40 to which the antifoggants were directly added, the desensitization was noticeable.

Therefore, it is shown that the precursors of the present invention are excellent in stability in the light-sensitive photographic material film and can release the antifoggants rapidly during the processing in order to thereby permit inhibiting desensitization and diminishing photographic fog specifically.

EXAMPLE 8

The procedure of Example 2 was repeated with the exception that the auxiliary developing agents or their precursors shown in Table 8 were used, in order to prepare Samples 41 to 46. The latter were processed as in Example 2, and the thus processed samples were tested for photographic properties. The results are set forth in Table 8.

TABLE 8

| Sample No. | Auxiliary Developing Agent or its Precursor | Fog | Gamma | Relative Sensitivity | Maximum Color Density |
|---|---|---|---|---|---|
| 41 | None (Control) | 0.13 | 0.68 | 100 | 1.60 |
| 42 | Exemplified Compound (IV)-(7) | 0.14 | 0.78 | 122 | 1.72 |
| 43 | Exemplified Compound (IV)-(19) | 0.13 | 0.73 | 118 | 1.70 |
| 44 | Comparative Compound 2-E | 0.18 | 0.87 | 95 | 1.76 |
| 45 | Comparative Compound 2-F | 0.17 | 0.86 | 97 | 1.75 |
| 46 | Comparative Compound 2-A | 0.21 | 0.88 | 81 | 1.73 |

As is apparent from Table 8, Samples 44 and 45 to which a phthalimido type precursor and its timing type precursor were added were indeed improved in regard to the photographic fog and the sensitivity, as compared with the Sample 46 to which the auxiliary developing agent was directly added. However, in Samples 42 and 43 to which the compounds of the present invention were added, the photographic fog was scarcely increased and the sensitivity was increased remarkably, which facts clearly indicate that the compounds of the present invention are predominant.

EXAMPLE 9

Estimation was made about the effectiveness of processing the development restrainer precursor of the present invention in the presence of an amine.

[Emulsion I]

To an aqueous gelatin solution maintained at 50° C., an aqueous silver nitrate solution, potassium iodide and an aqueous potassium bromide solution were added at one time over 60 minutes in the presence of $4\times10^{-7}$ mol of iridium (III) potassium hexachloride per mol of silver and ammonia, while pAg was maintained at a level of 7.8, in order to prepare a cubic monodisperse emulsion having the average silver iodide content of 1 mol%, the diameter of each monodisperse grain being 0.28 μm. The thus prepared emulsion was then washed with water in an ordinary manner to remove soluble salts therefrom, and gelatin was afterward added thereto. To give the chemical sensitization thereto, sodium thiosulfate was further added thereto. In succession, 0.1 mol% of an aqueous potassium iodide solution was added thereto to accomplish the conversion of the surfaces of the grains, so that an emulsion I was prepared.

To this emulsion I, there were added the sodium salt of 5,5'-dichloro-9-ethyl-3,3'-bis(3-sulfopropyl)oxacarbocyanine as a sensitizing dye, 4-hydroxy-6-methyl-1,3,3*a*,7-tetrazaindene as a stabilizer, a polyethylacrylate dispersion, polyethylene glycol, 1,3-vinylsulfonyl-2-propanol, each compound of the present invention shown in Table 9 and 2-[4-[2-(2,4-di-tert-pentylphenoxy)butyroamido]phenyl]-1-formylhydrazine. Afterward, a polyethylene terephthalate film was coated with the emulsion I just described so that an amount of silver might be 3.5 g/m² thereon. For comparison, there were prepared samples containing no compounds of the present invention and other samples containing development restrainers 1-A and 1-F which were not blocked. Thus, Samples 1 to 22 shown in Table 9 were prepared, and they were exposed to light and developed by the use of a developing solution I or II in order to examine the properties of the respective samples. The results are set forth in Table 9.

| | |
|---|---|
| Formulation of the developing solution I: | |
| Hydroquinone | 35.0 g |
| N—Methyl-p-aminophenol ½sulfate | 0.8 g |
| Sodium hydroxide | 9.0 g |
| Potassium tertiary phosphate | 74.0 g |
| Potassium sulfite | 90.0 g |
| Disodium ethylenediaminetetraacetate | 1.0 g |
| Sodium bromide | 3.0 g |
| 5-Methylbenzotriazole | 0.5 g |
| 3-Diethylamino-1-propanol | 15.0 g |
| Diethanolamine ((V)-(15)) | 15.0 g |
| Water | q.s. to 1 liter (pH = 11.6) |
| Formulation of developing solution II: | |
| Hydroquinone | 35.0 g |
| N—Methyl-p-aminophenol ½sulfate | 0.8 g |
| Sodium hydroxide | 9.0 g |
| Potassium tertiary phosphate | 74.0 g |
| Potassium sulfite | 90.0 g |
| Disodium ethylenediaminetetraacetate | 1.0 g |
| Sodium bromide | 3.0 g |
| 5-Methylbenzotriazole | 0.5 g |
| 2-Butylaminoethanol ((V)-(8)) | 17.0 g |
| Water | q.s. to 1 liter (pH = 11.6) |

The results are set forth in Table 9.

TABLE 9

| Sample No. | Emulsion | Amount of Compound A/ mol of Ag | Development Restrainer | Amount of Development Restrainer/ mol of Ag | Photographic Performance Sensitivity | Photographic Performance γ | Evaluation on Black Peppers |
|---|---|---|---|---|---|---|---|
| 1 | Developing Solution I | $3\times10^{-3}$ mol | — | — | 100 | 16 | 2 |
| 2 | " | $3\times10^{-3}$ mol | ((I)-(1)) | $2.4\times10^{-4}$ mol | 94 | 15.5 | 3.5 |
| 3 | " | " | " | $4.8\times10^{-4}$ mol | 88 | 13.5 | 4.5 |
| 4 | " | $3.3\times10^{-3}$ mol | " | " | 93 | 15 | 4 |
| 5 | " | $3\times10^{-3}$ mol | ((I)-(17)) | $5.4\times10^{-4}$ mol | 95 | 15 | 3.5 |
| 6 | " | " | " | $1.1\times10^{-3}$ mol | 91 | 14.5 | 4 |
| 7 | " | $3.3\times10^{-3}$ mol | " | " | 94 | 15 | 3.5 |
| 8 | " | $3\times10^{-3}$ mol | Comparative Compound 1-A | $2.4\times10^{-4}$ mol | 85 | 11.3 | 4 |
| 9 | " | " | " | $4.8\times10^{-4}$ mol | 69 | 10.6 | 5 |
| 10 | " | $3\times10^{-3}$ mol | Comparative Compound 1-F | $5.4\times10^{-4}$ mol | 93 | 14 | 3.5 |
| 11 | " | " | " | $1.1\times10^{-3}$ mol | 85 | 11 | 4 |
| 12 | Developing Solution II | $3\times10^{-3}$ mol | — | — | 100 | 16 | 2 |
| 13 | " | $3\times10^{-3}$ mol | (II)-(26)) | $2.4\times10^{-4}$ mol | 97 | 16.5 | 3.5 |
| 14 | " | " | " | $4.8\times10^{-4}$ mol | 83 | 13.5 | 4.5 |
| 15 | " | $3.3\times10^{-3}$ mol | " | " | 95 | 16.0 | 4 |
| 16 | " | $3\times10^{-3}$ mol | ((III)-(52)) | $2.4\times10^{-4}$ mol | 98 | 16 | 3.5 |
| 17 | " | " | " | $4.8\times10^{-4}$ mol | 96 | 16.5 | 4 |
| 18 | " | $3.3\times10^{-3}$ mol | " | " | 100 | 17 | 3.5 |
| 19 | " | $3\times10^{-3}$ mol | Comparative Compound 1-A | $2.4\times10^{-4}$ mol | 84 | 11.2 | 4 |

TABLE 9-continued

| Sample No. | Emulsion | Amount of Compound A/ mol of Ag | Development Restrainer | Amount of Development Restrainer/ mol of Ag | Photographic Performance Sensitivity | γ | Evaluation on Black Peppers |
|---|---|---|---|---|---|---|---|
| 20 | " | " | " | $4.8 \times 10^{-4}$ mol | 68 | 10.5 | 5 |
| 21 | " | $3 \times 10^{-3}$ mol | Comparative Compound 1-F | $5.4 \times 10^{-4}$ mol | 93 | 14.1 | 3.5 |
| 22 | " | " | " | $1.1 \times 10^{-3}$ mol | 84 | 10.9 | 4 |

As is apparent from Table 9, Samples 2 to 7 and 13 to 20 of the present invention can improve in the black peppers remarkably, while keeping up a higher sensitivity and a harder property, as compared with the comparative Samples 8 to 11 and 19 to 22.

(1) The relative sensitivity was a reciprocal number of an exposure to provide a turbidity of 1.5 in the development at 38° C. for 30 seconds, and was represented by a value relative to the value of Sample 1 regarded as 100.

(2) The black peppers were evaluated by classifying their quality into 5 degrees, and the best quality thereof is represented by a value of "5" and the worst quality is a value of "1". A usable state is indicated by a value of "5" or "4", a worse state within a practical limit is a value of "3", and an unpractical state is a value of "2" or "1". The quality thereof in the middle between the values "3" and "4" is judged to be "3.5", and a quality in the middle of the values "4" and "5" is a value of "4.5".

(3) The black peppers were evaluated from a result of the development at 38° C. for 30 seconds at the time when a pH of the developing solution was raised up to a level of 11.8.

EXAMPLE 10

A photographic element consisting of the undermentioned emulsion layer and protective layer was formed. The preparation of the emulsion layer and the protective layer as well as the coating manner of these layers was as follows: Blocked antifoggants or DIR compounds were each dissolved and emulsified in an aqueous gelatin solution containing tricresyl phosphate together with a coupler (Cp-1) to prepare an emulsifying dispersion, and the latter was then added to a silver iodobromide emulsion. Cellulose triacetate film supports provided with primer layers were then coated with the thus prepared emulsions. Furthermore, protective layers were coated on the emulsion layers respectively in order to prepare Samples 1 to 11. The coating amounts of the respective materials are denoted with the unit of "g/m²" or "mol/m²" in parentheses.

(1) Emulsion layer:

Negative silver iodobromide emulsion (grain size = 1.5 μm; silver content = $1.6 \times 10^{-2}$ mol/m²).

Antifoggant precursor or DIR compound ($8.0 \times 10^{-5}$ mol/m²).

Magenta coupler Cp-1 ($1.33 \times 10^{-3}$ mol/m²).

Tricresyl phosphate (0.959 g/m²).

Gelatin (2.5 g/m²).

(2) Protective layer:

Sodium salt of 2,4-dichloro-6-hydroxy-s-triazine (0.05 g/m²).

Gelatin (1.30 g/m²).

These films were allowed to stand for 14 hours under the conditions of 40° C. and a relative humidity of 70%, and subsequently subjected to exposure for sensitometry with white light. Then, the following color development processing (processing A) was carried out. For the processed samples, densities were measured by the use of green light, whereby the data of photographic properties were obtained.

| Color Development Processing Step | Time | Temperature |
|---|---|---|
| 1. Color development | 3 min. 15 sec. | 38° C. |
| 2. Bleaching | 6 min. 30 sec. | " |
| 3. Washing | 2 min. | " |
| 4. Fixing | 4 min. | " |
| 5. Washing | 4 min. | " |
| 6. Stabilization | 1 min. | " |

The compositions of the respective processing solutions for the color development processing steps were as follows:

| | |
|---|---|
| Color developing solution: | |
| Water | 800 ml |
| 4-(N—ethyl-N—hydroxyethyl)amino-2-methylaniline sulfate | 5 g |
| Sodium sulfite | 5 g |
| Potassium carbonate | 30 g |
| Potassium hydrogencarbonate | 1.2 g |
| Potassium bromide | 1.2 g |
| Sodium chloride | 0.2 g |
| Trisodium nitrilotriacetate | 1.2 g |
| Water | q.s. to 1 liter (H = 10.1) |
| Bleaching solution: | |
| Water | 800 ml |
| Ferric ammonium salt of ethylenediamine-tetraacetic acid | 100 g |
| Disodium ethylenediamine tetraacetate | 10 g |
| Potassium bromide | 150 g |
| Nitric acid | 10 g |
| Water | q.s. to 1 liter (pH = 6.0) |
| Fixer: | |
| Water | 800 ml |
| Ammonium thiosulphate | 150 g |
| Sodium sulfite | 10 g |
| Sodium hydrogensulfite | 2.5 g |
| Water | q.s. to 1 liter (pH = 6.0) |
| Stabilizer: | |
| Water | 800 ml |
| Formalin (37%) | 5 ml |
| Driwel (merchandised by Fuji Photo Film Co., Trade Name) | 3 ml |
| Water | q.s. to 1 liter |

Next, the procedure of the processing A was repeated with the exception that $5 \times 10^{-2}$ of amines shown in Table 10 was added to 1 liter of the color developing solutions of the processing A. These processings were defined as processings B to E. Incidentally, a pH of the developing solution in the processings B to E was 10.1.

With regard to Samples 1 to 11, values of the maximum color densities in the respective processings are set forth in Table 10.

TABLE 10

| Sample No. | Antifoggant Precursor | Processing Solution A type | B (V)-(2) | C (V)-(5) | D (V)-(15) | E (V)-(29) |
|---|---|---|---|---|---|---|
| 1 | Control | 1.39 | 1.31 | 1.29 | 1.33 | 1.25 |
| 2 | (I)-(3) | 1.38 | 0.87 | 0.85 | 0.89 | 0.86 |
| 3 | (I)-(46) | 1.39 | 0.83 | 0.81 | 0.85 | 0.84 |
| 4 | (I)-(13) | 1.37 | 0.91 | 0.87 | 0.93 | 0.93 |
| 5 | (II)-(26) | 1.33 | 0.99 | 0.92 | 1.05 | 0.94 |
| 6 | (II)-(44) | 1.35 | 0.85 | 0.80 | 0.89 | 0.83 |
| 7 | (III)-(51) | 1.38 | 0.97 | 0.91 | 1.02 | 0.92 |
| 8 | (III)-(11) | 1.34 | 0.82 | 0.77 | 0.88 | 0.79 |
| 9 | (IV)-(1) | 1.39 | 0.80 | 0.75 | 0.85 | 0.78 |
| 10 | (IV)-(4) | 1.34 | 0.75 | 0.71 | 0.83 | 0.74 |
| 11 | (IV)-(12) | 1.33 | 0.73 | 0.68 | 0.80 | 0.72 |

It is apparent from Table 10 that in the case of the processing solution A containing no amine, in Samples 2 to 11 containing the antifoggant precursor compounds, the deterioration of a color concentration was small. On the contrary, in the case that processing was done by the processing solutions B to E containing amines, in all Samples 2 to 11 containing the antifoggant precursors, the noticeable deterioration of color concentration was observed.

From the above mentioned facts, it is apparent that, in Samples 2 to 9, the amines accelerate the release of the antifoggants from the precursor compounds in the processing by the solutions B to E.

EXAMPLE 11

Coated Samples 12 to 15 were prepared in which amines ($4\times10^{-3}$ mol/m$^2$) were further contained in the emulsion layers as shown in Example 10. These film samples were exposed to light in the same manner as in Example 10, and the processings A and C in Example 10 were carried out. The obtained photographic properties are set forth in Table 11.

TABLE 11

| Sample No. | Antifoggant Precursor | Amine | Processing A Fog | Processing A Relative Sensitivity | Processing C Fog | Processing C Relative Sensitivity |
|---|---|---|---|---|---|---|
| Sample 1 of Example 10 | — | — | 0.13 | 100 | 0.14 | 95 |
| Sample 2 of Example 10 | (I)-(3) | — | 0.13 | 99 | 0.08 | 94 |
| 12 | (I)-(3) | (V)-(6) | 0.10 | 99 | 0.08 | 94 |
| 13 | (I)-(3) | (V)-(11) | 0.09 | 98 | 0.07 | 93 |
| Sample 5 of Example 10 | (II)-(26) | — | 0.13 | 99 | 0.07 | 94 |
| 14 | (II)-(26) | (V)-(18) | 0.08 | 99 | 0.07 | 94 |
| 15 | (II)-(26) | (V)-(24) | 0.08 | 98 | 0.06 | 93 |

The results in Table 11 indicate that in all the cases that the samples containing no amines were subjected to the processing A, any photographic fog did not diminish, but by the processing C, the fog was decreased, the relative sensitivity being scarcely lowered. On the other hand, in the cases of the samples in which the amines were included previously by coating, it is apparent that the processing A permitted diminishing the photographic fog remarkably, while keeping up the relative sensitivity substantially. Therefore, it is apparent that the acceleration effect of the deprivation reaction of the protected precursors by the amines according to the present invention can be displayed by the addition of the processing solution or by the previous coating to the sensitive materials.

As many apparently widely different embodiments of this invention may be made without departing from the spirit and scope thereof, it is to be understood that the invention is not limited to the specific embodiments thereof except as defined in the appended claims.

What we claim is:

1. A method of processing an imagewise exposed silver halide photographic material, which comprises subjecting the photographic material (a) containing at least one blocked photographic reagent, which is at least one member selected from the group consisting of compounds of the general formulae (I) to (IV):

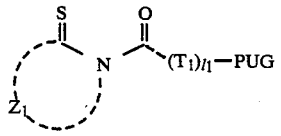

General formula (II):

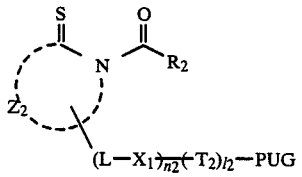

General formula (III):

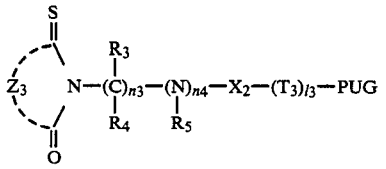

General formula (IV):

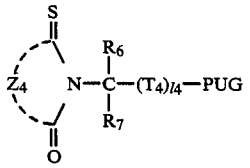

wherein PUG represents a photographically useful group; $T_1$, $T_2$, $T_3$ and $T_4$ independently represent a timing group; $R_2$, $R_3$, $R_4$, $R_5$, $R_6$ and $R_7$ independently represent a hydrogen atom or a substituent; $X_1$ and $X_2$ independently represent an electrophilic bond; L represents a connecting group; $Z_1$, $Z_2$, $Z_3$ and $Z_4$ independently represent a group of nonmetallic atoms forming a five- to seven-membered ring with or without a fused ring; $Z_1$ and $Z_2$ being connected to

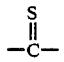

via a sulfur atom, an oxygen atom, or a substituted imino group; and $l_1$, $l_2$, $l_3$, $l_4$, $n_2$, $n_3$ and $n_4$ are independently 0 or 1, provided that in general formula (III), $n_3+n_4$ is an integer of 1 to 3, and capable of releasing a photographically useful reagent by cleavage of the carbon to nitrogen bond in the

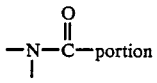

by nucleophilic attack of a nucleophilic reagent on the carbonyl group and subsequent intramolecular electron transfer reaction or intramolecular nucleophilic reaction and (b) having at least one photosensitive silver halide emulsion layer, to photographic processing in the presence of an amine.

2. A method according to claim 1, wherein said amine is selected from the compound represented by the following general formula:

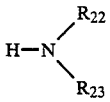

wherein $R_{22}$ and $R_{23}$ represent independently a hydrogen atom or a substituent.

3. A method according to claim 2, wherein $R_{22}$ and $R_{23}$, which may be the same or different, represent independently a hydrogen atom, an alkyl group, an aryl group, an alkenyl group, an aralkyl group, an amino group, an imino group, a hydroxy group, an alkoxy group, or an aryloxy group, the groups other than the hydrogen atom and the hydroxy group being substituted or unsubstituted, or $R_{22}$ and $R_{23}$ may be bonded to form a ring.

4. A method according to claim 2, wherein at least one of $R_{22}$ and $R_{23}$ is a hydrogen atom and the other is a substituted or unsubstituted alkyl or aryl group, or both $r_{22}$ and $R_{23}$ are independently a substituted or unsubstituted alkyl or aryl group.

5. A method according to claim 2, wherein $R_{22}$ and $R_{23}$ are independently a substituted or unsubstituted alkyl group, or $R_{22}$ represents a hydrogen atom and $R_{23}$ represents a substituted or unsubstituted alkyl group.

6. A method according to claim 1, wherein the blocked photographic reagent is selected from the compound of general formula (II) in which $n_2$ is 0 or the compounds of general formula (III) represented by the following general formula (IIIa) or (IIIb)

General formula (IIIa):

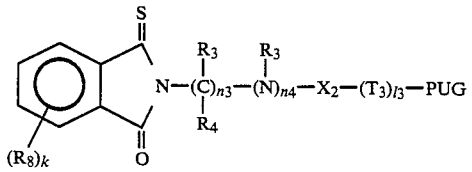

General formula (IIIb):

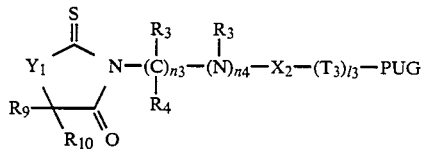

wherein PUG, $T_3$, $R_3$, $R_4$, $R_5$, $n_3$, $n_4$ and $l_3$ have the same meanings as defined in general formula (III), each $R_8$ represents a substituent which can be substituted to benzene, and k is an integer of from 0 to 4, $R_9$ and $R_{10}$ independently represent a hydrogen atom or a substituent but may join to give $R_9$, forming a double bond with the ring carbon, $Y_1$ represents an oxygen atom, a sulfur atom,

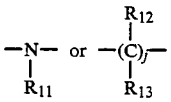

($R_{11}$, $R_{12}$ and $R_{13}$ independently represent a hydrogen atom or a substituent and j is 1 or 2. If j is 2, $R_{12}$ and $R_{13}$ on the two carbon atoms may be the same or different from each other, or may form a ring or double bond between the two carbon atoms).

7. A method according to claim 1, wherein the blocked photographic reagent is the compound of general formula (IV) represented by the following general formula (IVa) or (IVb)

General formula (IVa):

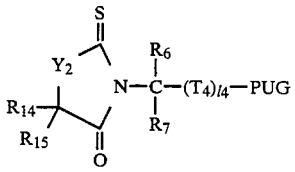

wherein PUG, $T_4$, $l_4$, $R_6$ and $R_7$ have, respectively, the same meanings as defined in formula (V), $R_{14}$ and $R_{15}$ independently represent a hydrogen atom or a substituent, and $Y_2$ represents an oxygen atom, a sulfur atom, $CR_{16}R_{17}$ or $NR_{18}$, in which $R_{16}$, $R_{17}$ and $R_{18}$ independently represent a hydrogen atom or a substituent, General formula (IVb):

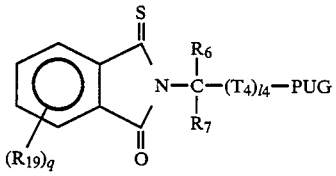

wherein PUG, $T_4$, $l_4$, $R_6$ and $R_7$ have, respectively, the same meanings as defined in formula (IV) and each $R_{19}$ represents a substituent and q is an integer of 0 to 4.

8. A method according to claim 1, wherein said amine is used by being added to a developer solution or by being added to the silver halide photographic material.

9. A method according to claim 1, wherein said amine is used in an amount of from $10^{-3}$ to 1 mole/liter when added to a processing solution or in an amount of from $10^{-7}$ to 10 moles per mole of silver when added to the photographic material.

10. A silver halide photographic material (a) containing at least one blocked photographic reagent and capable of releasing a photographically useful reagent by cleavage of the carbon to nitrogen bond in the

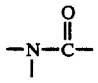

portion by nucleophilic attack of a nucleophilic reagent on the carbonyl group and subsequent intramolecular electron transfer reaction or intramolecular nucleophilic reaction and (b) having at least one photosensitive silver halide emulsion layer, said blocked photographic reagent being at least one member selected from the group consisting of compounds of the following general formulae (I) to (IV):

General formula (I):

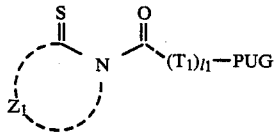

General formula (II):

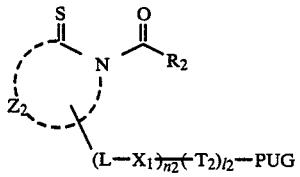

General formula (III):

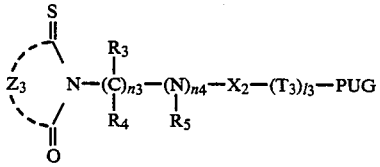

General formula (IV):

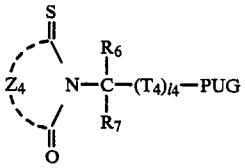

wherein PUG represents a photographically useful group; $T_1$, $T_2$, $T_3$, and $T_4$ independently represent a timing group; $R_2$, $R_3$, $R_4$, $R_5$, $R_6$ and $R_7$ independently represent a hydrogen atom or a substituent; $X_1$ and $X_2$ independently represent an electrophilic bond; L represents a connecting group; $Z_1$, $Z_2$, $Z_3$ and $Z_4$ independently represent a group of non-metallic atoms forming a five- to seven-membered ring with or without a fused ring, $Z_1$ and $Z_2$ being connected to

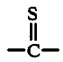

via a sulfur atom, an oxygen atom, or a substituted amino group; and $l_1$, $l_2$, $l_3$, $l_4$, $n_2$, $n_3$ and $n_4$ are independently 0 or 1, provided that in general formula (III), $n_3+n_4$ is an integer of 1 to 3.

11. A silver halide photographic material according to claim 10, wherein the group of the non-metallic atom represented by $Z_1$, $Z_2$, $Z_3$ and $Z_4$ is a member selected from the group consisting of alkylene, cycloalkylene, alkenylene, arylene, aralkylene, acylalkylene, acylaralkylene, thioalkylene, thioalkenylene, thioarylene, thioaralkylene, oxyalkylene, oxyalkenylene, oxyarylene, oxyaralkylene, aminoalkylene, aminoalkenylene, aminoarylene, aminoaralkylene and heterocyclene.

12. A silver halide photographic material according to claim 10, where $Z_1$,$Z_2$, $Z_3$ and $Z_4$ of general formulae (I) to (IV) independently have, as a hetero-atom, a sulfur atom, an oxygen atom or a substituted imino group.

13. A silver halide photographic material according to claim 10, wherein the blocked photographic reagent is selected from the compound of general formula (II) in which $n_2$ is 0 or the compounds of general formula (III) represented by the following general formula (IIIa) or (IIIb)

General formula (IIIa):

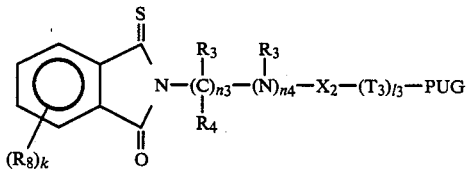

General formula (IIIb):

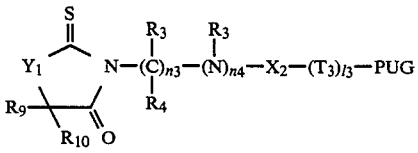

wherein PUG, $T_3$, $R_3$, $R_4$, $R_5$, $n_3$, $n_4$ and $l_3$ have the same meanings as defined in general formula (III), each $R_8$ represents a substituent which can be substituted to benzene, and k is an integer of from 0 to 4, $R_9$ and $R_{10}$ independently represent a hydrogen atom or a substituent but may join to give $R_9$, forming a double bond with the ring carbon, $Y_1$ represents an oxygen atom, a sulfur atom,

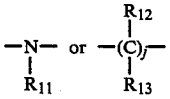

($R_{11}$, $R_{12}$ and $R_{13}$ independently represent a hydrogen atom or a substituent and j is 1 or 2. If j is 2, $R_{12}$ and $R_{13}$ on the two carbon atoms may be the same or different from each other, or may form a ring or double bond between the two carbon atoms).

14. A silver halide photographic material according to claim 10, wherein the blocked photographic reagent is the compound of general formula (IV) represented by the following general formula (IVa) or (IVb)

General formula (IVa):

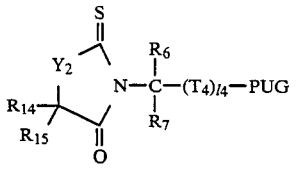

wherein PUG, $T_4$, $l_4$, $R_6$ and $R_7$ have, respectively, the same meanings as defined in formula (IV), $R_{14}$ and $R_{15}$ independently represent a hydrogen atom or a substituent, and $Y_2$ represents an oxygen atom, a sulfur atom, $CR_{16}R_{17}$ or $NR_{18}$, in which $R_{16}$, $R_{17}$ and $R_{18}$ independently represent a hydrogen atom or a substituent, General formula (IVb):

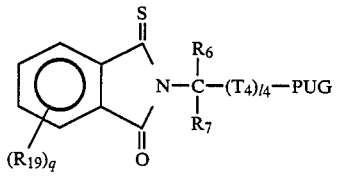

wherein PUG, $T_4$, $l_4$, $R_6$ and $R_7$ have, respectively, the same meanings as defined in formula (IV) and each $R_{19}$ represents a substituent and q is an integer of 0 to 4.

15. A silver halide photographic material according to claim 10, wherein each PUG in general formulae (I) to (IV) is an antifoggant, a development restrainer, a developing agent, an auxiliary developing agent, a nucleating agent, a solvent for silver halide, a bleach accelerator, an azo dye, an azomethine dye, a colorant for a color diffusion and transfer sensitizer or a DIR-hydroqinone.

16. A silver halide photographic material according to claim 10, wherein $R_1$ to $R_7$ in general formulae (I) to (IV) independently represent an alkyl group having from 1 to 17 carbon atoms or an aryl group having from 6 to 21 carbon atoms.

17. A silver halide photographic material according to claim 10, wherien $X_1$ and $X_2$ in general formulae (I) to (IV) independently represent a carbonyl group, a thiocarbonyl group, a sulfonyl group or a sulfinyl group.

18. A silver halide photographic material according to claim 10, wherein L in the general formula (II) represents an oxyalkylene group having from 1 to 18 carbon atoms, a carboxyalkylene group having from 2 to 19 carbon atoms or an oxyalkylene amino group having from 2 to 19 carbon atoms.

19. A silver halide photographic material according to claim 10, wherein $T_1$ to $T_4$ in general formulae (I) to (IV) is selected from an electron transfer-type timing group.

20. A silver halide photographic material according to claim 10, wherein the compounds of general formulae (I) to (IV) are used in such amounts that, an anti-foggant or development restrainer is in an amount of from $10^{-8}$ to $10^{-1}$ mole per mole of silver; a developing agent is in an amount of from $10^{-2}$ to 10 moles per mole of silver; a pyrazolidone auxiliary developing agent is in an amount of from $10^{-4}$ to 10 moles per mole of silver; a development promoter or a nucleating agent is in an amount of from $10^{-2}$ to $10^{-6}$ mole per mole of silver; a solvent for silver halide is in the range of from $10^{-3}$ to 10 moles per mole of silver; and a dye or a colorant for color diffusion and transfer photography is in the range of from $10^{-3}$ to 1 mole per mole of silver.

21. A method according to claim 1, wherein the five- to seven-membered ring of $Z_1$ in general formula (I) is selected from the group consisting of thiosuccinic acid imide, thiomaleimide, imidazoline-2-thio-5-one, imidazolidine-2-thio-4-one, oxazolidine-2-thio-4-one, thiazoline-2-thio-4-one, thiophthalimide, piperidine-6-thio-2-one, dihydrooxazine-2-thio-4-one, tetrahydrooxazine-2-thio-4-one, dihydrothiazine-2-thio-4-one, tetrahydrothiazine-2-thio-4-one, tetrahydro pyrimidine-2-thio-4-one, hexahydropyrimidine-2-thio-4-one, dihydroazepine-7-thio-2-one, tetrahydroazepine-7-thio-2-one, and hexahydroazepine-7-thio-2-one.

22. A silver halide photographic material according to claim 10, wherein the five- to seven-membered ring of $Z_1$ in general formula (I) is selected from the group consisting of thiosuccinic acid imide, thiomaleimide, imidazoline-2-thio-5-one, imidazolidine-2-thio-4-one, oxazolidine-2-thio-4-one, thiazoline-2-thio-4-one, thiophthalimide, piperidine-6-thio-2-one, dihydrooxazine-2-thio-4-one, tetrahydrooxazine-2-thio-4-one, dihydrothiazine-2-thio-4-one, tetrahydrothiazine-2-thio-4-one, tetrahydropyrimidine-2-thio-4-one, hexahydropyrimidine-2-thio-4-one, dihydroazepine-7-thio-2-one, tetrahydroazepine-7-thio-2-one, and hexahydroazepine-7-thio-2-one.

* * * * *